US010333242B2

(12) United States Patent
Savicki, Jr.

(10) Patent No.: US 10,333,242 B2
(45) Date of Patent: Jun. 25, 2019

(54) ELECTRICAL WIRING DEVICE WITH SHUTTERS

(71) Applicant: Pass & Seymour, Inc., Syracuse, NY (US)

(72) Inventor: Gerald R. Savicki, Jr., Canastota, NY (US)

(73) Assignee: Pass & Seymour, Inc., Syracuse, NY (US)

( * ) Notice: Subject to any disclaimer, the term of this patent is extended or adjusted under 35 U.S.C. 154(b) by 0 days.

(21) Appl. No.: 15/863,084

(22) Filed: Jan. 5, 2018

(65) Prior Publication Data

US 2018/0131120 A1 May 10, 2018

Related U.S. Application Data

(63) Continuation of application No. 15/401,230, filed on Jan. 9, 2017, now Pat. No. 9,893,456, which is a (Continued)

(51) Int. Cl.

| | |
|---|---|
| ***H01R 13/453*** | (2006.01) |
| ***H01R 25/00*** | (2006.01) |
| ***H01R 13/713*** | (2006.01) |
| ***H01R 24/28*** | (2011.01) |
| ***H01R 13/68*** | (2011.01) |
| *H01R 107/00* | (2006.01) |
| *H01R 103/00* | (2006.01) |
| *H01R 24/76* | (2011.01) |

(52) U.S. Cl.

CPC ..... *H01R 13/4532* (2013.01); *H01R 13/4534* (2013.01); *H01R 13/68* (2013.01); *H01R 13/7135* (2013.01); *H01R 24/28* (2013.01); *H01R 25/006* (2013.01); *H01R 24/76* (2013.01); *H01R 2103/00* (2013.01); *H01R 2107/00* (2013.01)

(58) Field of Classification Search

CPC ..... H01R 13/4534; H01R 13/4532

See application file for complete search history.

(56) References Cited

U.S. PATENT DOCUMENTS 5,518,132 A 5/1996 Chen
5,605,466 A 2/1997 Devlin et al.
(Continued)

*Primary Examiner* — Ross N Gushi

(74) *Attorney, Agent, or Firm* — Bond Schoeneck & King, PLLC; George McGuire; Frederick Price

(57) ABSTRACT

An electrical device includes a shutter support structure having a return position, at least one blocking position and an open position. A first shutter element is configured to rotate about a first dimensional axis within a predetermined angular range while being translated in two-dimensions between the return position to the open position, each of the two dimensions being orthogonal to the first dimensional axis. A second shutter assembly includes a second shutter element coupled to the first shutter element, the first shutter element allowing the second shutter portion to move in a first direction parallel to the first dimensional axis when the first shutter element is in the open position, the first shutter element being configured to drive the second shutter element in a second direction parallel to the first dimensional axis when the first shutter element is being translated into the return position.

49 Claims, 44 Drawing Sheets

Related U.S. Application Data continuation of application No. 14/857,155, filed on Sep. 17, 2015, now Pat. No. 9,543,715.

(60) Provisional application No. 62/079,028, filed on Nov. 13, 2014, provisional application No. 62/063,757, filed on Oct. 14, 2014.

(56) References Cited

U.S. PATENT DOCUMENTS

| | | | |
|---|---|---|---|
| 5,902,140 | A | 5/1999 | Cheung et al. |
| 6,015,306 | A | 1/2000 | Jen |
| 6,086,391 | A | 7/2000 | Chiu |
| 6,108,178 | A | 8/2000 | Beadles |
| 6,149,446 | A | 11/2000 | Yu |
| 6,217,353 | B1 | 4/2001 | Yu-Tse |
| 6,224,401 | B1 | 5/2001 | Yu |
| 6,238,224 | B1 | 5/2001 | Shao |
| 6,341,981 | B1 | 1/2002 | Gorman |
| 6,422,880 | B1 | 7/2002 | Chiu |
| 6,425,773 | B2 | 7/2002 | Mosebach et al. |
| 6,537,088 | B2 | 3/2003 | Huang |
| 6,555,771 | B2 | 4/2003 | Shao |
| 6,674,003 | B1 | 1/2004 | Torres |
| 6,749,449 | B2 | 6/2004 | Mortun et al. |
| 6,767,228 | B2 | 7/2004 | Katz |
| 6,863,561 | B2 | 3/2005 | Gorman |
| 6,916,989 | B2 | 7/2005 | Boussard, Jr. |
| 6,932,631 | B2 | 8/2005 | Huang |
| 6,986,674 | B1 | 1/2006 | Gorman |
| 7,026,895 | B2 | 4/2006 | Germain et al. |
| 7,088,205 | B2 | 8/2006 | Germain et al. |
| 7,088,206 | B2 | 8/2006 | Germain et al. |
| 7,211,729 | B1 | 5/2007 | Yang |
| 7,227,435 | B2 | 6/2007 | Germain et al. |
| 7,364,444 | B2 | 4/2008 | Kellock et al. |
| 7,438,567 | B2 | 10/2008 | Nalwad et al. |
| 7,510,412 | B1 | 3/2009 | Valentin |
| 7,551,047 | B2 | 6/2009 | Sokolow et al. |
| 7,588,447 | B1 | 9/2009 | Ni |
| 7,645,148 | B2 | 1/2010 | Carbone et al. |
| 7,695,293 | B1 | 4/2010 | Sikes |
| 7,833,030 | B1 | 11/2010 | Huang |
| 7,887,346 | B1 | 2/2011 | Huang |
| 7,931,482 | B2 | 4/2011 | Liao |
| 7,985,085 | B2 | 7/2011 | Gao |
| 8,007,296 | B2 | 8/2011 | Chen et al. |
| 8,187,011 | B1 | 5/2012 | Baldwin et al. |
| 8,187,012 | B1 | 5/2012 | Baldwin et al. |
| 8,193,445 | B2 | 6/2012 | Li |
| 8,215,972 | B2 | 7/2012 | Wang |
| 8,523,599 | B2 | 9/2013 | Lazzaro |
| 8,632,348 | B2 | 1/2014 | Baldwin et al. |
| 8,672,695 | B2 | 3/2014 | Baldwin et al. |
| 8,808,013 | B2 | 8/2014 | Baldwin et al. |
| 8,888,514 | B2 | 11/2014 | Baldwin et al. |
| 9,543,715 | B2 * | 1/2017 | Savicki, Jr. ..... H01R 25/006 |
| 2014/0065862 | A1 | 3/2014 | Tomimbang |

* cited by examiner

ELECTRICAL WIRING DEVICE WITH SHUTTERS

CROSS REFERENCE TO RELATED APPLICATION

This application is a continuation of U.S. patent application Ser. No. 15/401,230 filed on Jan. 9, 2017, which is a continuation of U.S. patent application Ser. No. 14/857,155 filed on Sep. 17, 2015, which claims the benefit of and priority under 35 U.S.C. § 119 to U.S. Provisional Patent Application Ser. Nos. 62/079,028 filed on Nov. 13, 2014 and 62/063,757 filed on Oct. 14, 2014, the contents of each are relied upon and incorporated herein by reference in their respective entireties, and the benefit of priority under 35 U.S.C. §§ 119, 120 is hereby claimed.

BACKGROUND OF THE INVENTION

1. Field of the Invention

The present invention relates generally to electrical wiring devices, and particularly to tamper-resistant electrical wiring devices.

2. Technical Background

Electrical power is provided to users by way of electrical distribution systems that typically include electrical wiring from a utility power source to a breaker panel disposed in a house, building or some other facility. The breaker panel distributes AC power to one or more branch electric circuits installed in the structure. The electric circuits may typically include one or more electrical wiring devices that regulate, monitor or provide AC power to other devices. Each electrical wiring device is equipped with electrical terminals that provide a means for connecting the device to the source of AC power and a means for connecting the device to a load. Specifically, line terminals couple the device to the source of AC electrical power, whereas load terminals couple power to the load. Load terminals may also be referred to as "feed-through" or "downstream" terminals because the wires connected to these terminals may be coupled to a daisy-chained configuration of receptacles or switches.

Thus, an electric circuit may include many different electrical wiring devices disposed at various locations throughout a structure. Outlet receptacles, switches and protective devices are examples or types of electrical wiring devices. Ground fault circuit interrupters (GFCIs), and arc fault circuit interrupters (AFCIs) are examples of protective devices in electric circuits. Switches, protective devices and other types of electrical devices are often provided in combination with receptacles. For example, outlet receptacles are disposed in duplex receptacles, raceways, multiple outlet strips, power taps, extension cords, light fixtures, appliances, and the like. When the wiring terminations of these devices (i.e., wiring terminals, plugs, etc.) of these devices are connected to the electrical distribution system, the receptacle contacts may be energized. When the power cord of an electrical appliance is inserted into the receptacle outlet, the electrical appliance is also energized or capable of being energized (i.e., turned ON).

The insertion of a foreign object into an outlet receptacle opening is usually a safety hazard. For example, young children and toddlers are known to have a proclivity toward inserting objects such as paper clips or screwdriver blades into receptacle contact openings. (This should be a cause for alarm, especially in light of the fact that, e.g., GFCIs are configured to trip in response to a mere 6 mA current). Even a small current (in the mA range) passing through a human body to ground can result in an electric shock, burns, or electrocution (a fatal shock event). As a result, the use of shutters has long been a means for preventing foreign objects from making contact with the receptacle contacts disposed within the receptacle openings. One drawback to this approach relates to the ineffectiveness of related art designs. In many conventional designs, the shutters will typically open when objects are placed into both openings and expose the person to a shock hazard. What is needed is a shutter mechanism that only opens when an actual corded plug is inserted into the receptacle.

Another drawback to this approach relates to the complexity of related art shutters. Many shutter designs comprise multiple parts and spring elements. For example, in one conventional approach that has been considered, the shutter must be intricately installed within a base platform (by hand) after positioning a delicate leaf spring element within the base. The cost and time of assembling the shutter mechanism, and the space taken up by their multiple parts, limit the usage of these designs. Moreover, automated environments often generate vibrations and mechanical forces that tend to introduce failure modes. Specifically, vibrations tend to cause the leaf spring to become dislodged or otherwise become separated from the platform. In addition, when objects are inserted into the receptacle opening, the shutter is forced to press against the leaf spring while moving upwardly and downwardly within the base platform. This type of movement increases the likelihood that the leaf spring will be dislodged. Once this happens, the receptacle device is either inoperable or unprotected.

Another drawback to conventional shutter designs relates to the assumption that keyed receptacle openings will ensure that the plug blades are inserted into the receptacle openings simultaneously. While this is true to a certain extent, there is still a great deal of room for skewing and side-to-side movement until the blades are captured by the receptacle contacts. For example, in real life, when someone attempts to insert a corded plug into a receptacle opening, they very often wiggle the plug in an effort to align the plug blades with the cover apertures. These back and forth skewing movements cause the plug blades to strike the shutter with varying amounts of force at different instants of time (not simultaneously). Similar issues can be caused by plug blades that are bent or not of the same length. Conventional shutters typically employ a linear slide motion and become jammed and inoperative after they absorb repeated nicks and gouges.

What is needed is a shutter assembly that is configured to operate smoothly (and robustly) even when foreign objects or uneven plug blades are forcefully inserted. What is also needed is a relatively simple protective shutter assembly that is easy to install within an electrical wiring device. What is needed is a shutter assembly that can freely float to prevent the aforementioned jamming issues.

SUMMARY OF THE INVENTION

The present invention addresses the needs described above by providing a shutter assembly and tandem shutter element or assembly, each of which is configured to operate smoothly (and robustly) even when foreign objects or uneven plug blades are forcefully inserted. The present invention also provides a relatively simple protective shutter assembly and tandem shutter element or assembly, each of which is easy to install within an electrical wiring device. The present invention also provides a shutter assembly that can freely float to prevent the aforementioned jamming issues.

One aspect of the present invention is directed to an electrical device that includes a housing including a front cover coupled to at least one body member, the front cover including a plurality of receptacle openings in a major front surface thereof, the plurality of receptacle openings being configured to receive a plurality of plug blades of a corded electrical plug, the at least one body member including at least one set of receptacle contacts configured to mate with the plurality of plug blades; a guidance structure corresponding to the at least one set of receptacles coupled to the front cover, the guidance structure including a first guidance portion and a second guidance portion; and a shutter assembly including a first shutter portion coupled to a second shutter portion, the first shutter portion being coupled to the first guidance portion in a return position when not engaged by an object and rotatable about the first guidance portion from the return position to a shutter blocking position in response to being engaged by the object via one of the plurality of receptacle openings, the object being prevented from obtaining access to the at least one set of receptacle contacts in the blocking position, the first shutter portion substantially preventing the second shutter portion from moving in the return position or the blocking position, the first shutter portion being translated from the return position on the first guidance portion to an open position on the second guidance portion in response to being engaged by the plurality of plug blades, the first shutter portion allowing the second shutter portion to move from a closed second shutter position to an open second shutter position in the open position, the first shutter portion being coupled to the guidance structure so that the first shutter portion rotationally self-aligns to the plurality of plug blades when the shutter element is translated from the return position to the open position.

In one embodiment, the first shutter portion is configured to rotate while being translated in two-dimensions from the return position to the open position, each of the two dimensions being orthogonal to a first dimensional axis, the first shutter portion allowing the second shutter portion to move in a direction parallel to the first dimensional axis when the first shutter portion is in the open position.

In one embodiment, the first shutter portion includes an elongated portion configured and positioned to prevent movement of the second shutter portion from the closed second shutter position to the open second shutter position when the first shutter portion is in the return position or the blocking position.

In one embodiment, the second shutter portion further comprises a cam portion configured to be engaged by the elongated portion, and wherein the elongate portion is configured and positioned to engage the cam portion so that the second shutter assembly is repositioned to the closed second shutter position when the first shutter portion is translated from the open position to the return position.

In one embodiment, the guidance structure includes a pivot region disposed between the first guidance portion and the second guidance portion.

In one embodiment, the first shutter portion is configured to rotate about the pivot region in the blocking position.

In one embodiment, the first shutter portion is configured move from the return position to the open position via the pivot position when the first shutter portion is engaged by the plurality of plug blades.

In one embodiment, the first shutter portion includes an aperture configured to allow one of the plurality of plug blades to pass through in the open position.

In one embodiment, the shutter assembly includes a spring configured to bias the first shutter portion in the return position, and wherein the spring is selected from a group of springs that include a torsion spring or a compression spring.

In one embodiment, the first shutter portion is configured to apply a rotational force to the compression spring when the first shutter portion moves from the return position to the open position.

In one embodiment, the guidance structure is an integrally molded feature of an interior surface of the front cover.

In one embodiment, the guidance structure is configured to be inserted in an interior surface of the front cover.

In one embodiment, the housing includes a wiring device housing, a duplex receptacle housing, a decorator housing, an extension cord housing, a multiple outlet strip housing, a combination receptacle and switch housing.

In one embodiment, the electrical device further includes a protection circuit, a ground fault circuit interrupter, an arc fault circuit interrupter, or a surge protective device.

In one embodiment, the second shutter portion further comprises a stationary guide member configured to be disposed in the front cover and a second shutter element configured to be linearly moveable within the stationary guide member.

In one embodiment, the second shutter portion includes a blocking cam and a plug blade cam disposed obliquely relative to the blocking cam.

In one embodiment, the first shutter portion includes an elongated finger configured to engage the blocking cam in the return position or the blocking position so that the second shutter element is prevented from moving linearly within the stationary guide member.

In one embodiment, the plug blade cam is configured to engage a portion of a 20 A neutral plug blade so that the second shutter element moves linearly within the stationary guide member in the open position.

In one embodiment, two surface of the first shutter portion bear against the guidance structure in the blocking position.

In one embodiment, the plurality of receptacle contacts includes at least one hot contact.

In one embodiment, the plurality of receptacle contacts includes a neutral contact.

In one embodiment, the electrical device further includes a plurality of termination at least partially disposed in the housing and configured to be connected to a source of power, the terminations being electrically coupled to the plurality of receptacle contacts.

In one embodiment, the source of power is 120 Vac.

In one embodiment, the terminations each include a binding screw.

In another aspect, the present invention is directed to an electrical device shutter including a housing including a front cover coupled to at least one body member, the front cover including a plurality of receptacle openings in a major front surface thereof, the plurality of receptacle openings being configured to receive a plurality of plug blades of a corded electrical plug, the at least one body member including at least one set of receptacle contacts configured to mate with the plurality of plug blades; a guidance structure configured to allow a first shutter element to move between a plurality of positions including a return position, at least one blocking position and an open position; a first shutter assembly including the first shutter element coupled to the guidance structure, the first shutter element being configured to rotate within a predetermined angular range while being translated in two-dimensions between the return position to the open position, each of the two dimensions being orthogonal to a first dimensional axis; and a second shutter assembly including a second shutter element coupled to the first shutter element, the first shutter element allowing the second shutter element to move in a direction parallel to the first dimensional axis in a first direction when the first shutter element is being translated into the open position, the first shutter element being configured to drive the second shutter element in a direction parallel to the first dimensional axis in a second direction when the first shutter element is being translated into the return position.

In one embodiment, the electrical device further includes a stationary guide member, and wherein the second shutter element is configured to be linearly moveable within the stationary guide member.

In one embodiment, the second shutter element includes a blocking cam and a plug blade cam disposed obliquely relative to the blocking cam.

In one embodiment, the first shutter portion includes an elongated finger configured to engage the blocking cam in the return position or the blocking position so that the second shutter element is prevented from moving linearly within the stationary guide member.

In one embodiment, the plug blade cam is configured to engage a portion of a 20 A neutral plug blade so that the second shutter element moves linearly within the stationary guide member in the open position.

In one embodiment, the guidance structure is formed in a front cover of an electrical wiring device.

In one embodiment, the guidance structure further comprises a stationary guide member configured to accommodate the first shutter element and the second shutter element.

In one embodiment, the guidance structure includes a pivot region disposed between a first guidance portion and a second guidance portion.

In one embodiment, the shutter assembly includes a spring configured to bias the first shutter element in the return position, and wherein the spring is selected from a group of springs that include a torsion spring or a compression spring.

In one embodiment, the first shutter element is configured to apply a rotational force to the compression spring when the first shutter element moves from the return position to the open position.

In one embodiment, the guidance structure includes at least one guide rib and the first shutter element is coupled to the at least one guide rib by way of two bearing surfaces when in the at least one blocking position.

In one embodiment, the plurality of receptacle contacts includes at least one hot contact.

In one embodiment, the plurality of receptacle contacts includes a neutral contact.

In one embodiment, the electrical device further includes a plurality of termination at least partially disposed in the housing and configured to be connected to a source of power, the terminations being electrically coupled to the plurality of receptacle contacts.

In one embodiment, the source of power is 120 Vac.

In one embodiment, the terminations each include a binding screw.

Reference is made to U.S. Pat. No. 8,044,299, which is incorporated herein by reference as though fully set forth in its entirety, for a more detailed explanation of an electrical device being configured to accommodate a shutter assembly in the front cover thereof. To be specific, U.S. Pat. No. 8,044,299 discloses a GFCI electrical device, an AFCI electrical device, 15 A electrical device, 20 A electrical device, a GFCI/switch combination electrical device, GFCI/Night light combination electrical device, a TVSS electrical device, a power outlet strip electrical device, a portable electrical device, and a raceway electrical device, all of which are configured to accommodate a shutter assembly in the front cover thereof and all of which are incorporated herein by reference as though fully set forth in their entirety.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

The accompanying drawings are included to provide a further understanding of the invention, and are incorporated in and constitute a part of this specification. The drawings illustrate various embodiments of the invention and together with the description serve to explain the principles and operation of the invention.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
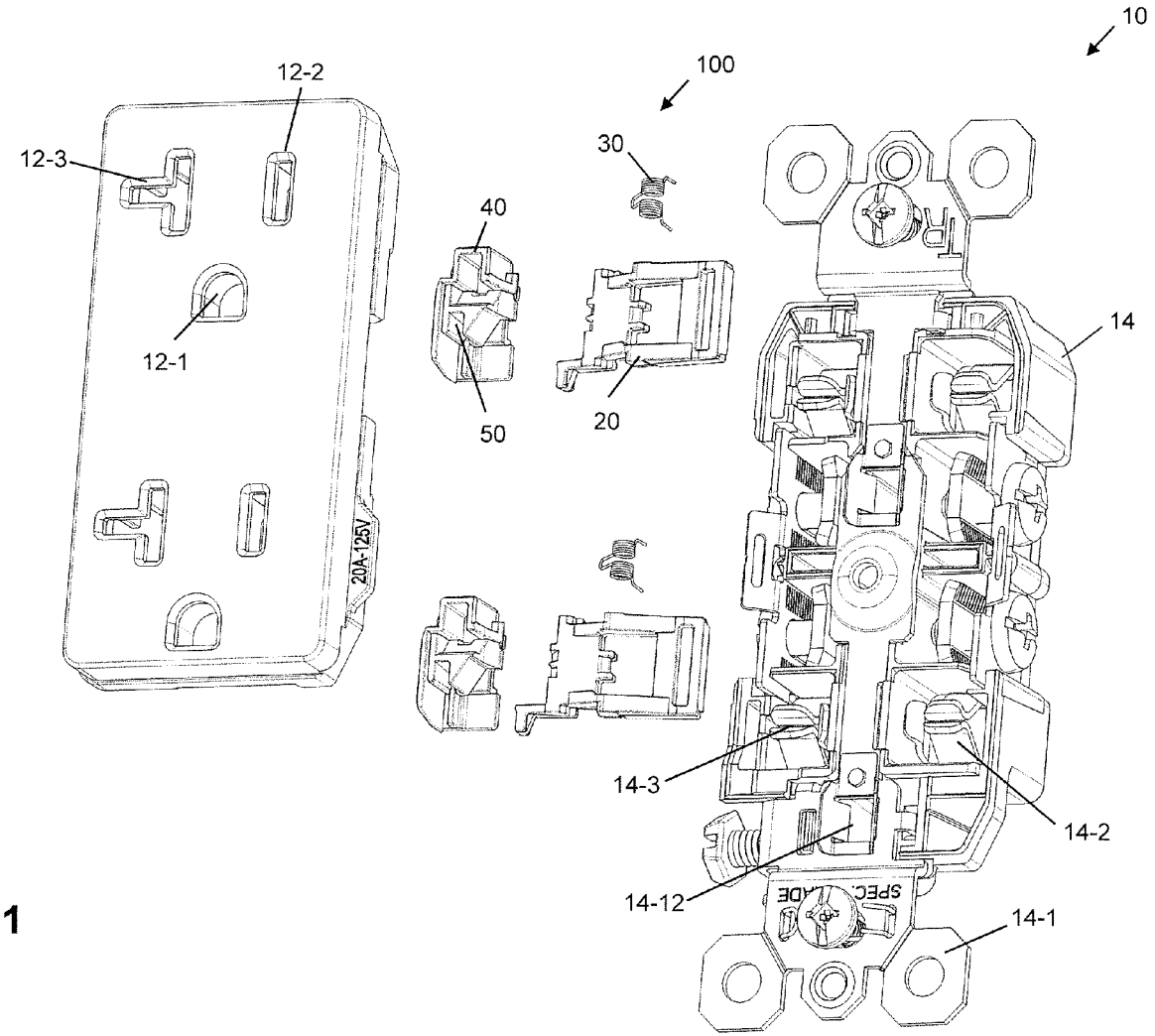
FIG. 1 is an exploded view of an electrical device with the front cover and the shutter assembly removed in accordance with an embodiment of the present invention.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of an electrical device with a shutter assembly and tandem shutter element or assembly of the present invention is shown in FIG. 1, and is designated generally throughout by reference numeral 10. Specifically, the electrical wiring device is designated generally throughout by reference numeral 10 and the shutter assembly by reference numeral 100. (The shutter assembly 100 includes a shutter 20, spring element 30, guide member 40 and tandem shutter 50).

With reference to FIG. 1, the proposed 20 A shutter assembly 100 may be used in an electrical wiring device 10, which is shown herein as a 15 A/20 A receptacle device (since the neutral opening 12-3 is configured with a T-slot). Of course, shutter assembly 100 may be used in a strictly 20 A receptacle where neutral opening 12-3 is just a rectangular slot that is normal to opening 12-2. Those skilled in the art will appreciate that the shutter assembly 100 may be adapted for use in protective wiring devices such as GFCIs, AFCIs, TVSSs and the like.

Receptacle 10 includes a cover 12 and a back body 14 and is configured as a duplex device (providing two sets of plug blade openings, one set at each end thereof). Each set of plug blade openings includes a ground prong aperture 12-1, a hot opening 12-2 and a neutral opening 12-3. The cover 12 is configured to mate with a back body 14 that includes a ground strap 14-1, a hot conductor that includes hot contacts 14-2 and a neutral conductor that includes neutral contacts 14-3. The ground aperture 12-1 is aligned and in communication with a ground contact 14-12 formed in the ground strap 14-1, the hot aperture 12-2 is aligned and in communication with a hot contact 14-2, and the neutral aperture 12-3 is aligned and in communication with a neutral contact 14-3. A shutter assembly 100 is positioned between each set of hot and neutral plug blade openings (12-2, 12-3 respectively) and their corresponding hot and neutral contacts (14-2, 14-3), respectively. Shutter assembly 100 may also be employed in receptacle configurations in which a ground contact and aperture are omitted, referred to as a "two opening receptacle."

Each shutter assembly 100 is equipped with a dual-torsion return spring 30 that is configured to move the shutter to a "return" or "rest" position when no external force is applied to the shutter by a plug or foreign object. To be more specific, the shutter 20 can rotate about an axis between about +/−8 degrees in this position/state. All told, the shutter 20 may be in one of four positions: a return position, a neutral blocking position; a hot blocking position; or an open position. The main shutter 20A operates in concert with the tandem shutter portion that includes the stationary guide member 40 and the tandem shutter 50. Two tandem shutters 50 are shown; one for each neutral opening 12-3 disposed on the cover 12. Each tandem shutter 50 resides within, and is linearly moveable within its respective guide member 40 positioned over the horizontal portion of its respective neutral aperture 12-3. As described herein, the main shutter 20 is rotationally translated in the X-Z plane to allow a linear translation of the tandem shutter 50 in the Y-direction when the shutter assembly 100 moves from the return position to the open position. Specifically, the tandem shutter 50 has two states; an open state when the shutter 20 is opened, and a blocking state when the shutter 20 is in the return or blocking states.

Figure 2:
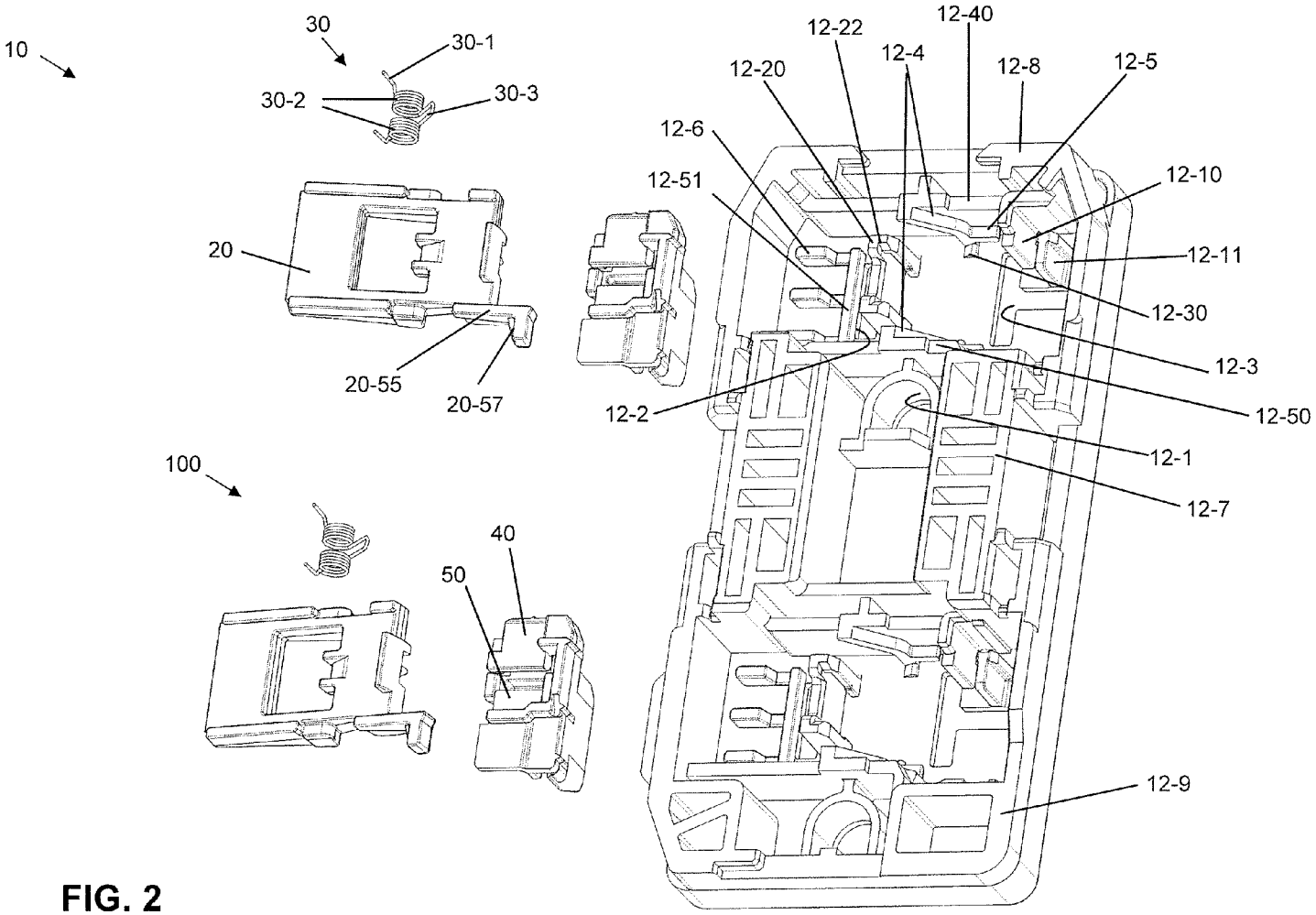
FIG. 2 is an exploded view of an interior of the front cover and the shutter assembly depicted in FIG. 1.

In reference to FIG. 2, the shutter assembly 100 is shown prior to being inserted into the internal portion of the cover 12. The dual torsion spring 30 includes retention portions 30-1 at each side thereof, the retention portions 30-1 are configured to be inserted into snap-in ("spring catch") elements 12-22 formed in the anti-probing wall 12-20 (adjacent to the hot aperture 12-2) of cover 12. A central bearing portion 30-3 is disposed between each coiled spring element 30-2. Each coiled spring element 30-2 is approximately 0.1 inches in diameter and is fabricated from a wire that is 0.01 inches in diameter. The return spring 30 is configured to apply a small amount of (approximately 100-200 grams) rotational force to the shutter 20 in order to direct the shutter 20 into a biased return state.

Figure 3:
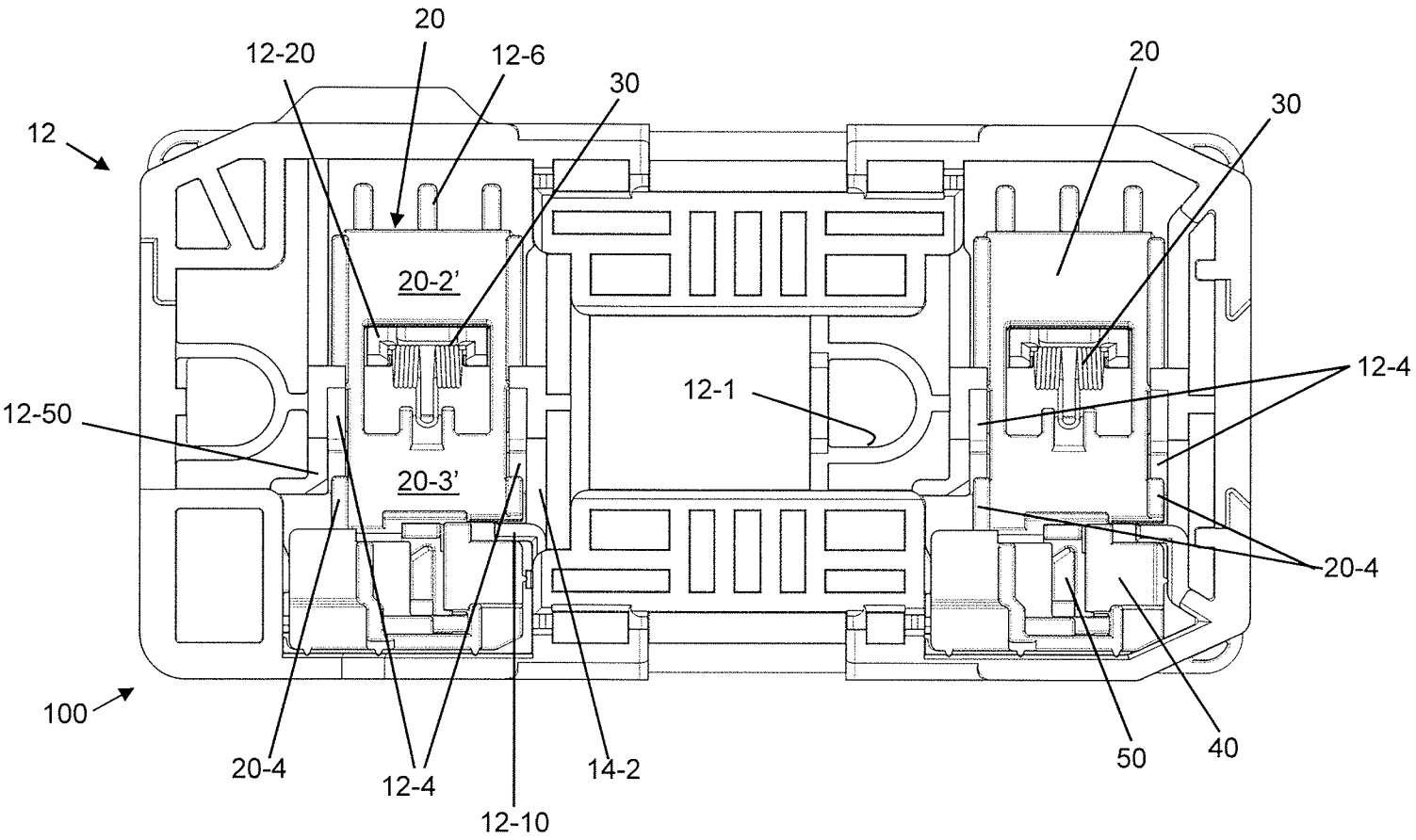
FIG. 3 is a plan view of an interior of the front cover with the shutter assembly installed in accordance with the present invention.

The guide portion 40 and the tandem shutter 50 are also shown; each of these elements fit into an interior portion of the cover 12 (as shown in FIG. 3). In another alternate embodiment, the guide member portion 40 can be incorporated into the interior portion of the cover 12 so that the tandem shutter 50 alone is placed within the front cover 12.

The interior portion of the cover 12 includes a plurality of gussets (i.e., structural ribs) 12-7, 12-8, 12-9, 12-40 and 12-50 that are configured to provide the cover 12 with a certain amount of rigidity so that it resists bending and deformation due to twisting or torsional forces. In addition, the gussets 12-40 and 12-50 are spaced apart to provide an opening that accommodates shutter 20 therebetween. To be clear, the shutter 20 is not retained or confined between ribs 12-40 and 12-50 by frictional fit; instead, there is a functional clearance between the shutter and the gussets 12-40 and 12-50 that allows the shutter 20 to move side-to-side. (Gusset 12-50 is also employed to electrically isolate the ground contact 14-12 from the hot and neutral conductors (14-2, 14-3), not shown).

A shutter guide rib 12-4 is formed on the interior face of each gusset 12-40, 12-50. Attached to each guide rib 12-4, and extending along substantially parallel to gusset 12-40, 12-50, is a shutter catch 12-5. Extending substantially perpendicular from each guide rib 12-4 and shutter catch 12-5 is a return rib 12-30. The interior portion of the cover 12 also includes a plurality of stand-off elements 12-6, anti-probing walls 12-10, and 12-51. Walls 12-10 and 12-11 are designed to keep guide members 40 stationary while allowing the tandem shutters 50 to linearly move within their respective guide members 40.

Referring to FIG. 3, the four piece shutter assembly 100—including shutter elements 20, spring element 30, the guide element 40 and the tandem shutter 50—is shown coupled to the interior portion of the cover 12. As described in greater detail in FIGS. 4A-4B, the shutter 20 includes lateral guide openings 20-4 on each side thereof; each guide rib 12-4 is disposed within its respective opening 20-4. The interior major surface 20-2' of the hot blocking pad is partially suspended over the stand-off elements 12-6 whereas the interior major surface 20-3' of the neutral blocking pad is partially suspended over the shutter catches 12-5 and the return ribs 12-30 (not visible in this view). Again, the return spring 30 applies a small force to the shutter 20 so that that it is disposed or maintained in the return state. In the return state/position and the blocking positions, the finger portion 20-55 (not shown in this view) prevents linear motion of the tandem shutter 50 in the y-direction. See also FIG. 5A.

Figure 4A:
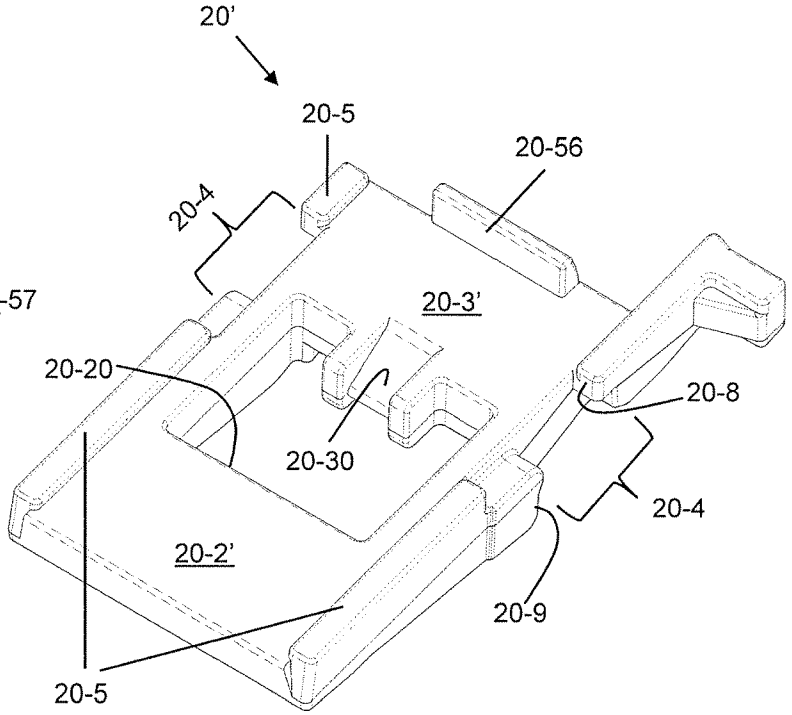
FIGS. 4A-4F are perspective views of component parts of the shutter assembly depicted in FIG. 1.
Figure 4B:
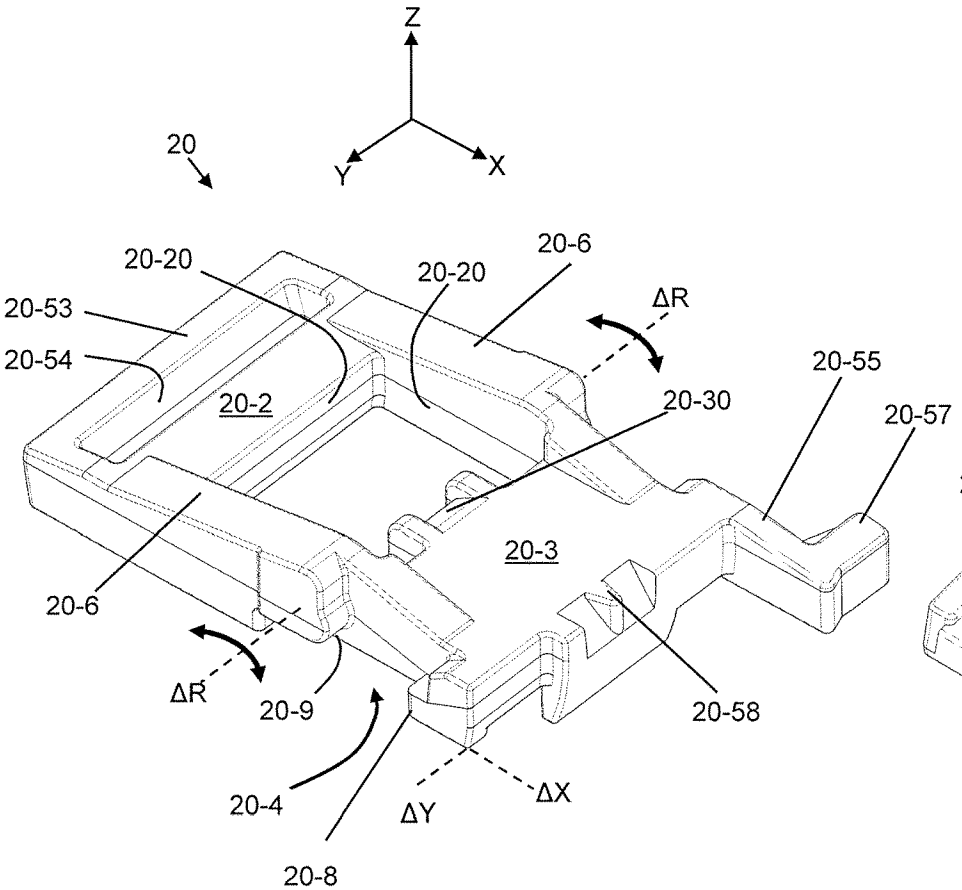

Referring now to FIGS. 4A and 4B, isometric detail views of the shutter 20 are provided. The shutter 20 can be fabricated by, e.g., injection molding a suitable plastic material such as Nylon, Polycarbonate, Acetal, Acrylic, Polyester, polyurethane, etc.

FIG. 4A shows the underside of the shutter 20, i.e., the major surface that faces the interior of the device 10 when the shutter is in its operating position. In this view, the interior major surface 20-2' of the hot blocking pad 20-2 is shown to the left of the opening 20-20 and the interior major surface 20-3' of the neutral blocking pad 20-3 is shown to the right thereof. (Pads 20-2 and 20-3 are shown in FIG. 4B). Because the shutter 20 is a relatively thin structure (approximately $1/16^{th}$ of an inch), it includes gussets 20-5 around a portion of its perimeter thereof to provide strength and rigidity to the shutter 20. The aperture 20-20 is disposed between the hot blocking pad 20-2 and the neutral blocking pad 20-3, and is configured to allow a hot plug blade to pass through when the shutter 20 is in an open position.

A lateral opening 20-4 is formed in each side of shutter 20; the lateral openings 20-4 accommodate the guide ribs 12-4. One side of each lateral opening 20-4 includes a bearing surface 20-9 that is configured to make tangential contact with its respective guide rib 12-4 as the shutter rides along the guide rib 12-4; this feature allows the shutter 20 to move in two dimensions (See x-axis and z-axis in FIG. 4B) about the guide rib 12-4. It is noted that the lateral openings 20-4 can be implemented by indentations that are not flanked on the right hand side by any portion of the shutter 20 (such as catch detents 20-8).

The shutter 20 also includes a spring seat 20-30 (for return spring 30) that is formed within the opening 20-20 and is configured to accommodate the central bearing portion 30-3 of spring 30. A finger element 20-55 extends longitudinally from the shutter 20 and includes an end portion 20-57 that is orthogonal thereto. The shutter 20 further includes a blocking wall 20-56.

FIG. 4B shows the topside of the shutter 20, that is, the side that faces the interior of the front cover 12 when it is disposed in its operating position. The hot blocking pad 20-2 and the neutral blocking pad 20-3 are substantially flat planar surfaces, i.e., they are not inclined and are substantially within the plane (+/−8°) formed by the x-axis and y-axis when the shutter is in the return/rest state. This view also shows the anti-probing slot 20-54, aperture 20-20, spring seat 20-30, gussets 20-6 and 20-7, gussets 20-6 and 20-7, bearing surface 20-9, edge 20-53 of shutter contact pad 20-2, openings 20-4, and catch detents 20-8. The gussets 20-6 and 20-7 have the same function as gussets 20-5, i.e., to provide strength and rigidity to the shutter 20. The functionality of the other elements will be described below in greater detail.

FIG. 4B shows the shutter 20 within a three dimensional Cartesian grid space to illustrate the three dimensional operating space of the shutter 20. One of the unique features of shutter 20 is its ability to move in all three dimensions. This ability to "float" is enabled by the relatively loose coupling of the shutter to the front cover 12 (i.e., the disposition of the guide ribs 12-4 within the lateral openings 20-4). While the openings 20-4 loosely accommodate the guide ribs 12-4 therein, the shutter 20 is not snapped onto the ribs 12-4 or otherwise connected to the cover 12. Moreover, while the spring seat 20-30 accommodates the central bearing portion 30-3 of spring 30, the shutter 20 does not retain any portion of the spring 30 therewithin. Similarly, while the anti-probing wall 12-20 is disposed within the shutter aperture 20-20, these two elements are not connected to each other (so that one can move relative to the other). Finally, a functional clearance is provided in the y-direction ($\Delta y$) between the lateral edges of the shutter 20 and the side walls 12-40 and 12-50. (There is no friction fit or interference fit between the shutter edges and the walls 12-40, 12-50). Thus, when the shutter is translated in the x-z plane by a corded plug, or rotated in the x-z plane by an object, it is free to wobble in all three dimensions ($\Delta x$, $\Delta y$, $\Delta z$). This "give" or ability to float or wobble around the ribs 12-4 substantially prevents the shutter from becoming damaged, jammed or stuck after repeated usage. The shutter's ability to "float" enables the shutter to accommodate plug blades that are not perfectly parallel, bent or are not of equal length, or plug blade edges that are sharp (and can gouge and nick the shutter). In brief, the floating ability also allows the user to insert the plug at an angle without jamming or damaging the shutter.

Figure 4D:
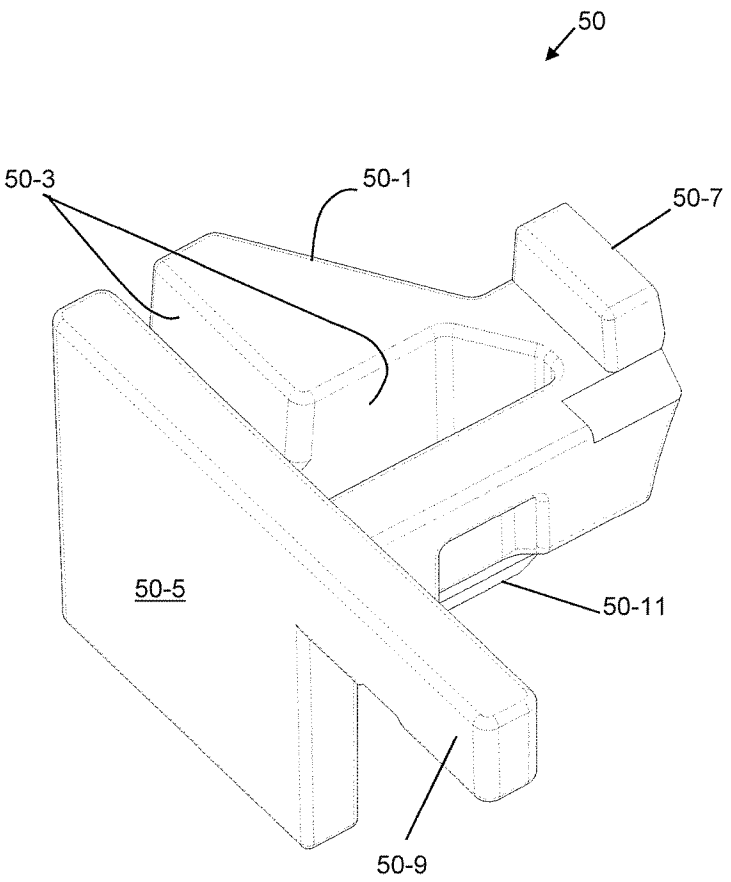
Figure 4C:
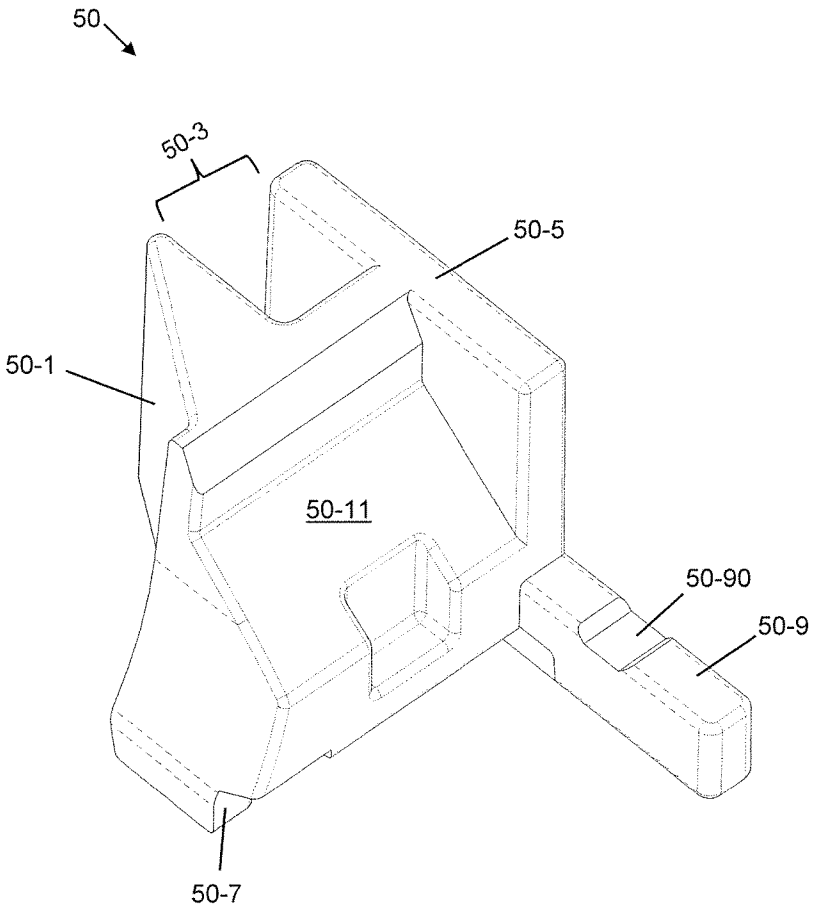

Referring now to FIGS. 4C and 4D, isometric detail views of the tandem shutter 50 are provided. FIG. 4C shows the relative "underside" of the tandem shutter 50, i.e., the side that faces away from the guide member 40 and the interior surface of the cover 12. FIG. 4D shows the relative "topside" of the tandem shutter 50, i.e., the side that faces the guide member 40 and the interior surface of the cover 12. A blocking cam 50-1, channel/slot 50-3, guide wall 50-5, side wall 50-7, guide tail 50-9, and blade cam 50-11 are shown (further details of which are provided with reference to additional figures below). The tandem shutter 50 can be fabricated by, e.g., injection molding a suitable plastic material such as Nylon, Polycarbonate, Acetal, Acrylic, Polyester, polyurethane, etc.

Figure 4F:
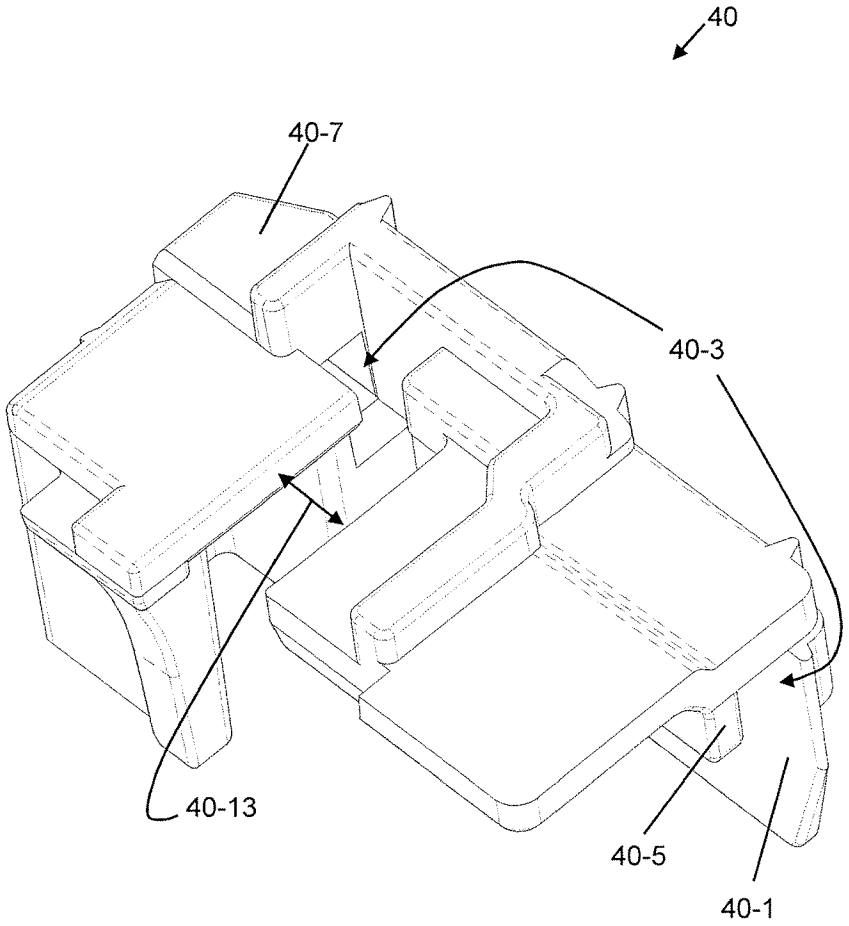
Figure 4E:
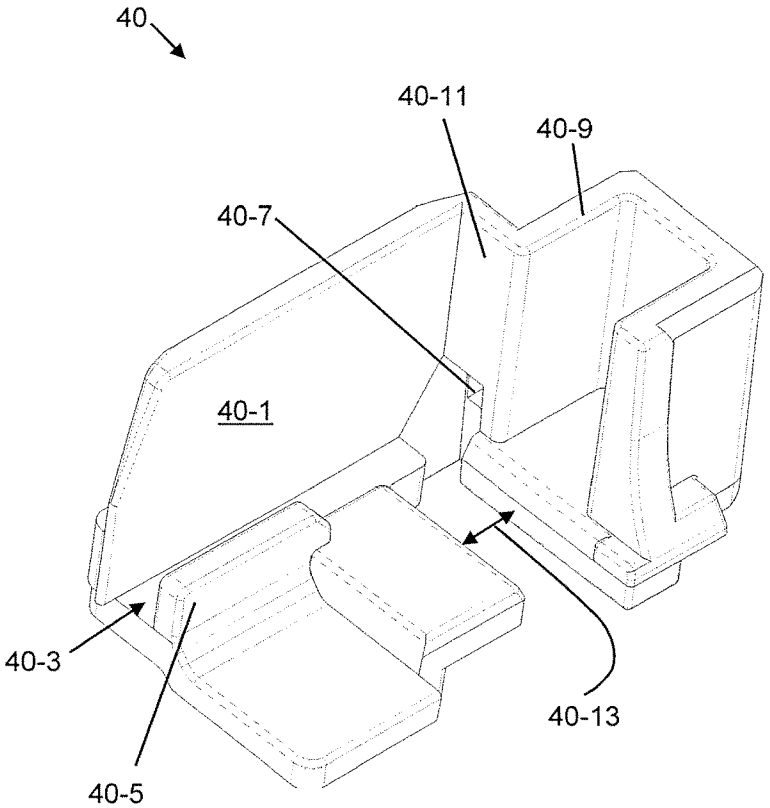

Referring now to FIGS. 4E and 4F, isometric detail views of the guide member 40 are provided. FIG. 4E shows the relative topside of the guide member 40, i.e., the side that faces toward the interior surface of the cover 12 and accommodates the tandem shutter 50. FIG. 4F shows the relative underside of the guide member 40, i.e., the side that faces the interior neutral contact 14-3. The guide member 40 includes guide walls 40-1, 40-5, and 40-7 that form a guide track 40-3 to accommodate the tandem guide wall 50-5 therewithin. The guide member 40 also includes a pocket formed by blocking walls 40-9 and 40-11. The guide track 40-3 is separated from the pocket 40-9 by an aperture 40-13; aperture 40-13 is disposed over the neutral aperture 12-3 when guide member 40 is in its operational position (i.e., positioned within cover 12. The guide member 40 can be fabricated by, e.g., injection molding a suitable plastic material such as Nylon, Polycarbonate, Acetal, Acrylic, Polyester, polyurethane, etc.

Figure 5A:
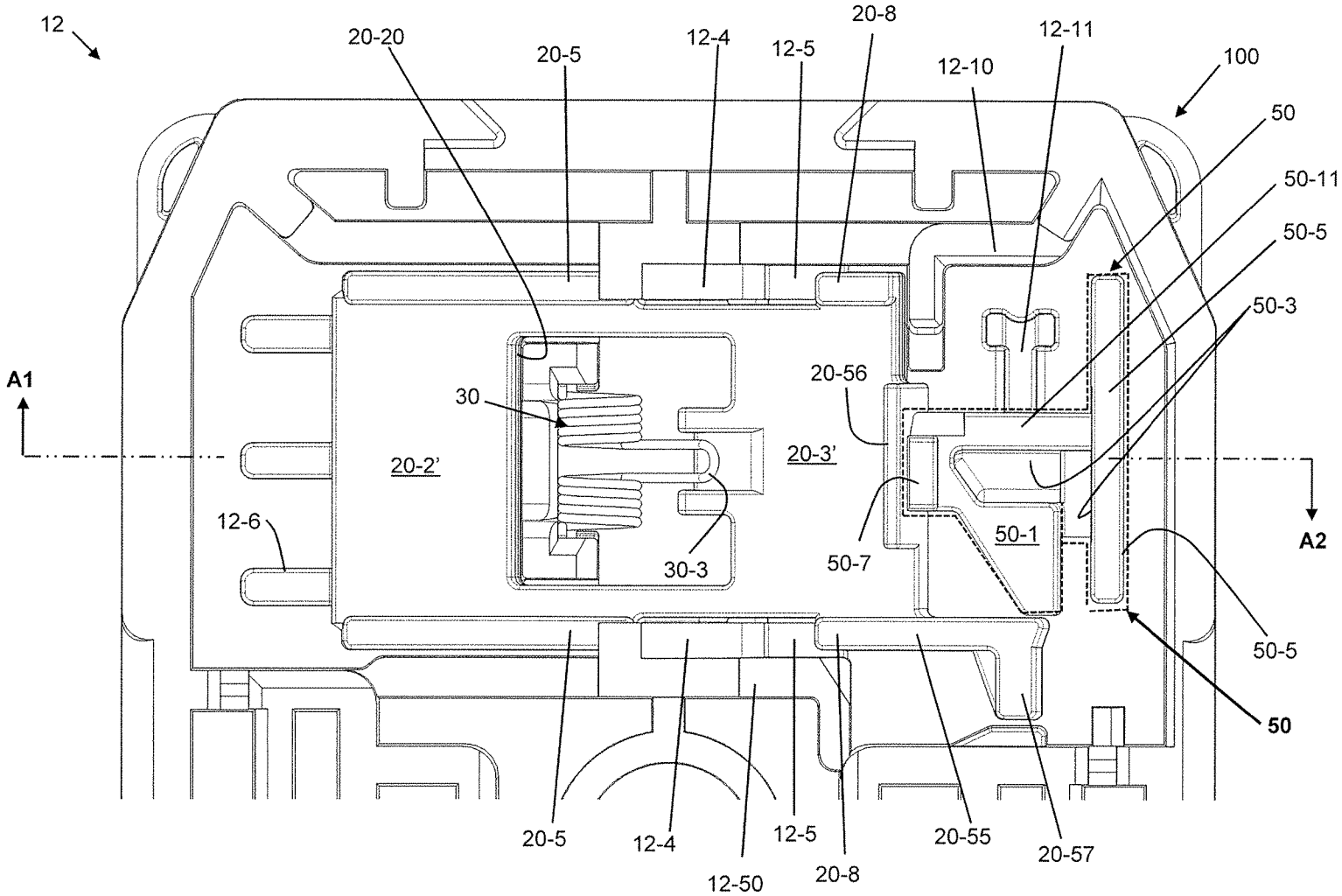
FIGS. 5A-5B are plan views showing an interior of the front cover with an installed shutter assembly in a closed position and in an open position, respectively, in accordance with the present invention.
Figure 5B:
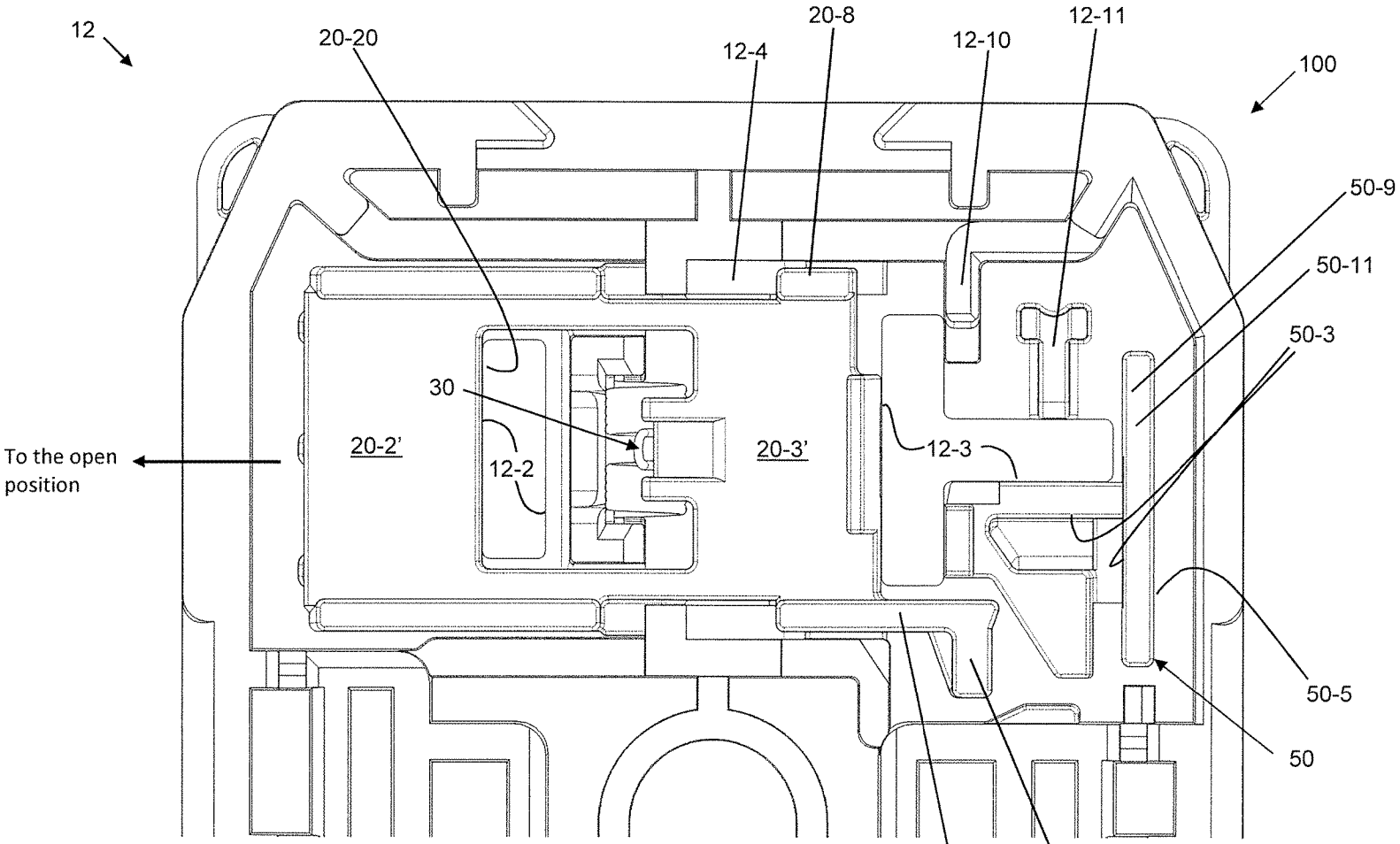

Referring to FIGS. 5A and 5B, in situ detail views of the shutter assembly 100 in the return/rest position and the "open" position are shown, respectively. In both FIGS. 5A and 5B, guide member 40 is hidden in order to fully show the relative linear movement of the tandem shutter 50 within the interior portion of the cover 12, and its cooperation and engagement with the shutter 20.

FIG. 5A shows the shutter assembly 100 in the return position. In this view, the guide ribs 12-4 are clearly shown adjacent to their respective catch detents 20-8 (and hence, within the lateral openings 20-4). The interior major surface 20-2' of the hot blocking pad is partially covering the stand-off elements 12-6. Similarly, the interior major surface 20-3' of the neutral blocking pad is partially covering the stand-off elements 12-5 (and fully covering the return ribs 12-30 so that they are not visible in this view). In the return state, the shutter spring 30 applies a small rotational force to urge the shutter 20 toward the interior surface of the front cover 12. The tandem shutter 50 is shown with cam 50-1, channel/slot 50-3, guide wall 50-5, side wall 50-7, rib 50-9, and blocker 50-11 visible. The blocker 50-11 is shown blocking neutral opening 12-3; and, the finger 20-55 (with end portion 20-57) prevents any linear movement of the tandem shutter 50 in the y-direction (toward the finger 20-55).

In FIG. 5B, the shutter assembly 100 is shown in the open position (with the corded plug blade fully deployed). In the open position, the shutter 20 is moved to the left in the x-direction so that the cover aperture 12-2 and cover aperture 12-3 are completely misaligned with the shutter contact pads 20-2, 20-3, respectively (allowing the plug blades to mate with the contacts 14-2 and 14-3 (not shown)). The movement of the shutter 20 allows the tandem shutter 50 to be moved by the neutral blade of the 20 A plug. (When the shutter 20 is in the open position, the finger 20-55 is not positioned to restrain the tandem shutter 50 and it is free to move until the finger 20-55 urges it back into the return state). Comparing FIG. 5B to FIG. 5A, it becomes apparent that the tandem shutter 50 is linearly translated in the y-direction so that the cover aperture 12-3 is fully opened. Once the 20 A plug blade is removed from the device, the spring 30 is configured to urge the shutter 20 back into the return state (FIG. 5A). Specifically, as the shutter 20 is urged to the right (in FIG. 5B), the finger 20-55 is structured and positioned to engage cam 50-1 so that the tandem shutter 50 is returned to the rest/return position (to thus block the aperture 12-3).

Figure 6A:
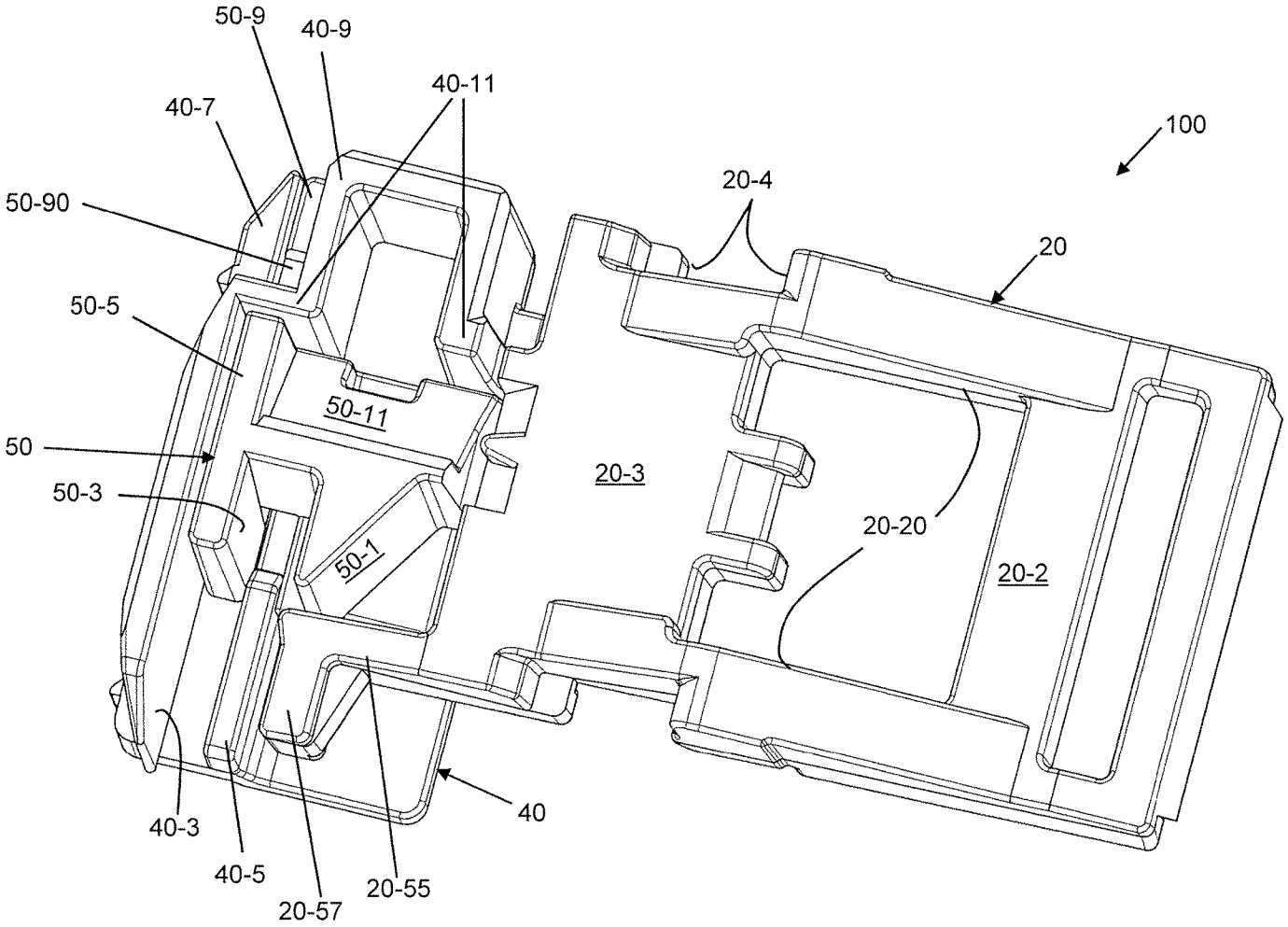
FIGS. 6A-6D are detail views showing the shutter assembly in various positions without the front cover in accordance with the present invention.
Figure 6B:
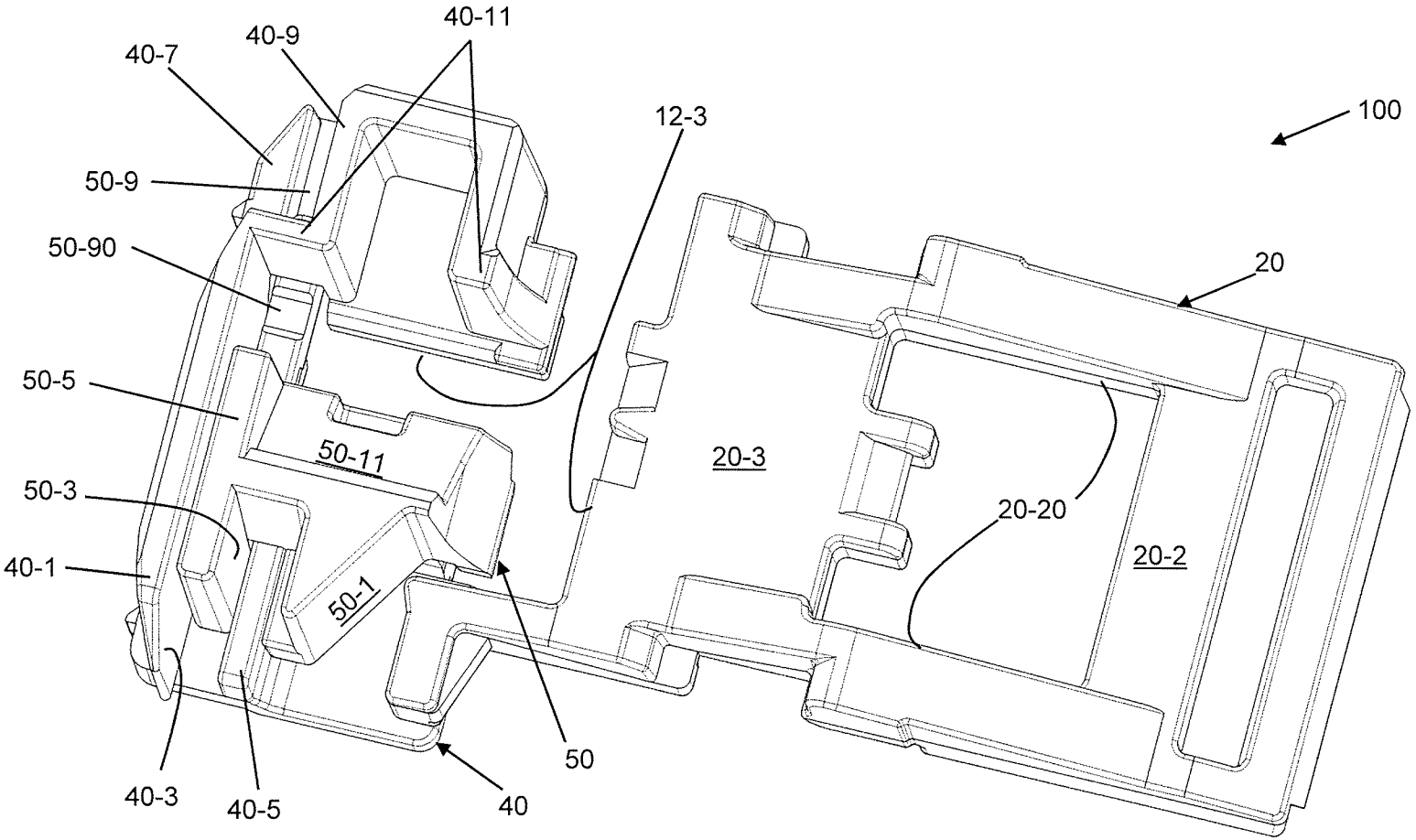

Referring to FIGS. 6A and 6B, detail views of the shutter assembly 100 in the return/rest position and the open position are shown, respectively. Note, however, that the front cover 12 and spring 30 are not shown for clarity of illustration. To be specific, these elements are removed to better illustrate the relative linear movement of tandem shutter 50 within the guide member 40. These views also more clearly show the cooperation and engagement of the guide member 40 and the shutter 20.

FIG. 6A shows the shutter assembly 100 in the return/rest position. The cam portion 50-1 of the tandem shutter 50 is engaged by the finger 20-55 so that the tandem shutter 50 is prevented from moving along the guide rail 40-5. The blocking walls 40-11 prevent the tandem shutter 50 from any linear movement in the opposite direction (away the finger 20-55). Thus, if a foreign object is inserted into the cross portion of the T-slot opening 12-3, it will strike the cammed portion 50-11 and slide into the blocking pocket formed by blocking walls 40-11. Even if the foreign object is forcefully inserted against the cammed portion 50-11, the tandem shutter 50 cannot slide along rail 40-5 because of the blocking action by the restraining finger 20-55.

FIG. 6B shows the shutter assembly 100 in the open position. Once the shutter 20 is engaged by a set of corded plug blades, it will be translated to the right (in FIG. 6B); at this point, the restraining finger 20-55 is moved out of the way allowing the tandem shutter 50 to move along the guide rail 40-5 (in response to the neutral blade of the 20 A plug) so that the neutral blade can mate with the neutral contact 14-3 disposed in the body 14. During this movement, the tandem channel/slot 50-3 is configured to slide over the guide rail 40-5. As before, guide member 40 is stationary within the interior surface of the cover 12 (not shown in this view).

Figure 6C:
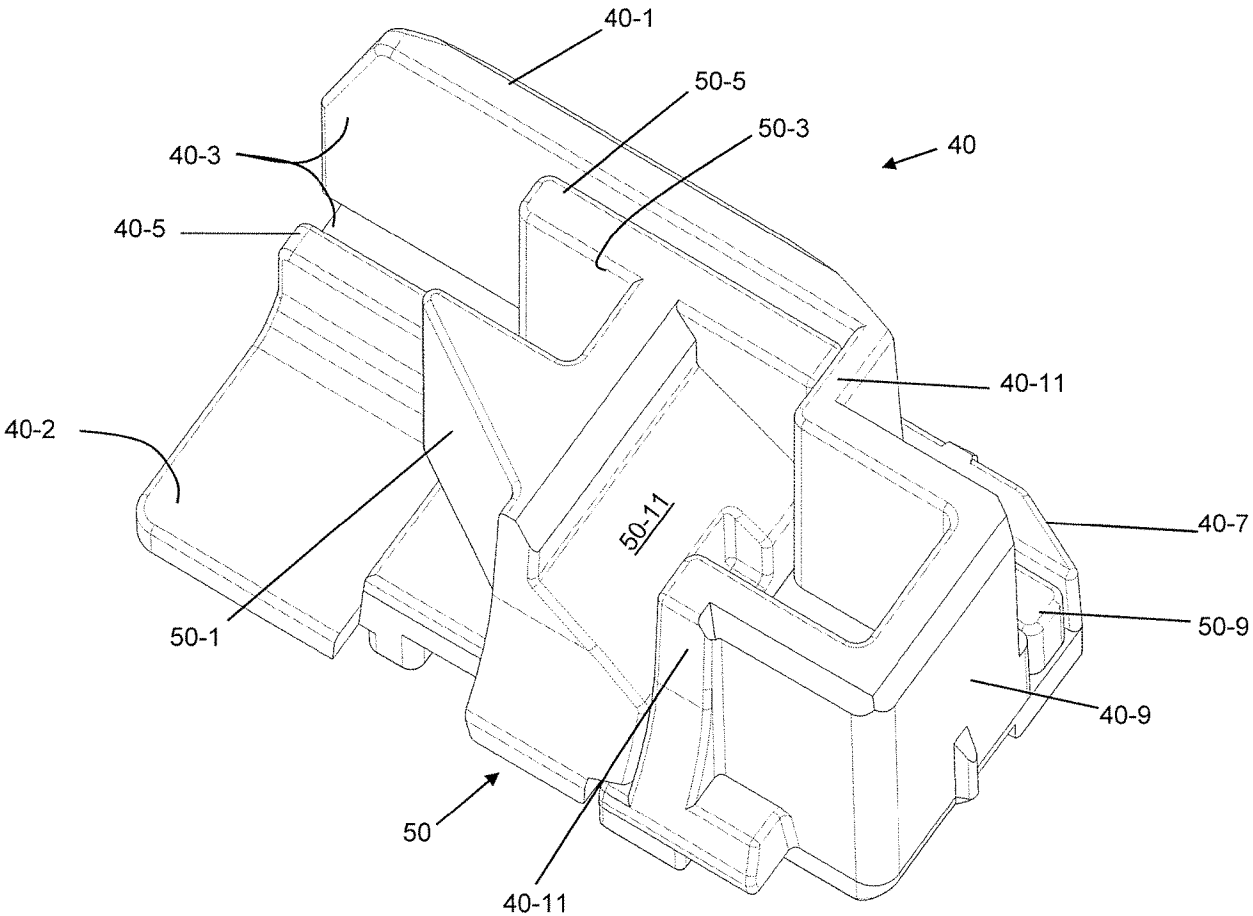
Figure 6D:
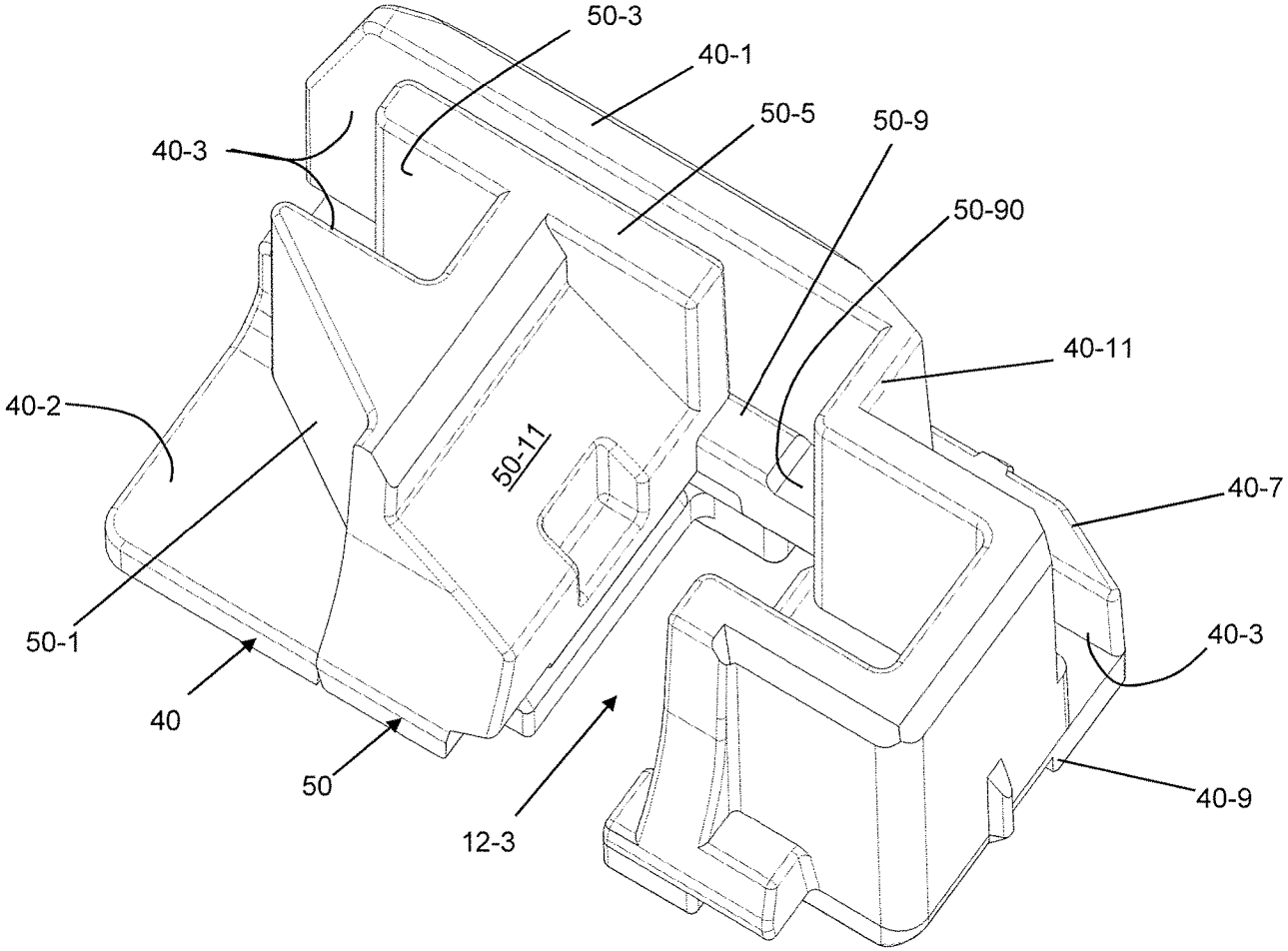

Referring to FIGS. 6C and 6D, alternate detail views of the shutter assembly 100 in the return/rest position and the open position are shown, respectively. Specifically, this view shows the opposite end of the guide track 40-3; this end of the guide track 40-3 is configured to accommodate the guide tail portion 50-9 of the tandem shutter 50. In FIG. 6C, the guide tail 50-9 is fully extended into the guide track 40-3 because the blocking cam 50-1 is restrained by the shutter finger 20-55 (not shown here for sake of clarity). In FIG. 6D, the guide tail 50-9 is retracted within the guide track 40-3 because the blocking cam 50-1 is unrestrained by the shutter finger 20-55 (not shown here for sake of clarity) and the blade cam 50-11 is being driven by the neutral blade of the 20 A plug (again, not shown in this view for clarity of illustration).

Figure 7:
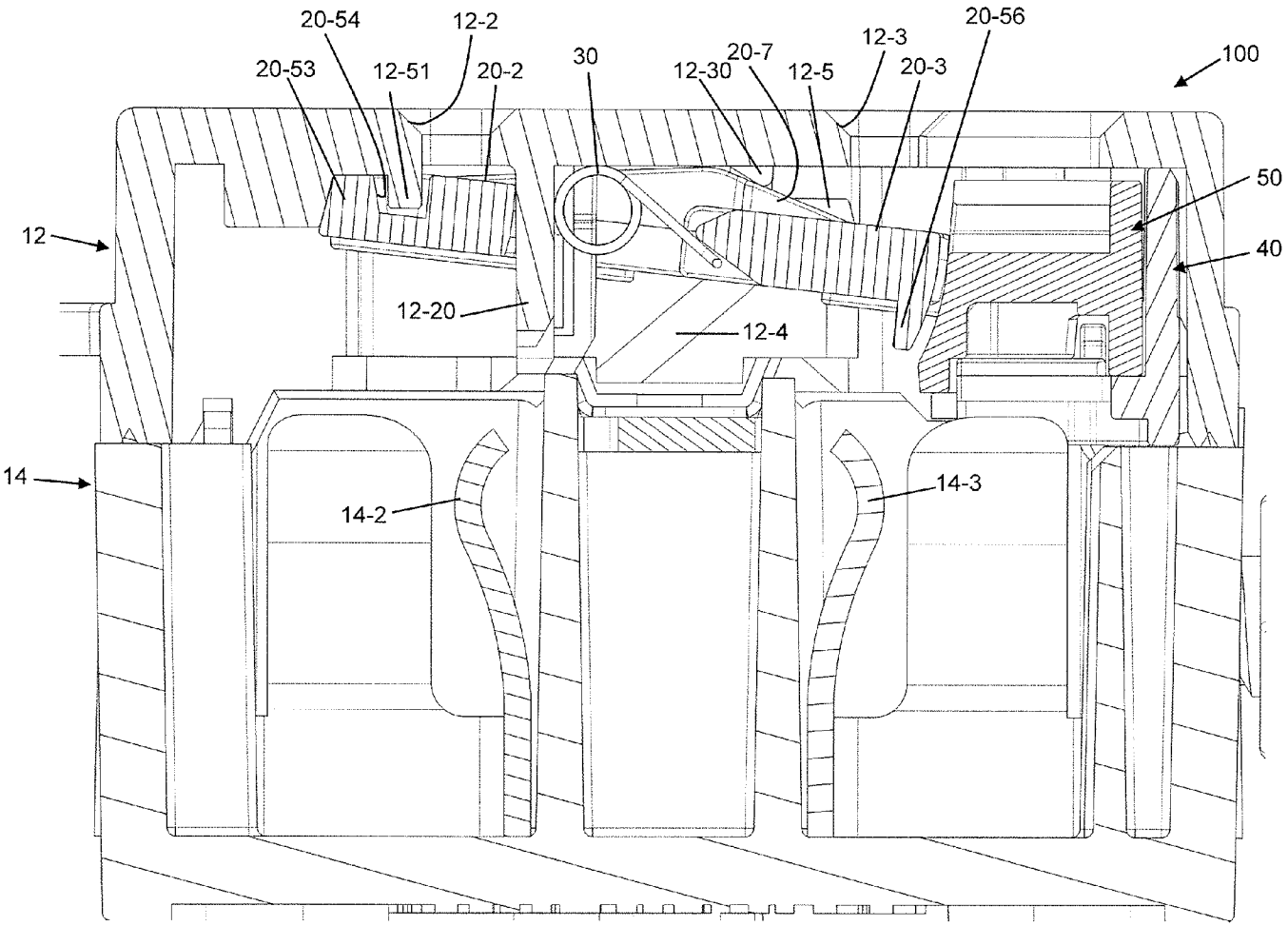
FIG. 7 is a cross sectional view of the shutter assembly in a rest position in accordance with the present invention.

Referring to FIG. 7, a cross-sectional view of an electrical wiring device 10 taken along "A1" of the view illustrated in FIG. 5A is shown, with the shutter assembly 100 (including shutter 20, torsion spring 30, guide 40 and the tandem shutter 50) in the return/rest position. During assembly, the spring 30 is employed to position the shutter 20 in the return/rest position. In particular, the return spring 30 applies approximately 100-200 grams of translational force to bias the gussets 20-7 close to, or against, the return ribs 12-30 (within a range +/−8°). When the shutter 20 is in the return position, the finger 20-55 is biased to prevent any linear movement of the tandem shutter 50 in the y-direction toward the finger 20-55. At one end of the angular range (+/−8°) the shutter 20 will be engaged with, but not connected to, the front cover 12. (Specifically, the anti-probing wall 12-51 is engaged with the anti-probing slot 20-54 and the far edge 20-53 of shutter contact pad 20-2 is engaged with the stand-off elements 12-6).

Figure 8A:
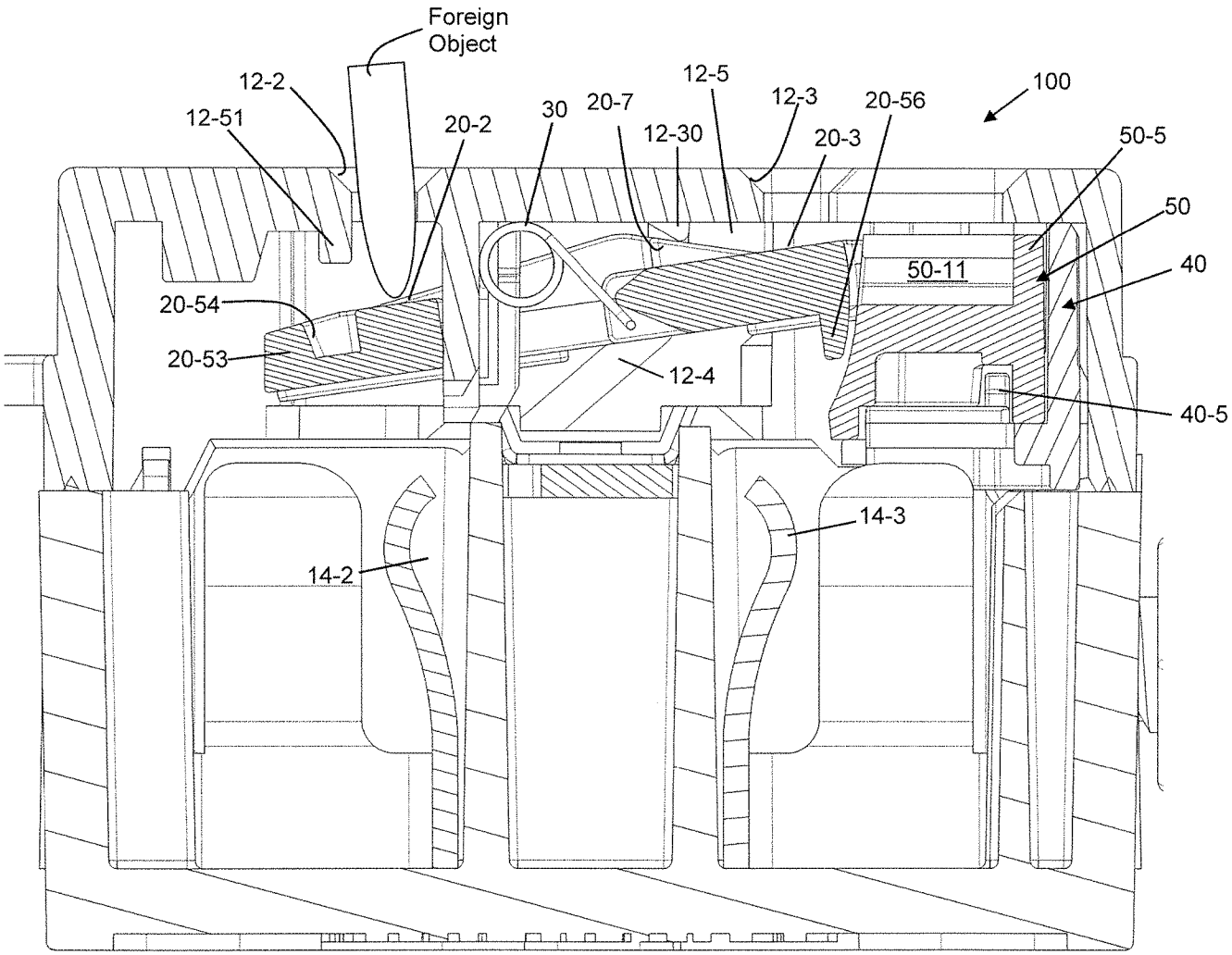
FIGS. 8A-8D are cross sectional views of the shutter assembly in a stop position in accordance with the present invention.
Figure 8B:
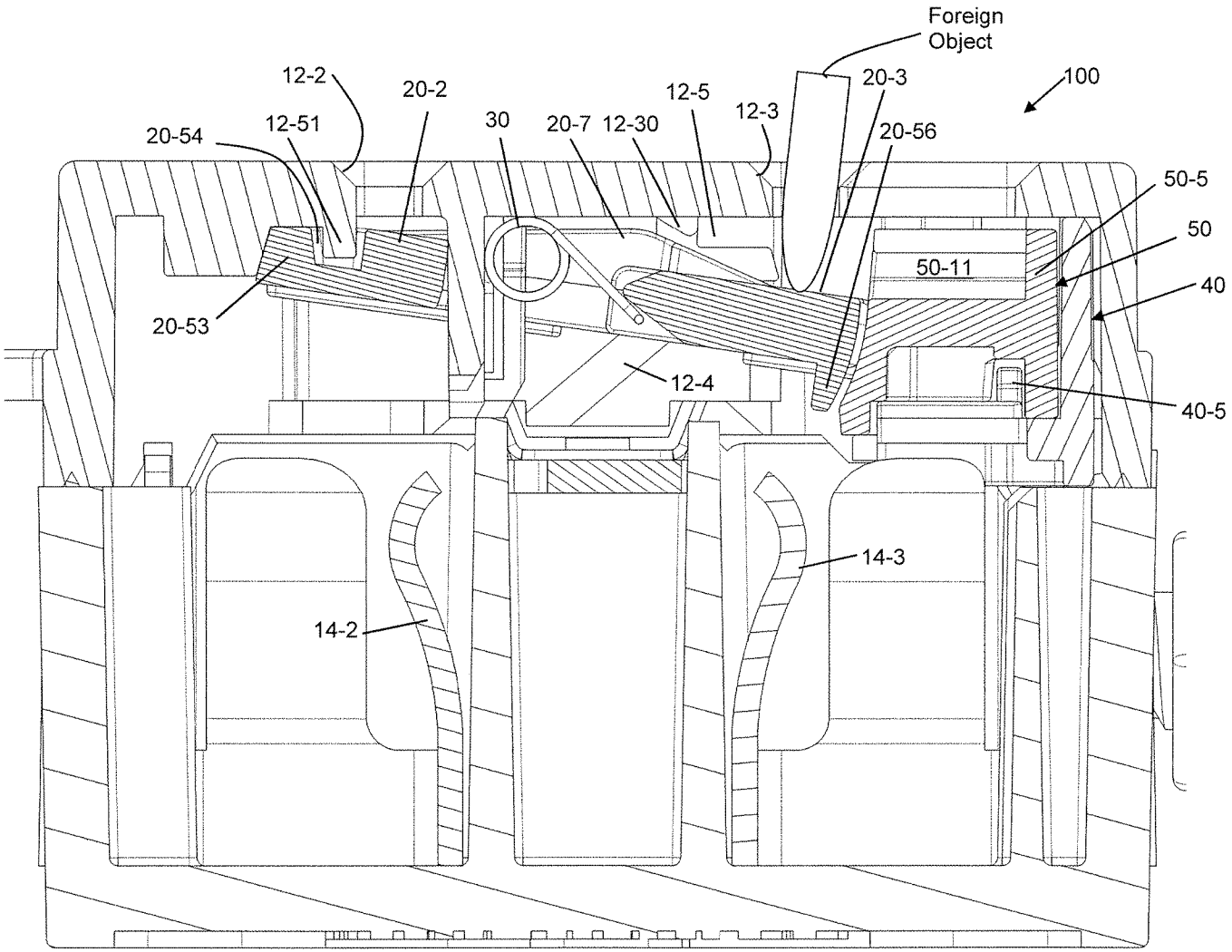
Figure 8C:
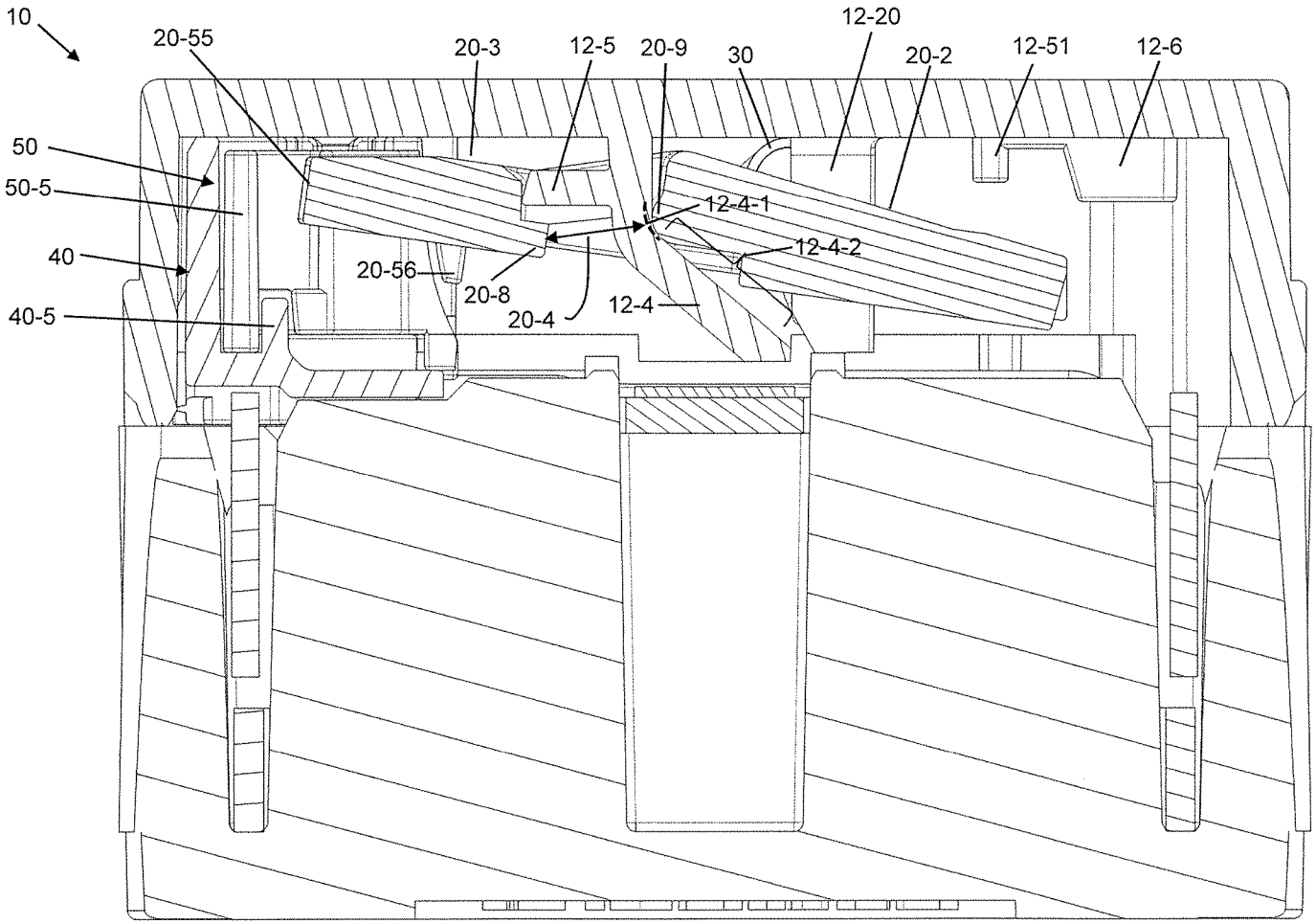
Figure 8D:
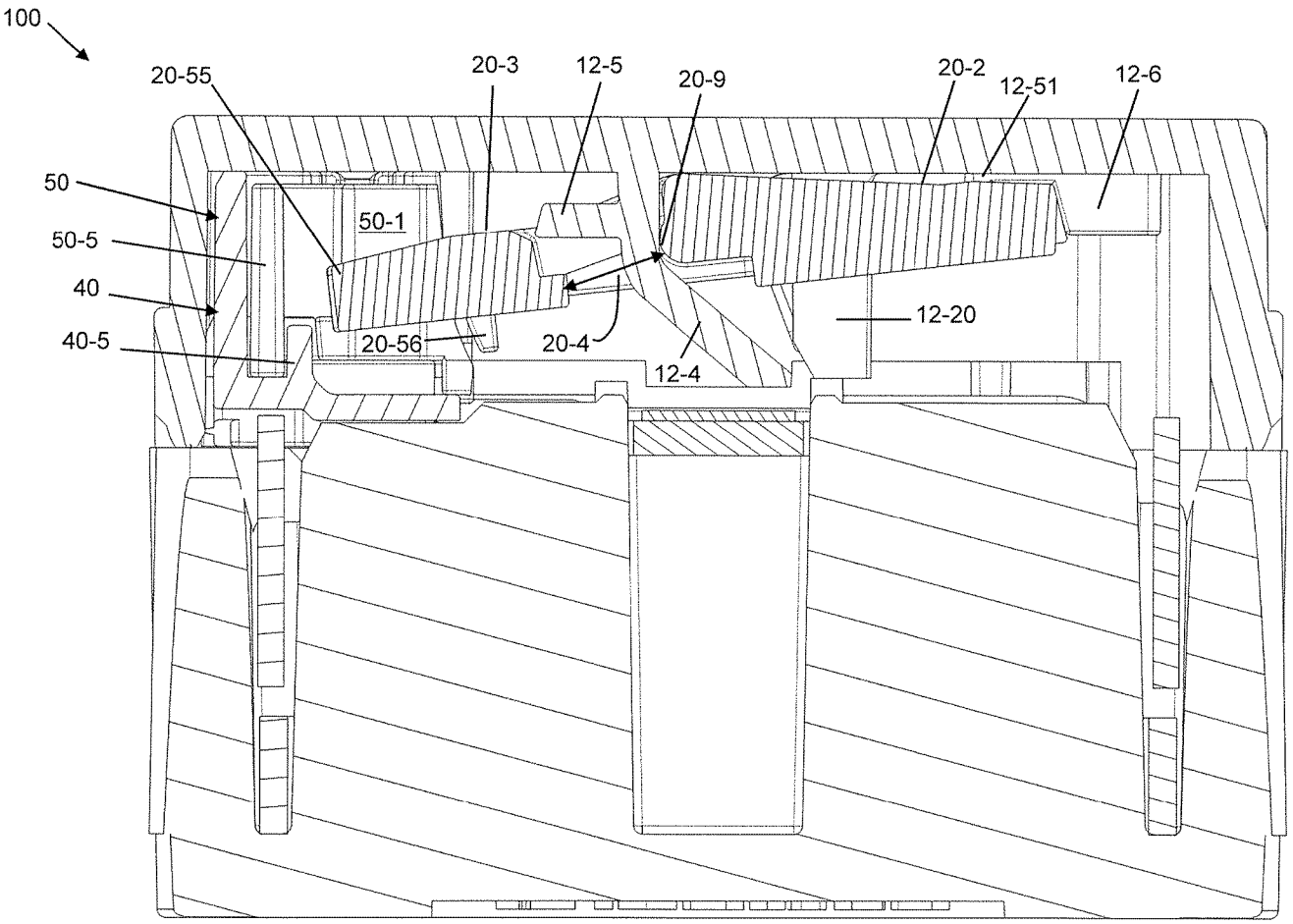

Referring to FIGS. 8A-8D, cross-sectional views of the electrical wiring device 10 are shown when a single foreign object is inserted into only one of the cover apertures (12-2, 12-3). FIGS. 8A and 8B are cross-sectional views of an electrical wiring device 10 taken along "A1" of the view illustrated in FIG. 5A. FIGS. 8C and 8D are cross-sectional views of an electrical wiring device 10 taken along "A2" of the view illustrated in FIG. 5A.

In these views, the shutter 20 is rotated into a "blocking" position to defeat an object inserted into a single opening, and tandem shutter 50 remains in its blocking state, prevented from moving linearly (by the finger 20-55 on one side and the blocking walls 40-11 on the other side). FIGS. 8C and 8D show the blocking function of finger 20-55 more clearly (the blocking of the tandem shutter 50 by finger 20-55). Further, blocking wall 20-56 also assists with preventing a single object from reaching past the shutter 20.

Returning to FIG. 8A, an object is shown as being inserted into the hot aperture 12-2. FIG. 8C shows this event from the opposite perspective (See cross sectional view A2). When the object is inserted into the hot aperture 12-2, the shutter 20 will rotate so that the anti-probing wall 12-51 disengages from anti-probing slot 20-54 and the far edge of blocking pad 20-2 will disengage from stand-off elements 12-6. Due to the rotation, however, the shutter gussets 20-7 are pressed against the return ribs 12-30 (see FIG. 8A), catch detents 20-8 engage the shutter catches 12-5, and bearing surfaces 20-9 engage respective bends (see dashed line) in the guide ribs 12-4. See FIG. 8C. The shutter 20 rotates about the pivot points formed by bearing surfaces 20-9 when contacting the bends in the guide ribs 12-4 until the shutter catches 12-5 are captured by the catch detents 20-8 formed in the neutral blocking surface 20-3. The single object is also prevented from engaging the hot receptacle contact 14-2 by the anti-probing wall 12-20 and the shutter's hot blocking surface 20-2.

FIG. 8B shows an object being inserted into the neutral aperture 12-3. FIG. 8D shows the opposite cross sectional view (See cross-section A2 in FIG. 5A). When the object is inserted into the neutral aperture 12-3, the bearing surface 20-9 (on each side of shutter 20) engages the bend in its respective guide rib 12-4 (see FIG. 8D). The shutter 20 rotates about the pivot points formed by bearing surfaces 20-9 until anti-probing slot 20-54 engages the anti-probing wall 12-51, and the far edge of 20-2 engages stand-off elements 12-6 (see FIG. 8B). The single object is prevented from engaging the neutral receptacle contact 14-3 by the anti-probing wall 12-10 and the shutter's neutral blocking surface 20-3.

Importantly, in both described and illustrated probing scenarios, there is no significant movement of the shutter 20 in the x-direction (i.e., to the left or right in FIGS. 8A-8D).

As shown in FIG. 8D, for example, there may be shutter 20 movement in the yz-directions (i.e., up and down, and in and out of the page in this view) as bearing surfaces 20-9 slide along the guide ribs 12-4. Once the bearing surface 20-9 reaches the bend in the guide rib 12-4 (in response to the insertion of the foreign object), the shutter 20 begins to rotate about the bearing surfaces 20-9 until the shutter engages the cover 12 to effect the blocking position. In one embodiment, the radii of the bearing surfaces 20-9 are substantially the same as the radii of the guide rib 12-4 bends. This feature allows the bearing surfaces 20-9 to rotate at the bend position and resist further vertical (Z-direction) movement.

Thus, neither contact—hot contact 14-2 or neutral contact 14-3—is exposed to the foreign object. Specifically, when a foreign object is inserted into either the hot receptacle aperture 12-2 or the neutral receptacle aperture 12-3 as described with respect to FIGS. 8A-D above, the object will strike blocking pad 20-2 or 20-3 and cause the shutter to rotate around the y-axis about 8° in one direction until the shutter is stopped by one of the following elements (return ribs 12-30, shutter catches 12-5, stand-off elements 12-6, and anti-probing wall 12-51) disposed on or attached to the interior surface of the cover 12 and the interior anti-probing wall 12-20. In one rotational direction, the anti-probing slot 20-54 will engage the anti-probing wall 12-51 and the far edge of 20-2 will engage stand-off elements 12-6 (see FIGS. 8B, 8D), and in the other direction, catch detents 20-8 will engage shutter catches 12-5 (see FIG. 8C) and gussets 20-7 will engage return ribs 12-30 (see FIG. 8A). In both probing examples, bearing surfaces 20-9 engage respective bends in the guide ribs 12-4, which create the pivot points. (Thus, $-8° \leq \Delta R \leq +8°$).

Figure 9A:
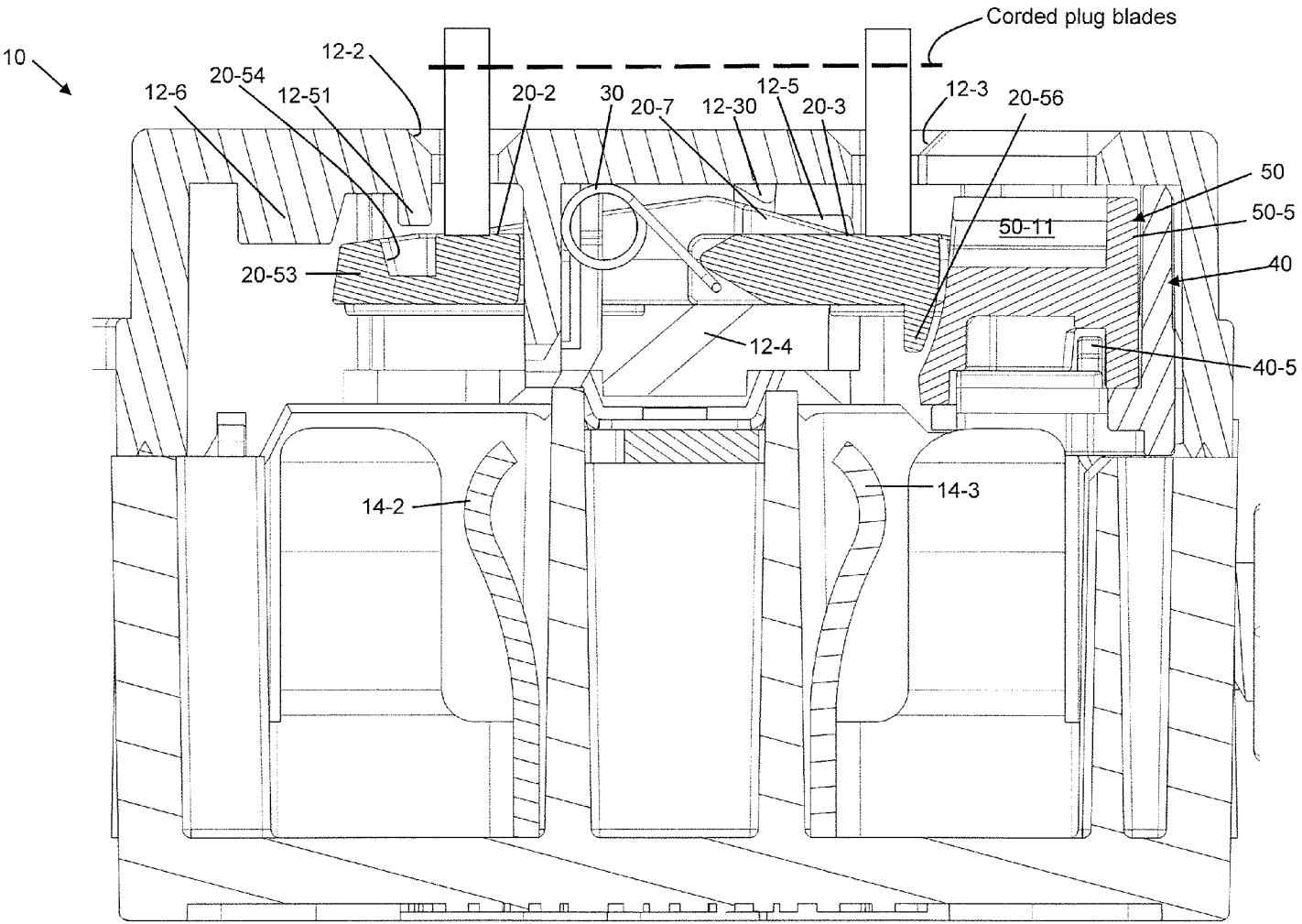
FIGS. 9A-9C are cross sectional views of the shutter assembly being driven along a translational portion of the guide structure in accordance with the present invention.
Figure 9B:
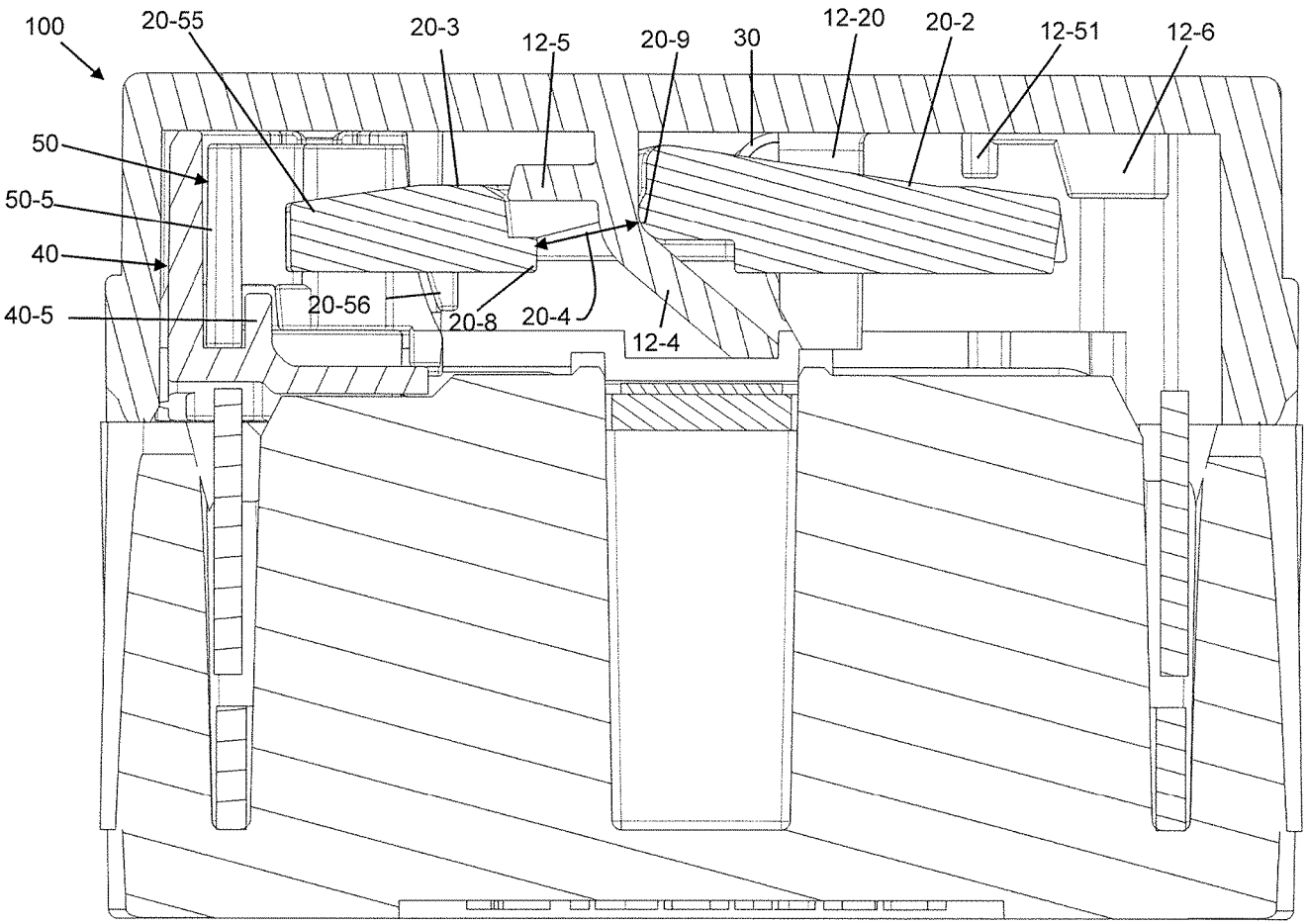
Figure 9C:
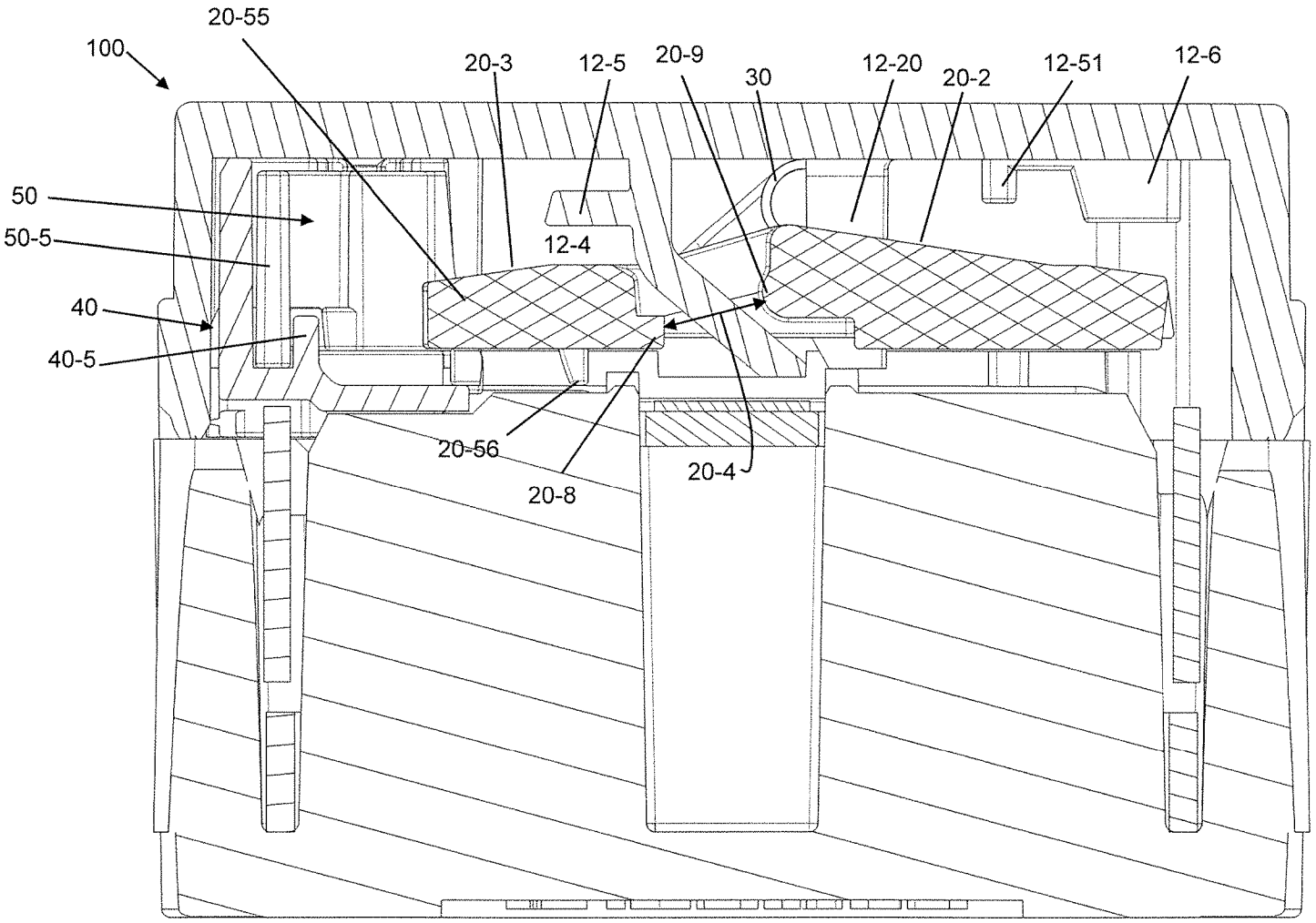
Figure 10A:
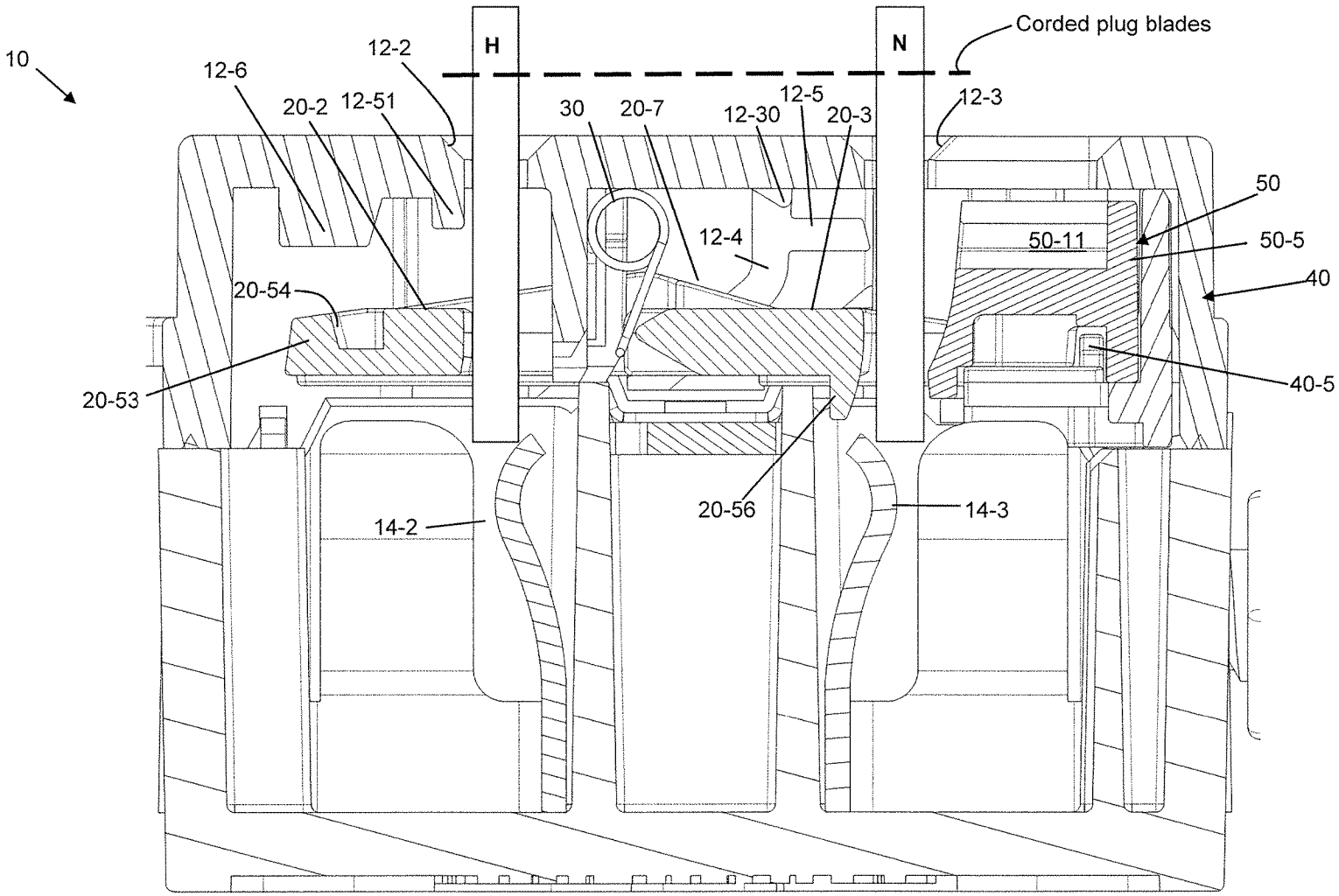
FIGS. 10A-10B are cross sectional views of the shutter assembly in an open position.
Figure 10B:
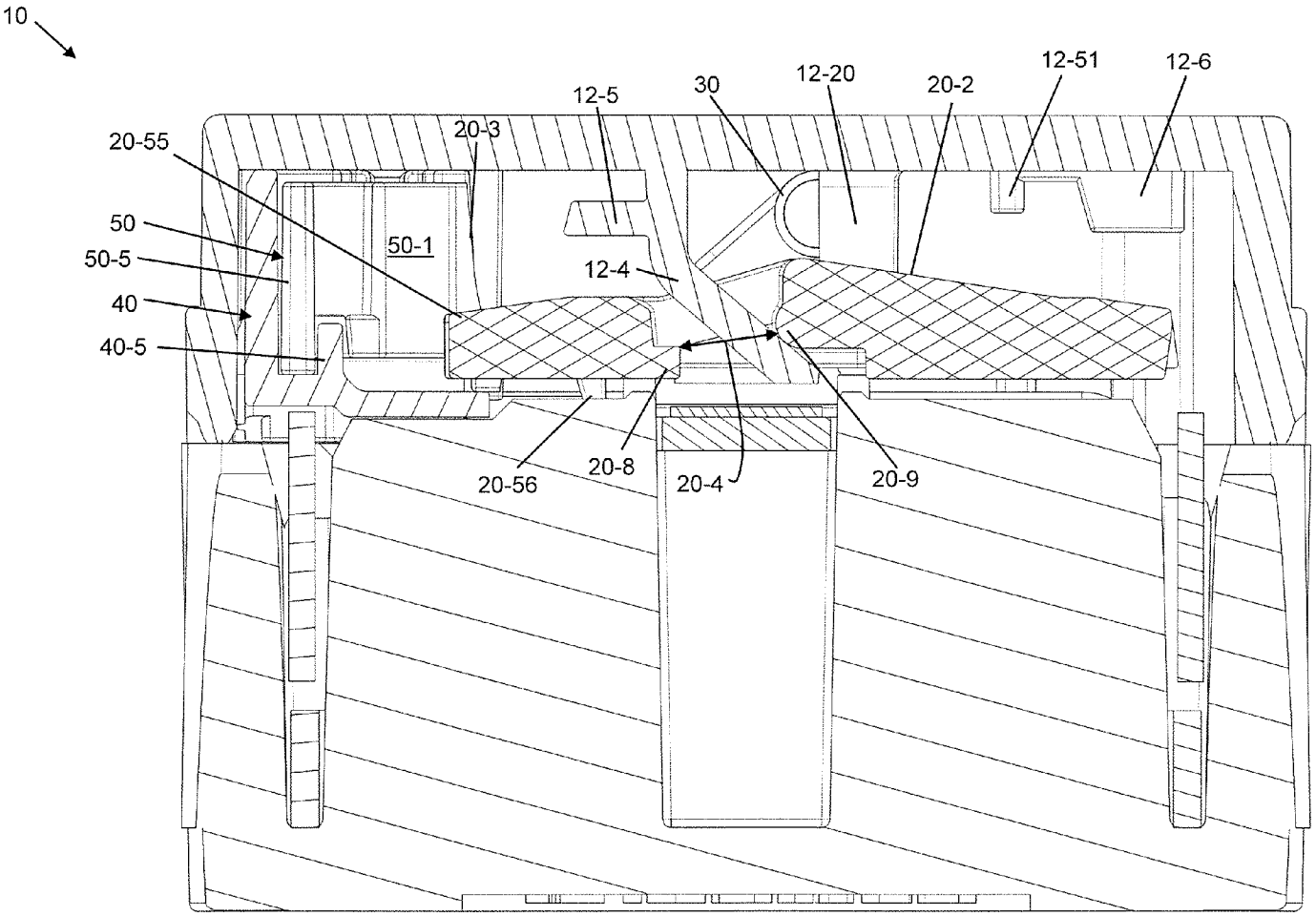

Referring to FIGS. 9A-9C, and 10A and 10B, cross-sectional views are shown of the electrical wiring device 10 with 15 A corded plug blades inserted into the cover apertures 12-2, 12-3. FIGS. 9A and 10A are cross-sectional views of an electrical wiring device 10 taken along "A1" of the view illustrated in FIG. 5A. FIGS. 9B, 9C and 10B are cross-sectional views of an electrical wiring device 10 taken along "A2" of the view illustrated in FIG. 5A.

As illustrated in these views, the shutter 20 is shown in various positions along its x and z movement from the return/rest position to the open position. As noted above, the tandem shutter 50 has two states; an open state when the shutter 20 is opened, and a blocking state when the shutter 20 is in one of the return or blocking positions. In addition, note that when 15 A plug blades are inserted into apertures 12-2, 12-3, there is no plug blade component that exerts any force on the tandem shutter 50 to cause it to move into the open position, and thus, it tends to remain in the closed or blocking position.

Referring to FIGS. 9A and 9B, when 15 A corded plug blades (which are parallel to one another) are inserted into apertures 12-2, 12-3, the shutter 20 starts to move in the z direction along the guide ribs 12-4 until the bearing surface 20-9 engage the bend in the guide ribs 12-4. (Of course, this movement occurs on each side of the shutter 20). Once the bearing surface 20-9 reaches the bend in the guide rib, the force of the plug blades causes the shutter 20 to follow guide ribs 12-4 in the x and z directions. (Once the plug blades are removed, the return spring 30 is structured and configured to reverse these movements and return the shutter 20 to the return/rest position.

In reference to FIG. 9C, a cross-sectional view of an electrical wiring device 10 showing the shutter 20 in transit between the return position and the open position is disclosed. As the hot and neutral blades press shutter 20 downwardly, the biasing force of spring 30 is overcome and the shutter 20 remains substantially parallel to the front cover. As the shutter 20 moves downwardly, it also moves generally in the x-direction (to the left in FIG. 9A and to the right in FIG. 9C), as the shutter 20 glides down the diagonal guide ribs 12-4. In FIG. 9C, the width (ΔW) of the opening 20-4 is seen to be much greater than the thickness of the guide rib 12-4 and this feature allows the shutter 20 to move, or wobble, back and forth about the guide rib 12-4 when making its transit from the return position to the open position. (As noted above, this ability to wobble allows the shutter 20 to more effectively move, and resist jamming, in response to being engaged by bent or uneven plug blades etc.). Thus, the present invention overcomes the skewing, alignment, and damaged plug blade issues (related to conventional shutter mechanisms and described above in the Background Section) by allowing the shutter 20 to freely float (within +/−8°) between the cover 12 and the back body 14. Specifically, the present invention provides, in general, shutter 20 translation in the xz-directions while allowing the shutter to "wobble" in all three dimensions (x, y, z); this counter-intuitive wobbling motion prevents damage to the shutter during plug insertion.

In reference to FIG. 10A and FIG. 10B (showing the opposite cross sectional view), the hot blade "H" and the neutral blade "N" of a 15 A corded plug are shown making contact with the hot contact 14-2 and neutral contact 14-3, respectively. At this point, the movement of the plug blades is substantially complete; and, the shutter has been translated to the bottom of the guide ramp 12-4 to fully compress the return spring 30.

Figure 11A:
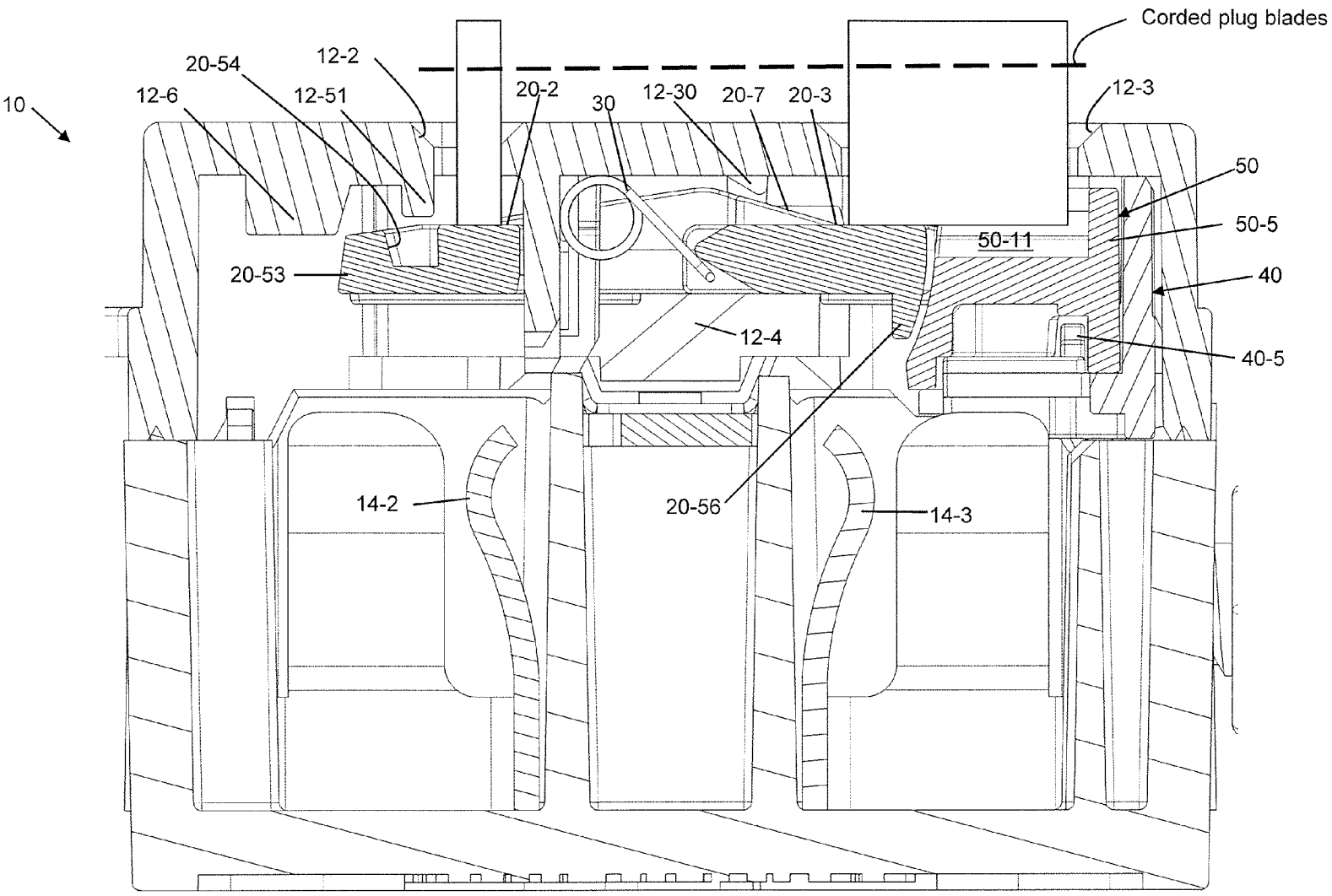
FIG. 11A is a cross sectional view of the shutter assembly with a 20 A corded plug blade assembly driving the shutter element along a translational portion of the guide structure and the tandem shutter element along the guide member in accordance with the present invention.
Figure 11B:
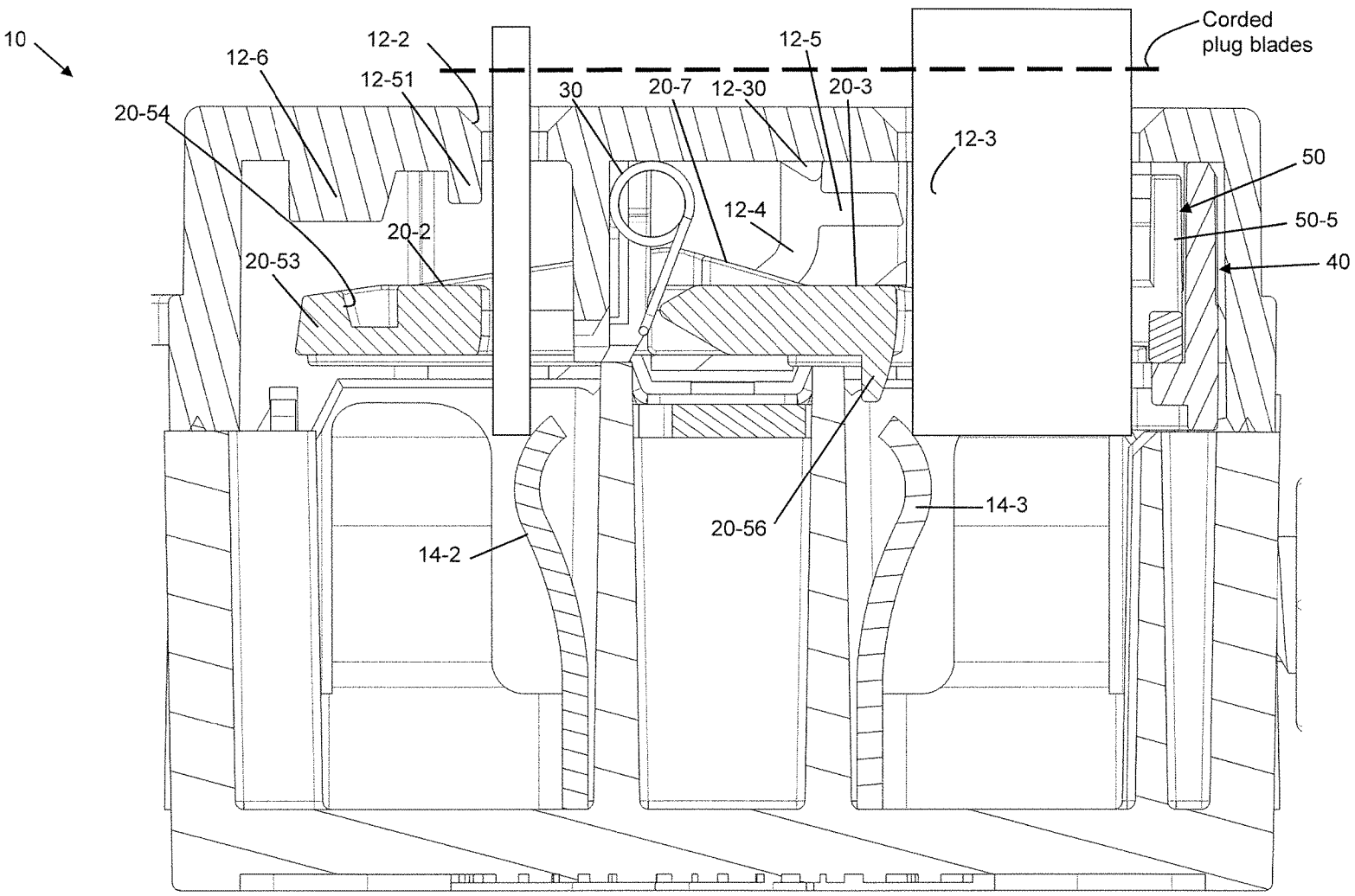
FIGS. 11B and 11C are cross sectional views of the shutter assembly with a 20 A corded plug blade assembly fully inserted in an open position.
Figure 11C:
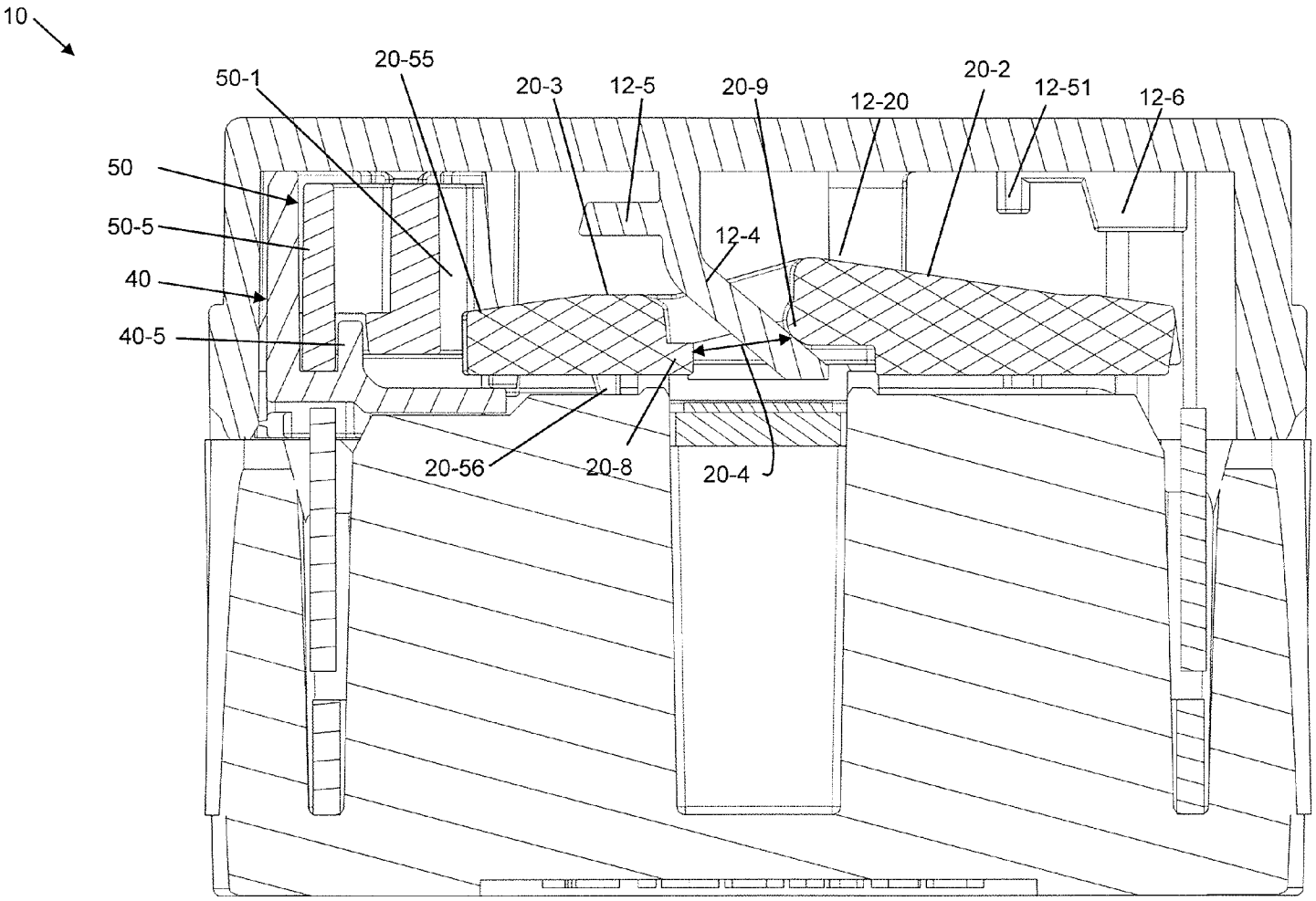

Referring to FIGS. 11A-11C, additional cross-sectional views of the electrical wiring device 10 are disclosed. In these views, 20 A corded plug blades (ones that are normal to each other) are inserted into the cover apertures. Note that FIGS. 11A and 11B are cross-sectional views of an electrical wiring device 10 taken along "A1" of the view illustrated in FIG. 5A, whereas FIG. 11C is a cross-sectional view of an electrical wiring device 10 taken along "A2" of the view illustrated in FIG. 5A.

As illustrated in these views, the shutter 20 is shown in various positions between the return position and the open position. When a 20 A plug is employed, the neutral plug blade will engage the tandem shutter so that it will move in the y-direction (i.e., retract into the pages shown at FIGS. 11A, B). FIG. 11C illustrates that the tandem shutter 50 has been moved in the y-direction by the 20 A neutral plug blade and that the finger 20-55 is retracted and not blocking the tandem blocking cam 50-1. (See also FIG. 6B).

Figure 12:
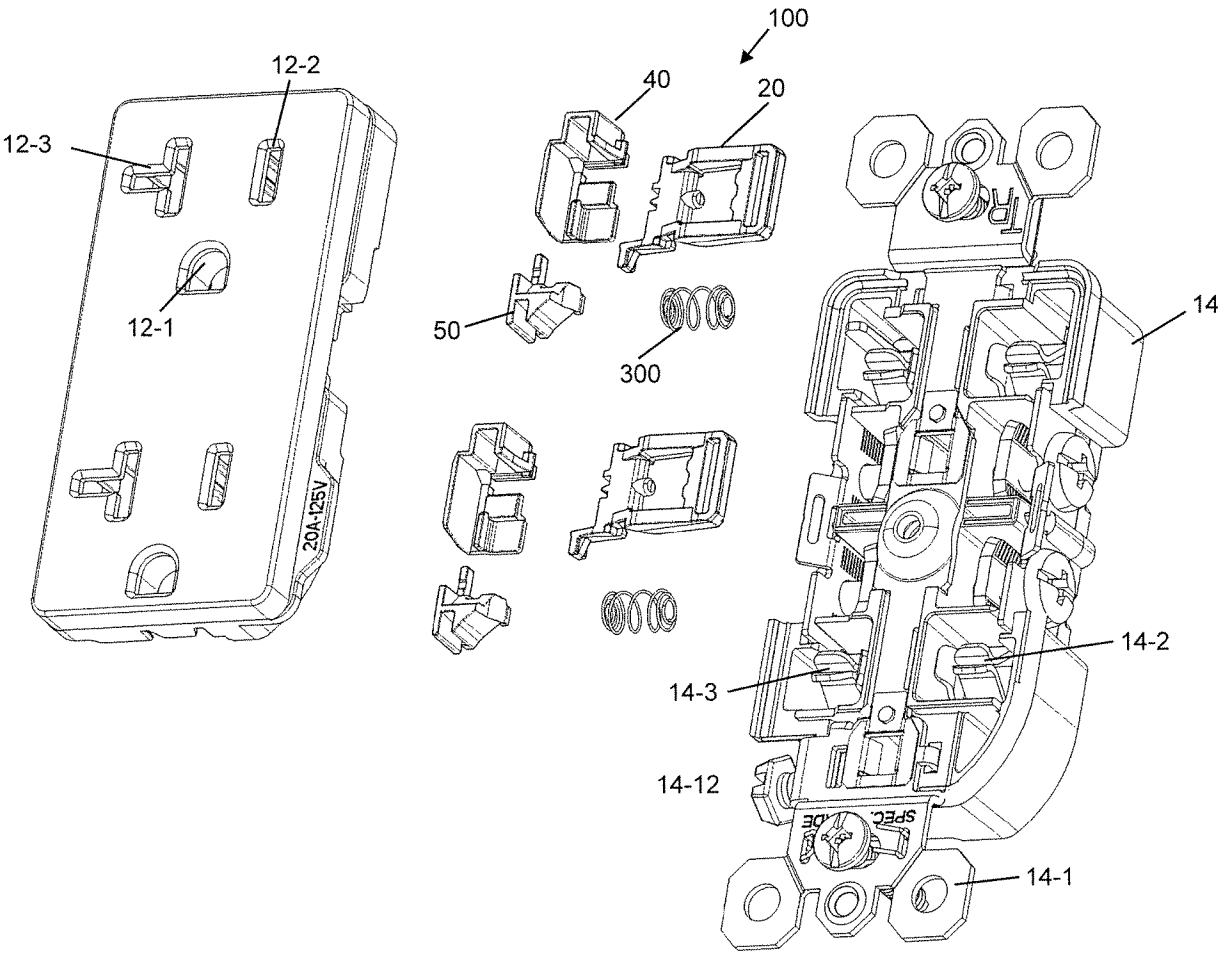
FIG. 12 is an exploded view of an electrical device with the front cover, the shutter assemblies, and the tandem shutters and guide members removed in accordance with an embodiment of the present invention.

With reference to FIG. 12, a 20 A shutter assembly 100 in accordance with another embodiment of the present invention may be used in an electrical wiring device 10, which is shown herein as a 15 A/20 A receptacle device (since the neutral opening 12-3 is configured with a T-slot). Of course, shutter assembly 100 may be used in a strictly 20 A receptacle where neutral opening 12-3 is just a rectangular slot that is normal to opening 12-2. Those skilled in the art will appreciate that the shutter assembly 100 may be adapted for use in protective wiring devices such as GFCIs, AFCIs, TVSSs and the like.

Receptacle 10 includes a cover 12 and a back body 14 and is configured as a duplex device (providing two sets of plug blade openings, one set at each end thereof). Each set of plug blade openings includes a ground prong aperture 12-1, a hot opening 12-2 and a neutral opening 12-3. The cover 12 is configured to mate with a back body 14 that includes a ground strap 14-1, a hot conductor that includes hot contacts 14-2 and a neutral conductor that includes neutral contacts 14-3. The ground aperture 12-1 is aligned and in communication with a ground contact 14-12 formed in the ground strap 14-1, the hot aperture 12-2 is aligned and in communication with a hot contact 14-2, and the neutral aperture 12-3 is aligned and in communication with a neutral contact 14-3. A shutter assembly 100 is positioned between each set of hot and neutral plug blade openings (12-2, 12-3 respectively) and their corresponding hot and neutral contacts (14-2, 14-3), respectively. Shutter assembly 100 may also be employed in receptacle configurations in which a ground contact and aperture are omitted, referred to as a "two opening receptacle."

Each shutter assembly 100 is equipped with a compression spring 300 that is configured to move the shutter to a "return" or "rest" position when no external force is applied to the shutter by a plug or foreign object. To be more specific, the shutter 20 can rotate about an axis between about +/−8 degrees in this position/state. All told, the shutter 20 may be in one of four positions: a return position, a neutral blocking position; a hot blocking position; or an open position. The main shutter 20A operates in concert with the tandem shutter portion that includes the stationary guide member 40 and the tandem shutter 50. Two tandem shutters 50 are shown; one for each neutral opening 12-3 disposed on the cover 12. Each tandem shutter 50 resides within, and is linearly moveable within its respective guide member 40 positioned over the horizontal portion of its respective neutral aperture 12-3. As described herein, the main shutter 20 is rotationally translated in the X-Z plane to allow a linear translation of the tandem shutter 50 in the Y-direction when the shutter assembly 100 moves from the return position to the open position. Specifically, the tandem shutter 50 has two states; an open state when the shutter 20 is opened, and a blocking state when the shutter 20 is in the return or blocking positions.

Figure 13:
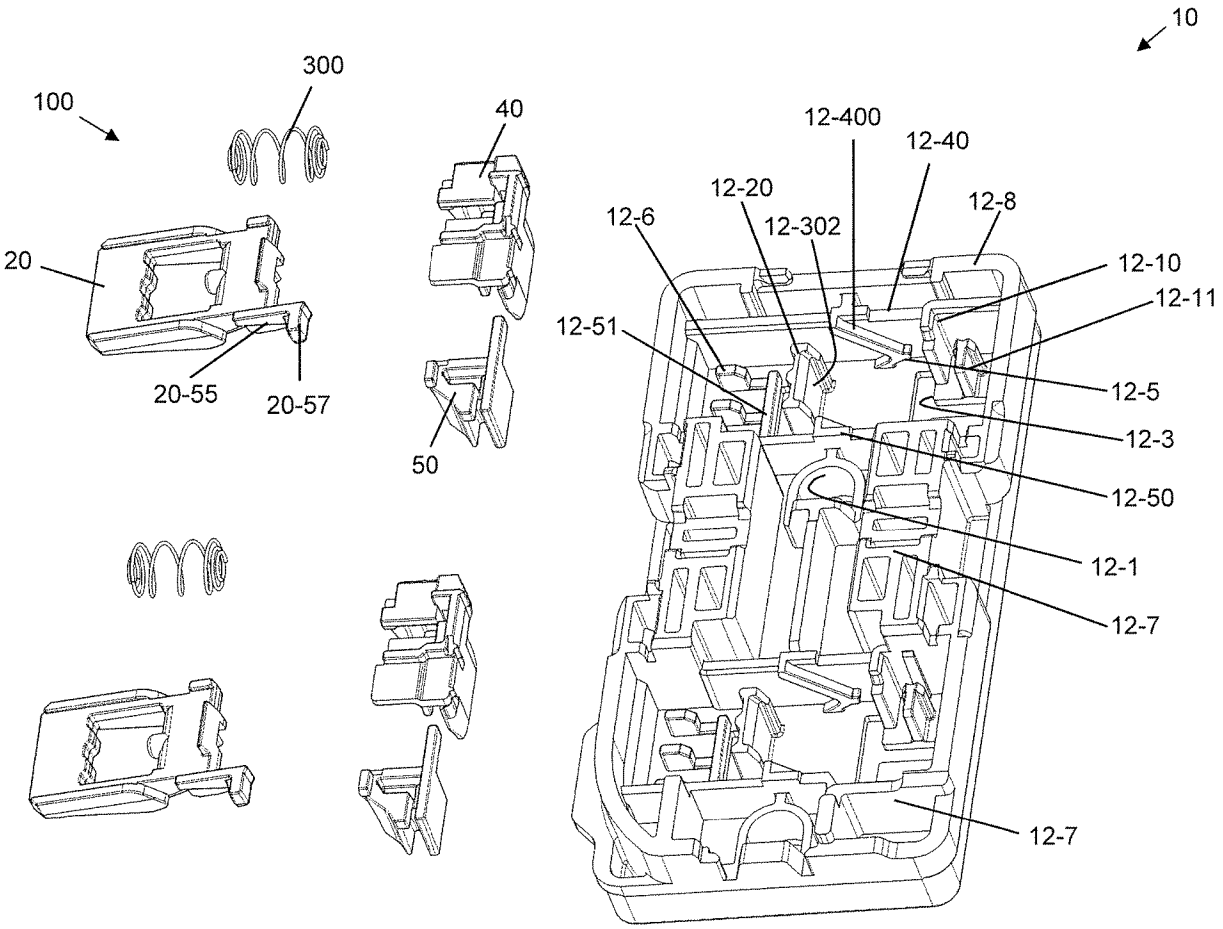
FIG. 13 is an exploded view of an interior of the front cover and the shutter assembly depicted in FIG. 12.

Referring to FIG. 13, an exploded view of an interior of the front cover and the shutter assembly depicted in FIG. 12 is disclosed. The shutter assembly 100 is shown prior to being inserted into the internal portion of the cover 12. Compression spring 300 is approximately 0.2 inches in diameter and is fabricated from a wire that is approximately 0.01 inches in diameter. The compression spring 300 is configured to apply a small amount of force (approximately 100-200 grams). Whereas torsion spring 30 in FIG. 1 provides a translational and rotationally directed force for biasing shutter 20 in the return position, the compression spring 300 only provides a translational force and relies on a different guide rib structure 12-400 and a pair of bearing surfaces (20-90, 20-92) (instead of a single surface 20-9) for accomplishing the rotational positioning. The other elements (guide member 40 and tandem shutter 50) are substantially the same as the corresponding element shown and described in FIGS. 1-11C.

Figure 14:
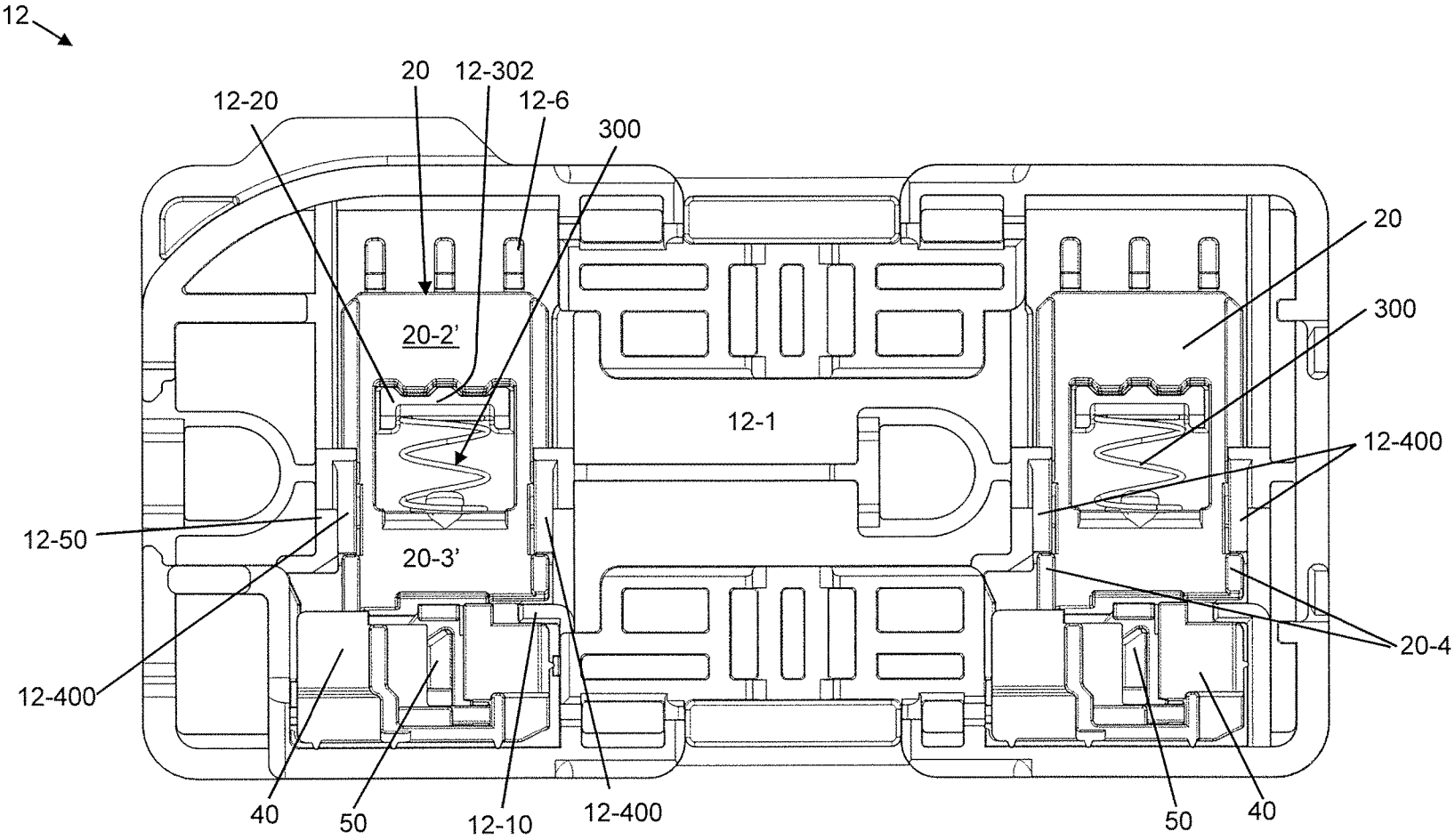
FIG. 14 is a plan view of an interior of the front cover and the shutter assembly depicted in FIG. 12.

Referring to FIG. 14, a plan view of an interior of the front cover 12 and the shutter assembly 100 depicted in FIG. 12 is disclosed. With the exception of the compression spring 300, this embodiment is substantially the same as the embodiment of FIG. 3. Namely, the four piece shutter assembly 100—including shutter elements 20, spring elements 300, the guide element 40 and the tandem shutter 50—is shown coupled to the interior portion of the cover 12. As before, the return spring 300 applies a small force to the shutter 20 so that that it is disposed or maintained in the return state. In the return state/position and the blocking positions, the finger portion 20-55 (not shown in this view) prevents linear motion of the tandem shutter 50 in the y-direction.

Figure 15A:
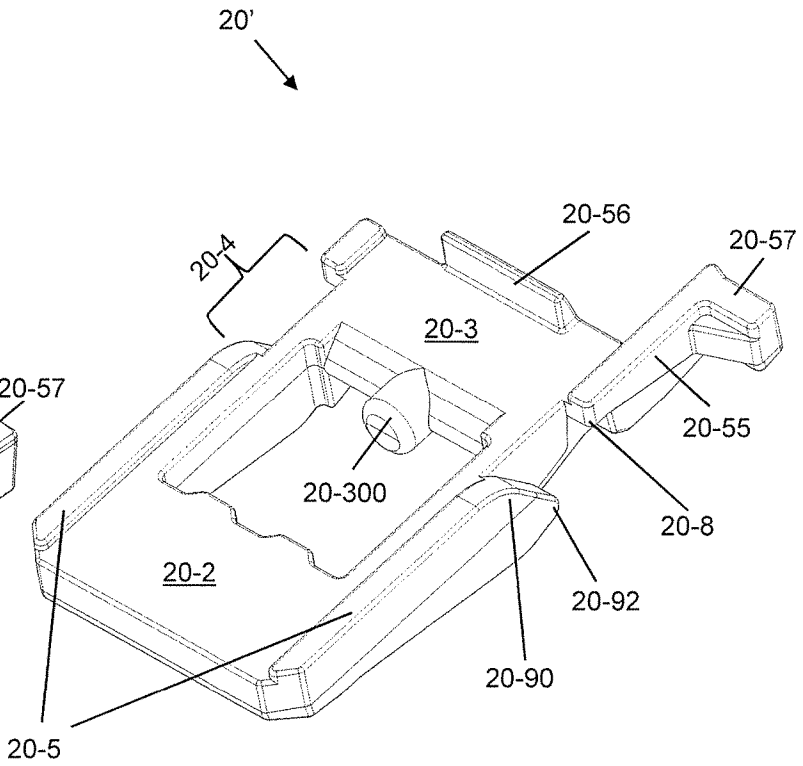
FIGS. 15A-15B are perspective views of the shutter assembly depicted in FIG. 12.
Figure 15B:
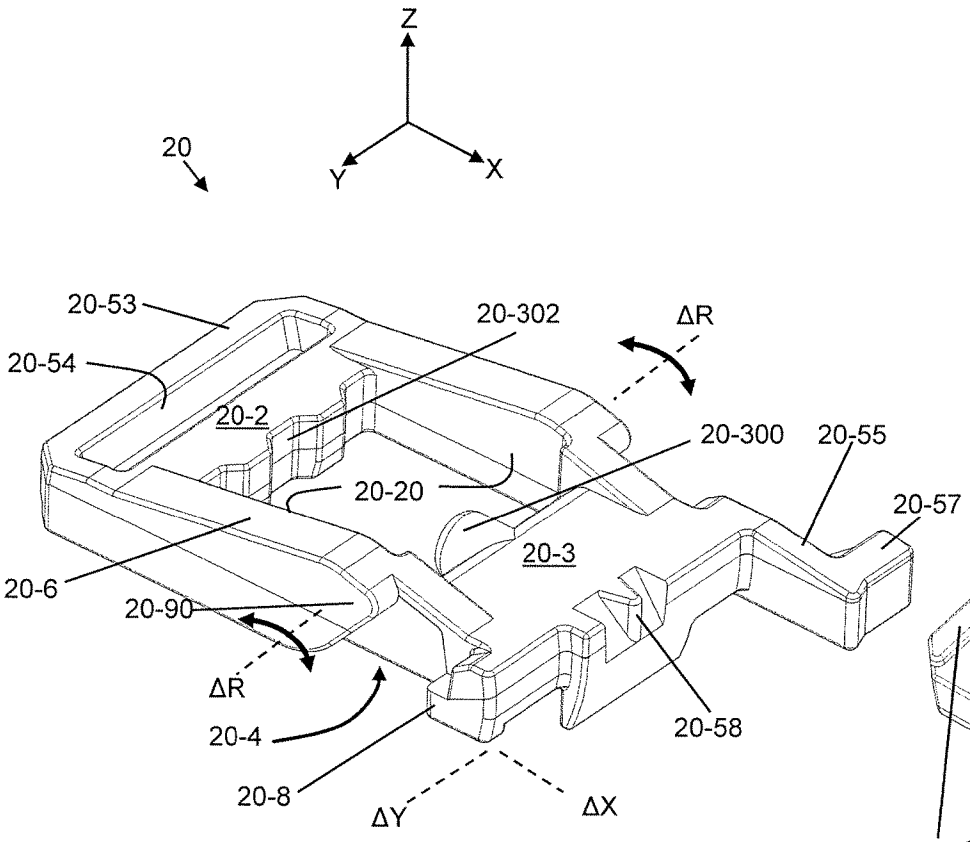

Referring now to FIGS. 15A-15B, isometric detail views of the shutter 20 are provided. The shutter 20 can be fabricated by, e.g., injection molding a suitable plastic material such as Nylon, Polycarbonate, Acetal, Acrylic, Polyester, polyurethane, etc. FIG. 15A and FIG. 15B are substantially the same as FIG. 4A and FIG. 4B, respectively. One set of differences relate to the substitution of the compression spring 300 in place of the torsion spring 30. Thus, the instant embodiment includes a compression spring retainer element 20-300 instead of torsion spring seat 20-30, (FIGS. 4A, B) and a compression spring seat 12-302, opposite thereto (FIG. 13). Another set of differences relates to the bearing surfaces 20-90 and 20-92 in place of bearing surface 20-9.

Figure 16A:
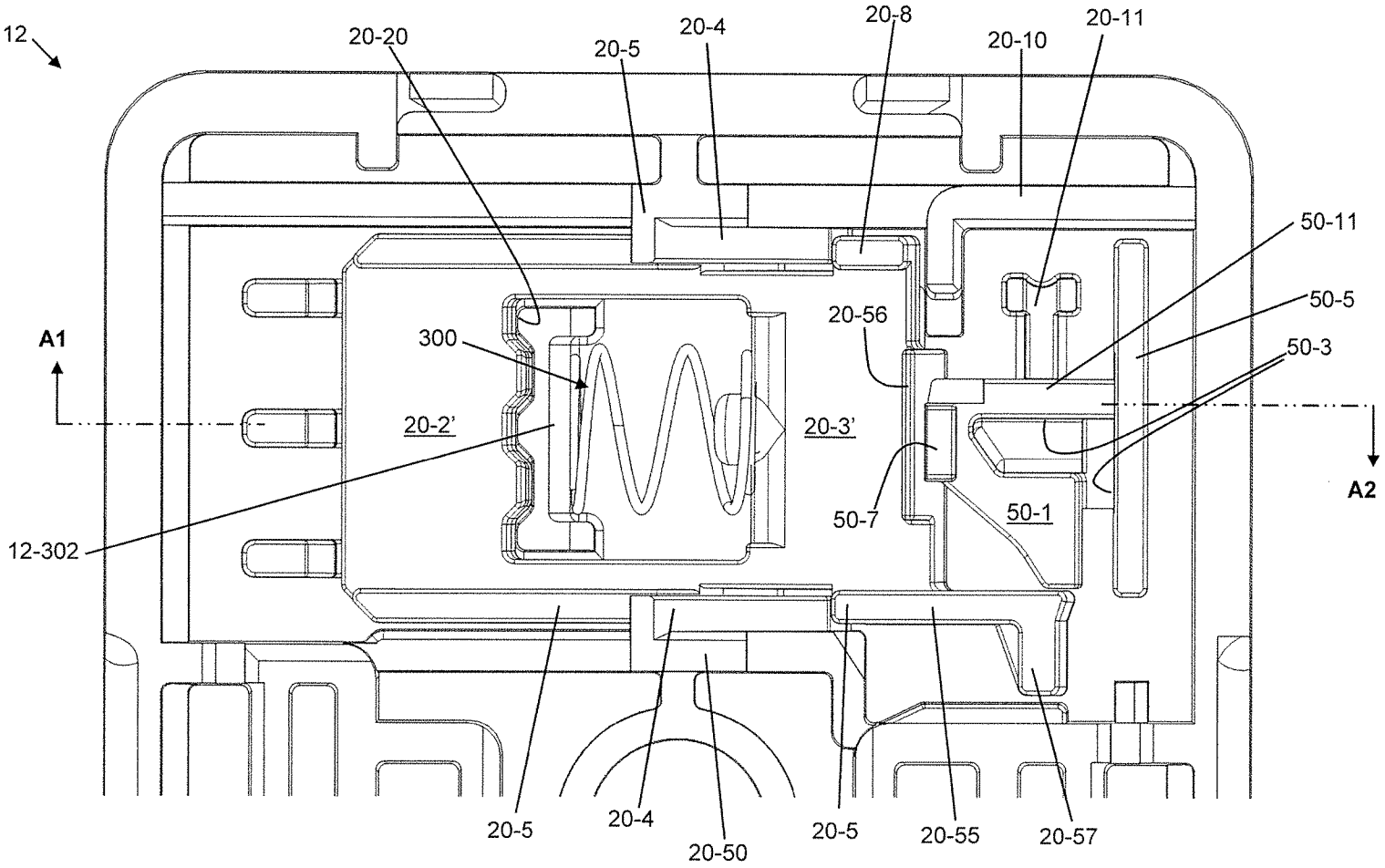
FIGS. 16A-16B are plan views showing an interior of the front cover and the shutter assembly depicted in FIG. 12 in a closed position and in an open position, respectively, in accordance with the present invention.
Figure 16B:
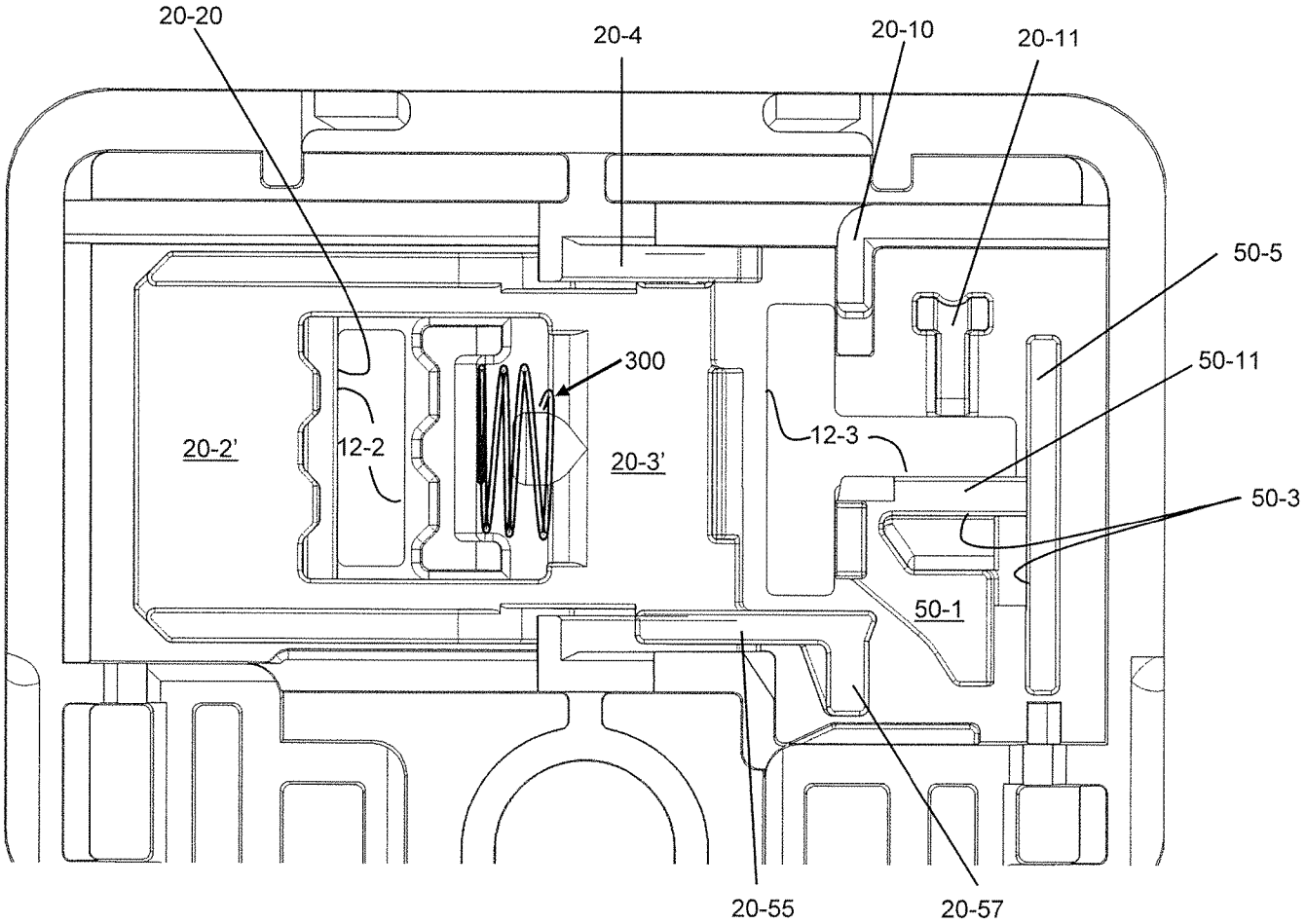

FIGS. 16A-16B are plan views showing an interior of the front cover and the shutter assembly depicted in FIG. 12 in an open position and a closed position, respectively. With the exception of the compression spring 300, these views are substantially the same as the embodiment of FIGS. 5A-5B. Comparing FIG. 16B to FIG. 16A, it becomes apparent that the tandem shutter 50 is linearly translated in the y-direction so that the cover aperture 12-3 is fully opened. Once the 20 A plug blade is removed from the device, the spring 300 is configured to urge the shutter 20 back into the return state (FIG. 16A). Specifically, as the shutter 20 is urged to the right (in FIG. 16B), the finger 20-55 is structured and positioned to engage cam 50-1 so that the tandem shutter 50 is returned to the rest/return position (to thus block the aperture 12-3).

Figure 17:
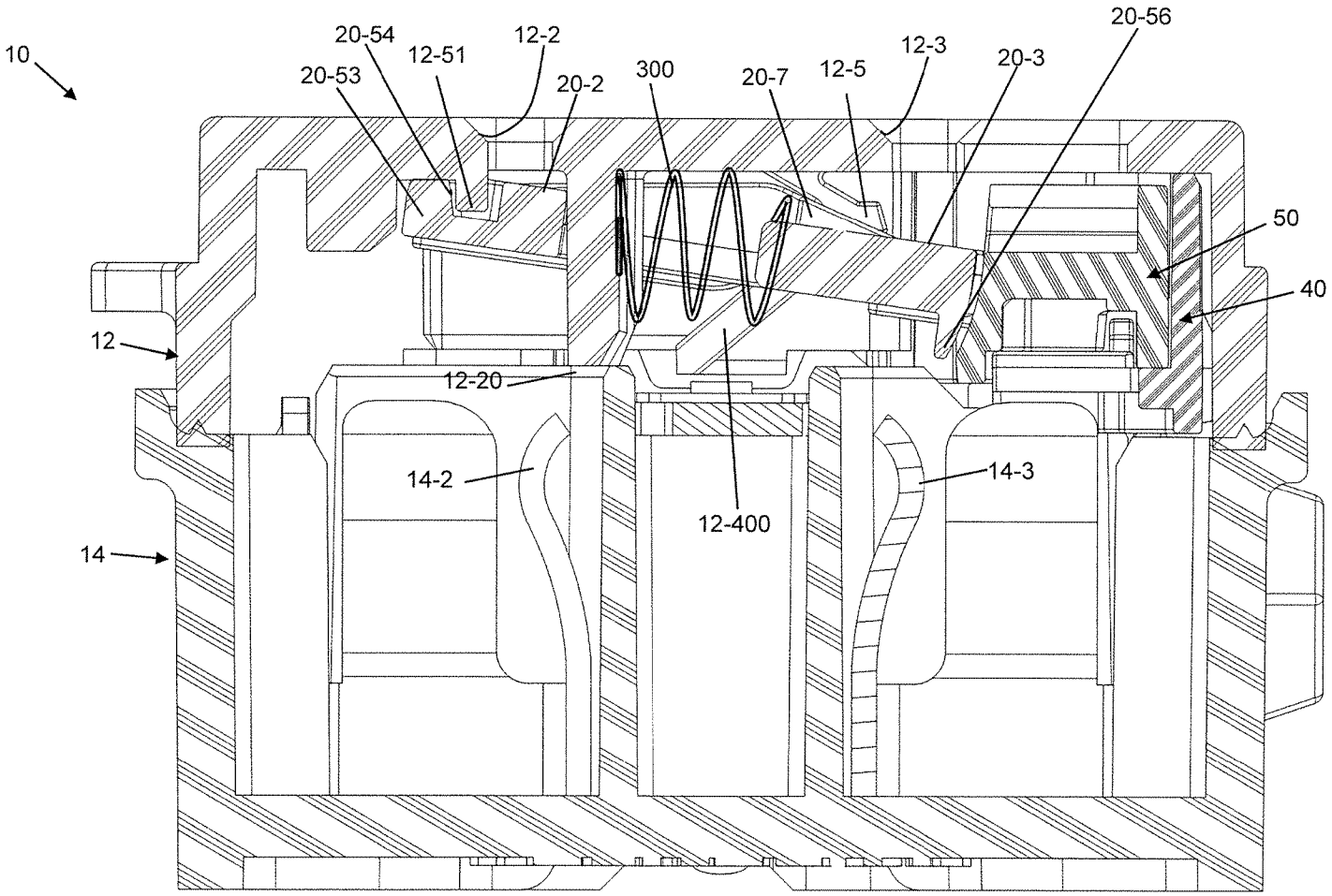
FIG. 17 is a cross sectional view of the shutter assembly depicted in FIG. 12 in a return position in accordance with the present invention.

Referring to FIG. 17, a cross sectional view of the shutter assembly 100 depicted in FIG. 12 is shown in a return position. With the exception of the compression spring 300 and guide rib 12-400, this embodiment is substantially the same as the embodiment of FIG. 7. As before, the return spring 300 applies approximately 100-200 grams of translational force to bias the gussets 20-7 close to, or against, the return ribs 12-30 (within a range +/−8°). When the shutter 20 is in the return position, the finger 20-55 is biased to prevent any linear movement of the tandem shutter 50 in the y-direction toward the finger 20-55. At one end of the angular range (+/−8°) the shutter 20 will be engaged with, but not connected to, the front cover 12. (Specifically, the anti-probing wall 12-51 is engaged with the anti-probing slot 20-54 and the far edge 20-53 of shutter contact pad 20-2 is engaged with the stand-off elements 12-6).

Figure 18A:
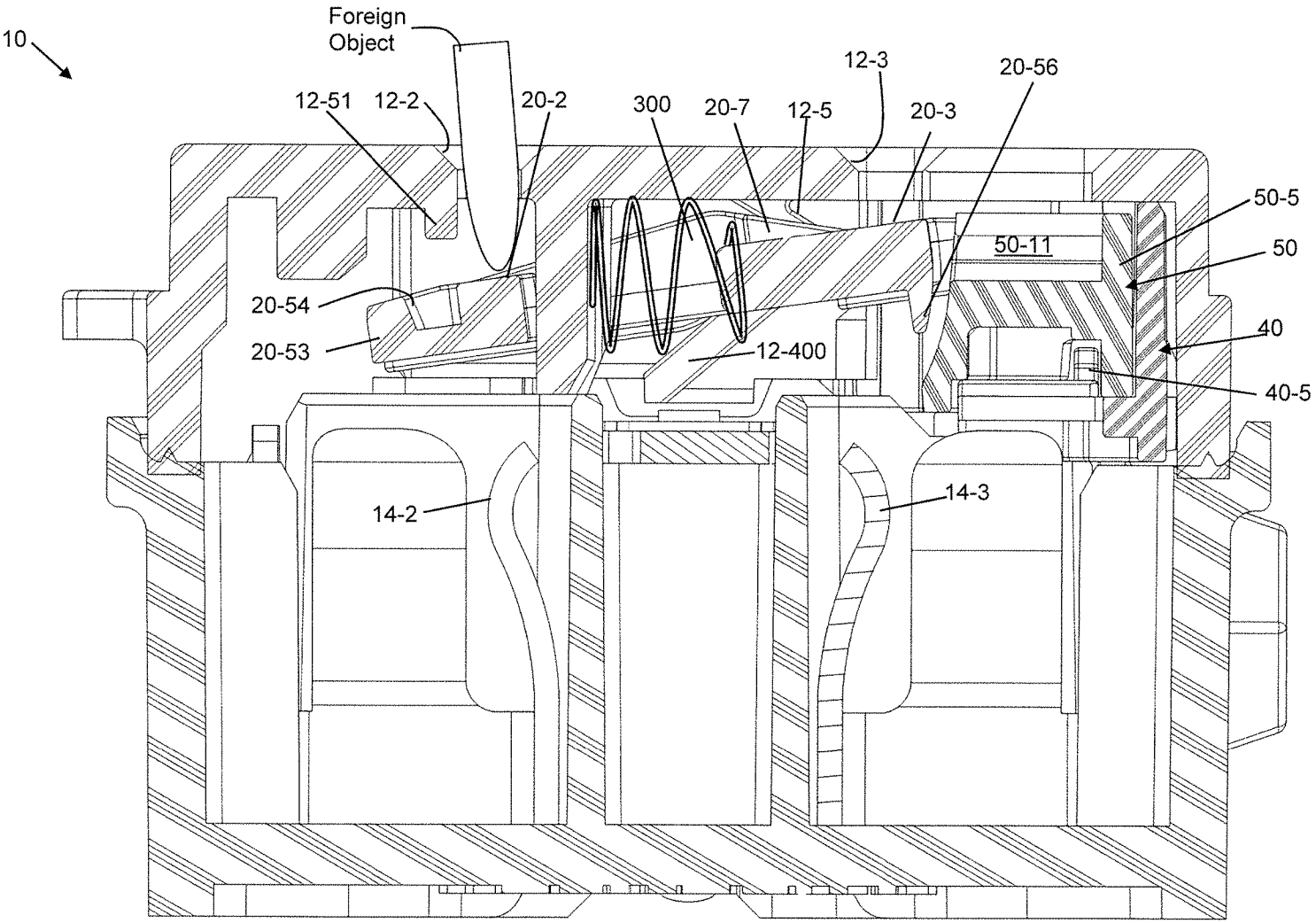
FIGS. 18A-18D are cross sectional views of the shutter assembly depicted in FIG. 12 in a stop position in accordance with the present invention.
Figure 18B:
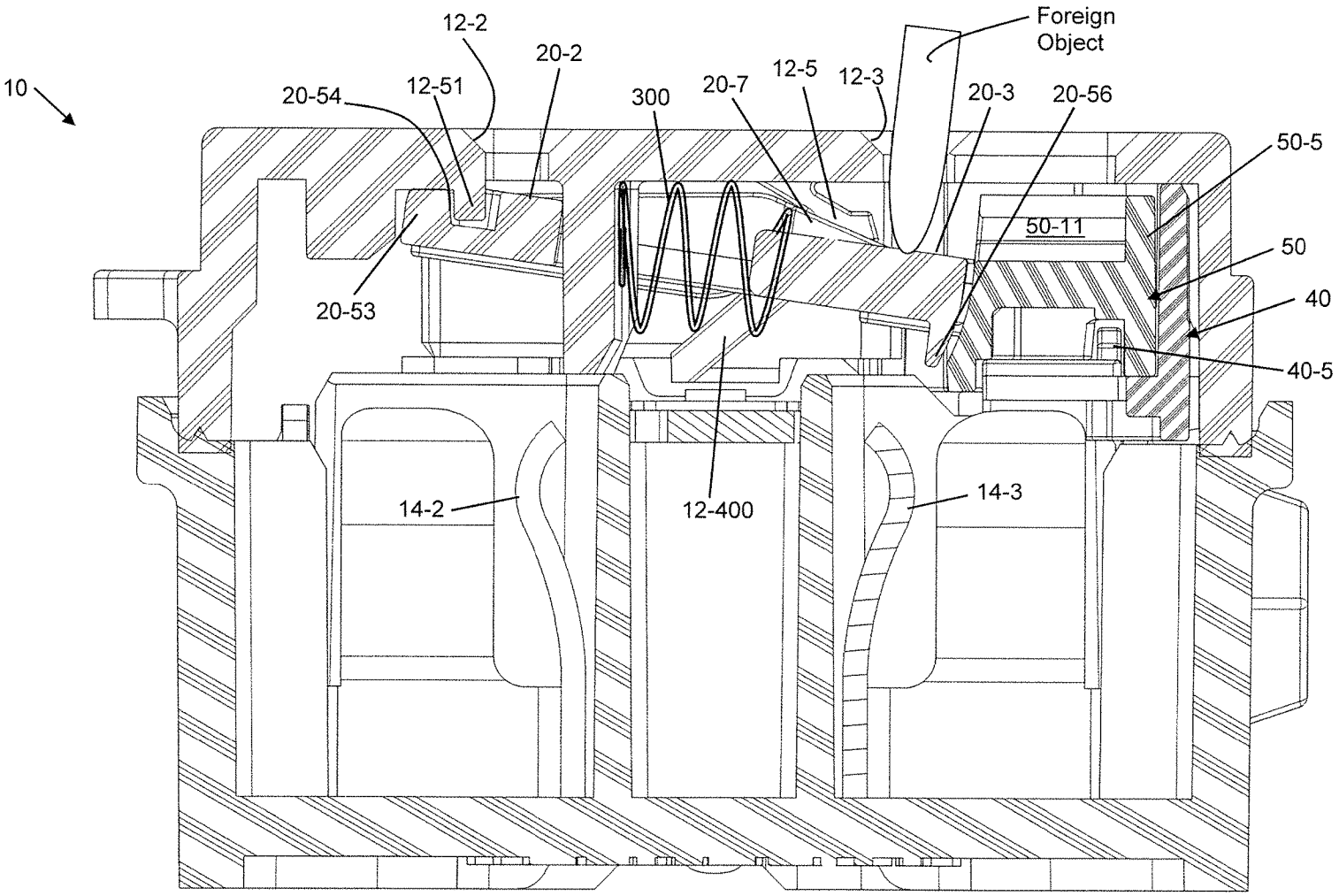
Figure 18C:
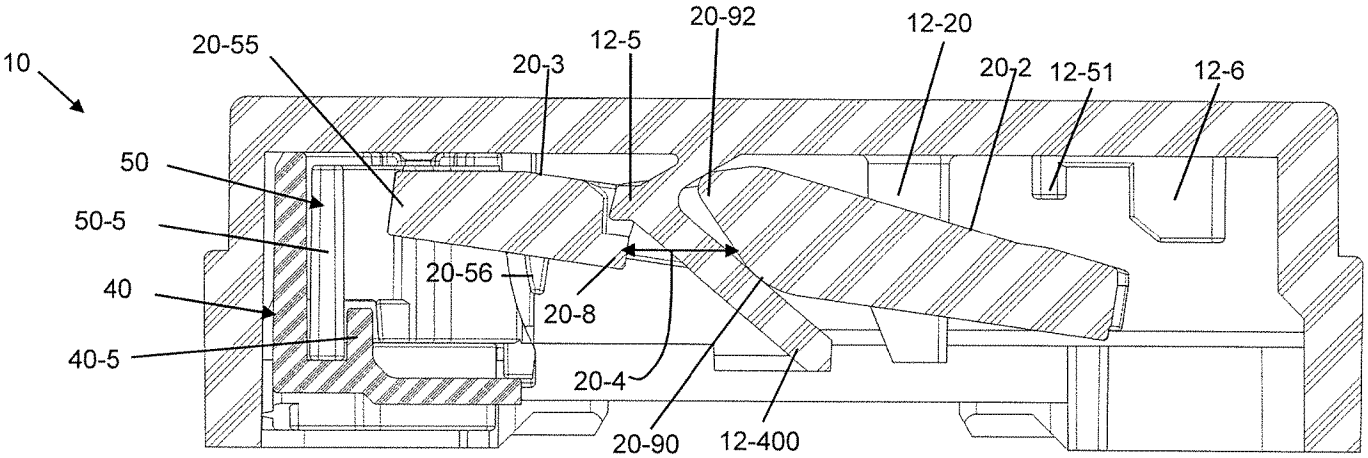
Figure 18D:
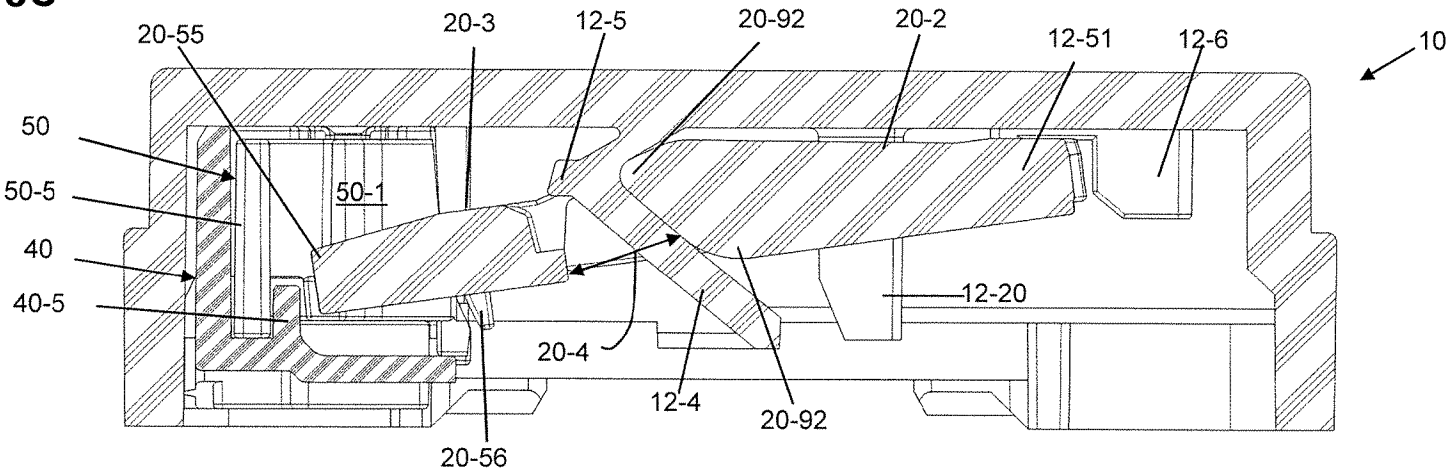

Referring to FIG. 18A-18D, cross sectional views of the shutter assembly depicted in FIG. 12 are shown in various blocking positions. With the exception of the compression spring 300, the guide rib 12-400 and the bearing surfaces (20-90, 20-92), this embodiment is substantially the same as the embodiment of FIG. 8A-8D. FIGS. 18A and 18B are cross-sectional views of an electrical wiring device 10 taken along "A1" of the view illustrated in FIG. 16A. FIGS. 18C and 18D are cross-sectional views of an electrical wiring device 10 taken along "A2" of the view illustrated in FIG. 16A. In these views, the shutter 20 is rotated into a "blocking" position to defeat an object inserted into a single opening, and tandem shutter 50 remains in its blocking state, prevented from moving linearly (by the finger 20-55 on one side and the blocking walls 40-11 on the other side). FIGS. 18C and 18D show the blocking function of finger 20-55 more clearly (the blocking of the tandem shutter 50 by finger 20-55).

Whereas some embodiments of the present invention rely on a spring and a single bearing surface for shutter rotation, the instant embodiment accomplishes this rotational movement by modifying the shutter 20 and the guide ribs 12-400. In particular, shutter 20 has two bearing surfaces (20-90, 20-92) that pivot about the V-shaped portion of the guide ribs 12-400.

Figure 19A:
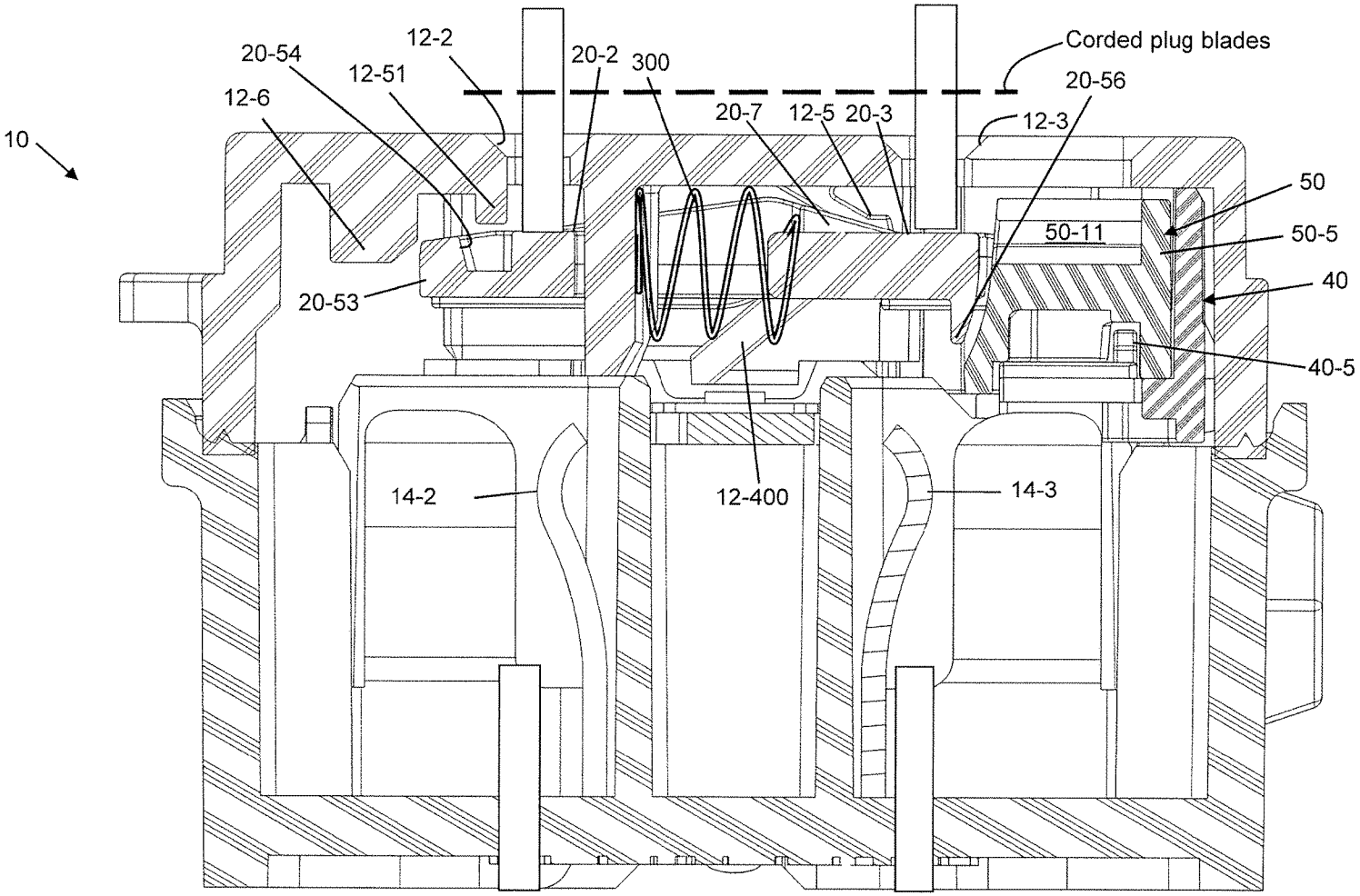
FIGS. 19A-19C are cross sectional views of the shutter assembly depicted in FIG. 12.
Figure 19B:
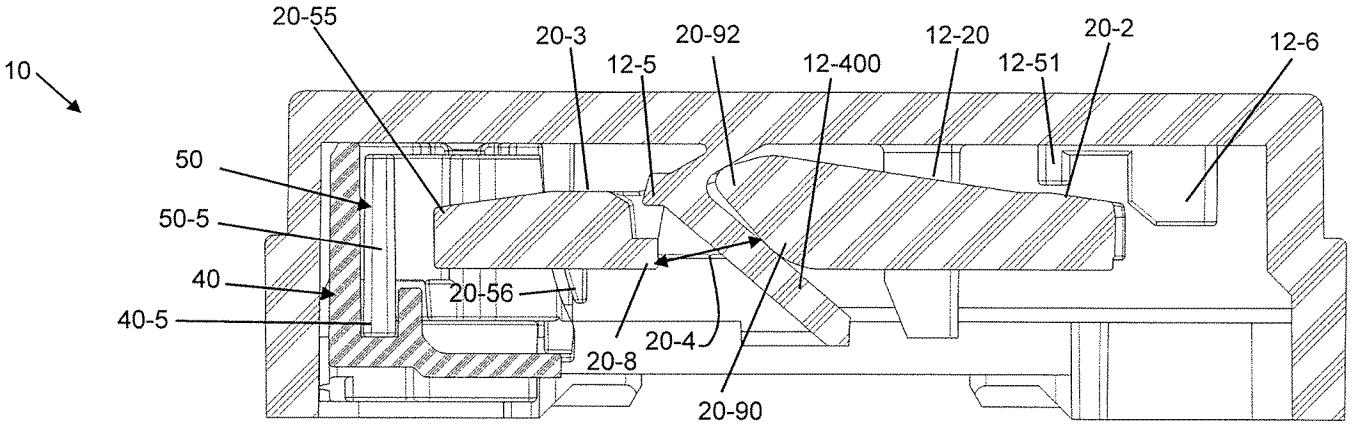
Figure 19C:
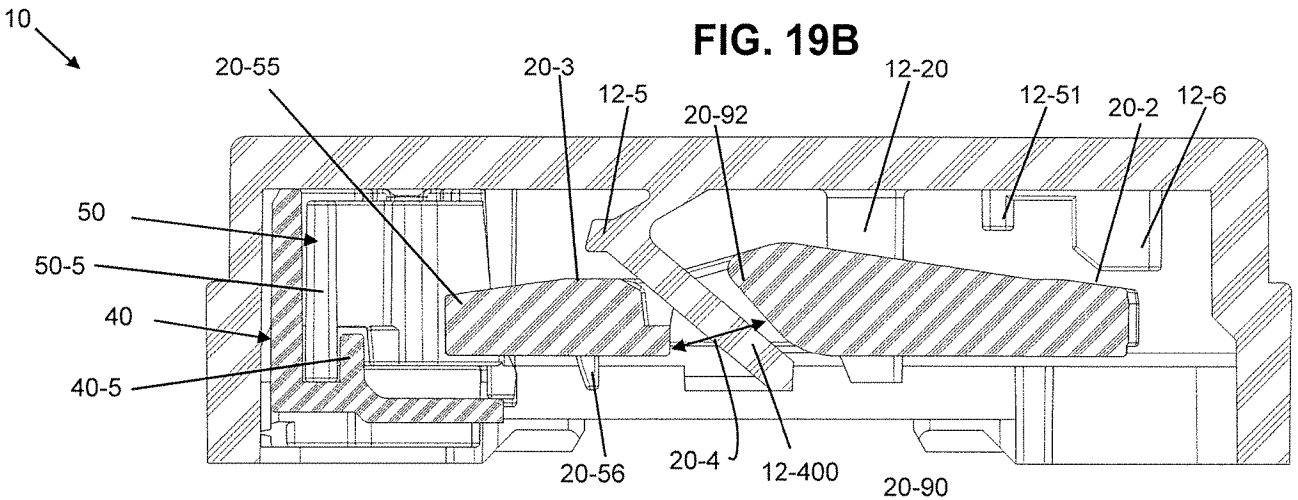
Figure 20A:
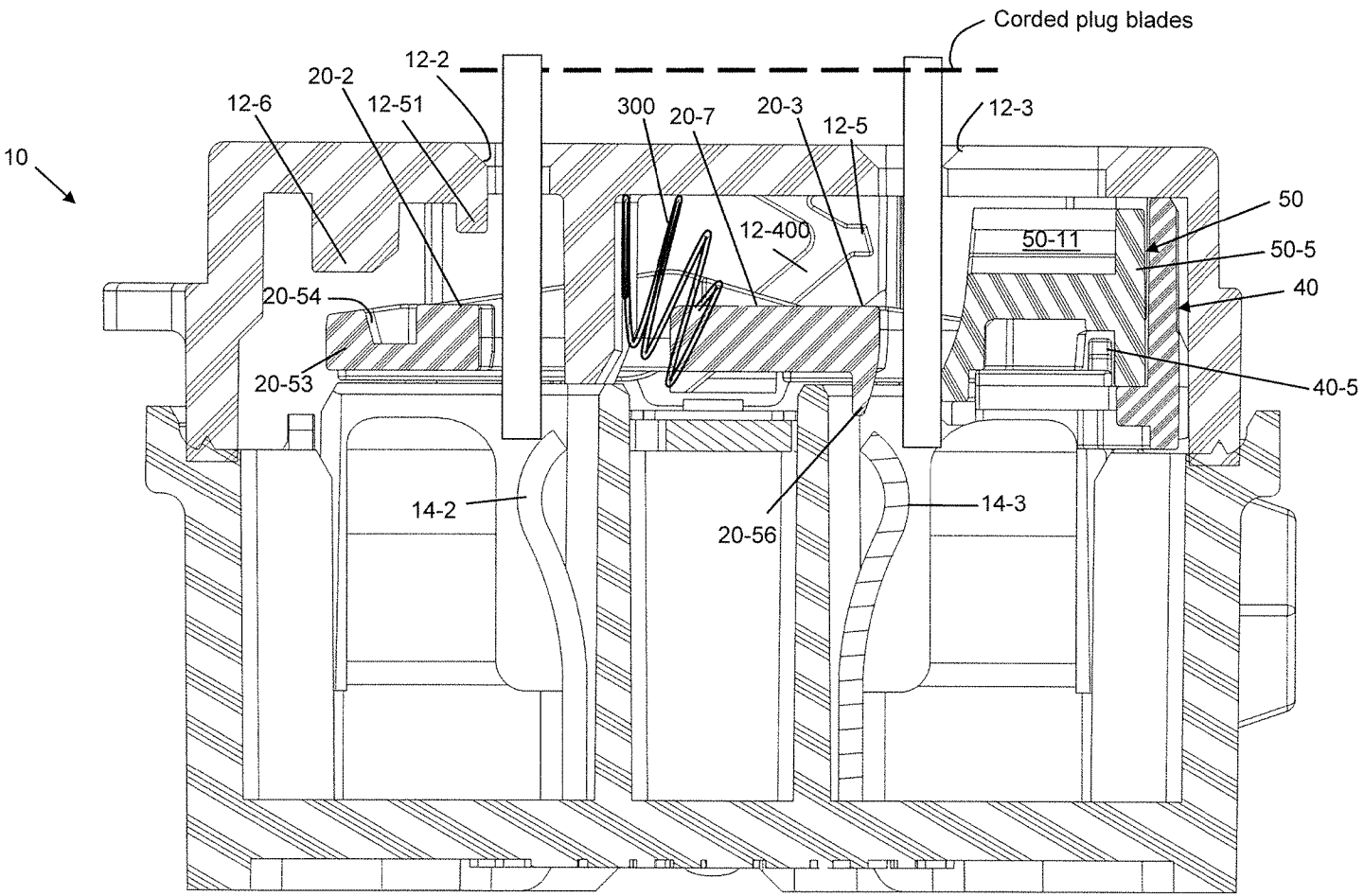
FIGS. 20A-20B are cross sectional views of the shutter assembly depicted in FIG. 12 in an open position.
Figure 20B:
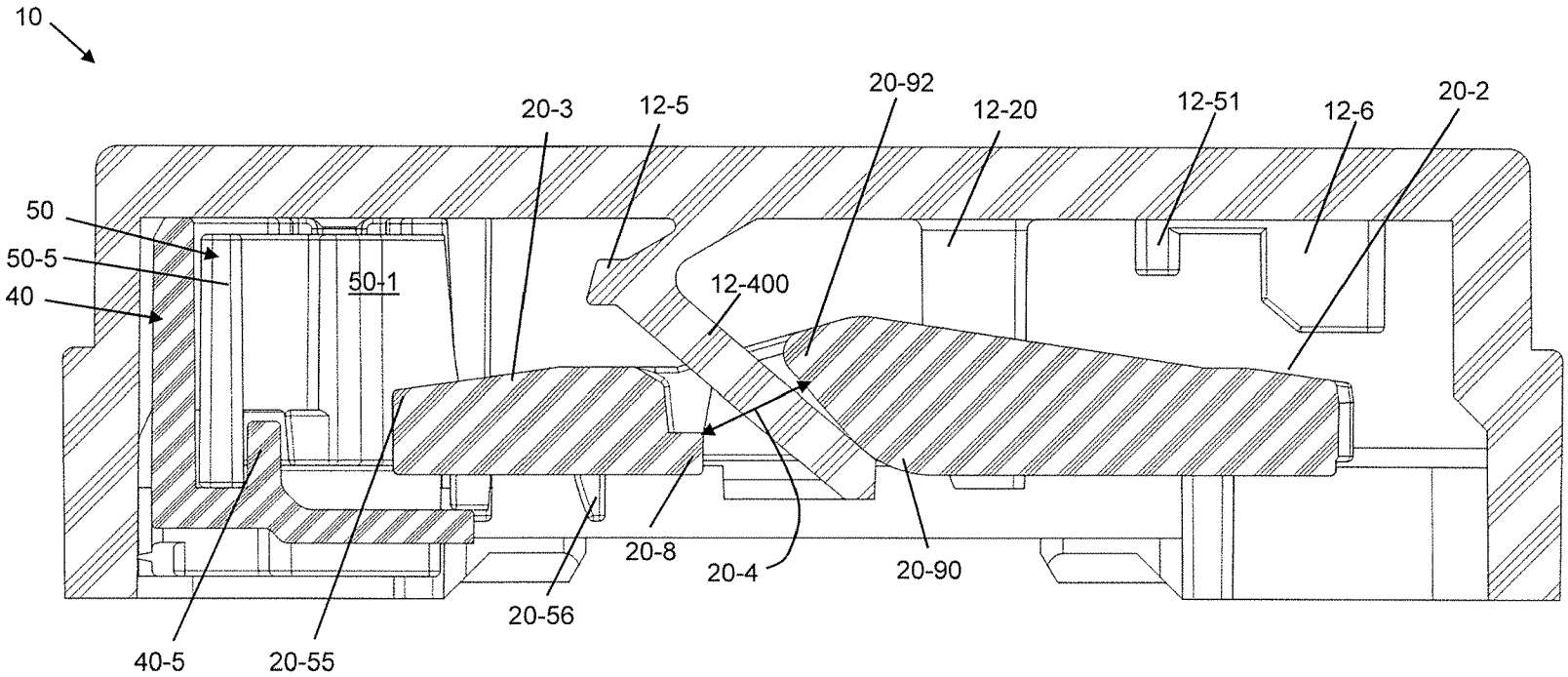

FIGS. 19A-19C, are cross sectional views of the shutter assembly depicted in FIG. 12 with 15 A corded plug blades inserted into the cover apertures 12-2, 12-3. With the exception of the compression spring 300, guide rib 12-400 and bearing surfaces (20-90, 20-92), this embodiment is substantially the same as the embodiment of FIG. 9A-9C. FIGS. 20A-20B are cross sectional views of the shutter assembly depicted in FIG. 12 in the open position (the 15 A corded plug blades are engaging contacts 14-2, 14-3).

Thus, FIGS. 19A and 20A are cross-sectional views of an electrical wiring device 10 taken along "A1" of the view illustrated in FIG. 16A. FIGS. 19B, 19C and 20B are cross-sectional views of an electrical wiring device 10 taken along "A2" of the view illustrated in FIG. 16A.

As before, the shutter 20 is shown in various positions along its x and z movement from the return/rest position to the open position. As noted above, the tandem shutter 50 has two states; an open state when the shutter 20 is opened, and a blocking state when the shutter 20 is in one of the return or blocking positions. In addition, note that when 15 A plug blades are inserted into apertures 12-2, 12-3, there is no plug blade component that exerts any force on the tandem shutter 50 to cause it to move into the open position, and thus, it tends to remain in the closed or blocking position.

In reference to FIG. 19C, a cross-sectional view of an electrical wiring device 10 showing the shutter 20 in transit between the return position and the open position is disclosed. As the hot and neutral blades press shutter 20 downwardly, the biasing force of spring 300 is overcome and the shutter 20 remains substantially parallel to the front cover. As the shutter 20 moves downwardly, bearing surface 20-90 slides along guide ribs 12-400 (note that there is no interaction with bearing surface 20-92 during opening). Shutter 20 also moves generally in the x-direction (to the left in FIG. 19A and to the right in FIG. 19C), as the shutter 20 glides down the diagonal guide ribs 12-400. In FIG. 19C, the width ($\Delta W$) of the opening 20-4 is seen to be much greater than the thickness of the guide rib 12-4 and this feature allows the shutter 20 to move, or wobble, back and forth about the guide rib 12-4 when making its transit from the return position to the open position. (As noted above, this ability to wobble allows the shutter 20 to more effectively move, and resist jamming, in response to being engaged by bent or uneven plug blades etc.). As in the previous embodiment, the present invention overcomes the skewing, alignment, and damaged plug blade issues (related to conventional shutter mechanisms and described above in the Background Section) by allowing the shutter 20 to freely float (within +/−8°) between the cover 12 and the back body 14. Specifically, the present invention provides, in general, shutter 20 translation in the xz-directions while allowing the shutter to "wobble" in all three dimensions (x, y, z); this counter-intuitive wobbling motion prevents damage to the shutter during plug insertion.

In reference to FIG. 20A, the compression spring 300 is employed in an unusual, but advantageous, manner. As those of ordinary skill in the art will appreciate, a compression force is usually applied at one end of the spring so that the spring is compressed and relaxed along the spring's longitudinal axis. In this embodiment, the shutter 20 is translated in the X-Z plane so that the spring 300 also rotates in this plane. Specifically, the end of the spring is fixed to the cover 12 (at 12-302) while the other end of the spring is attached to the shutter post 20-300 so that the spring 300 is allowed to rotate in the X-Z plane as the shutter is being translated.

Figure 21A:
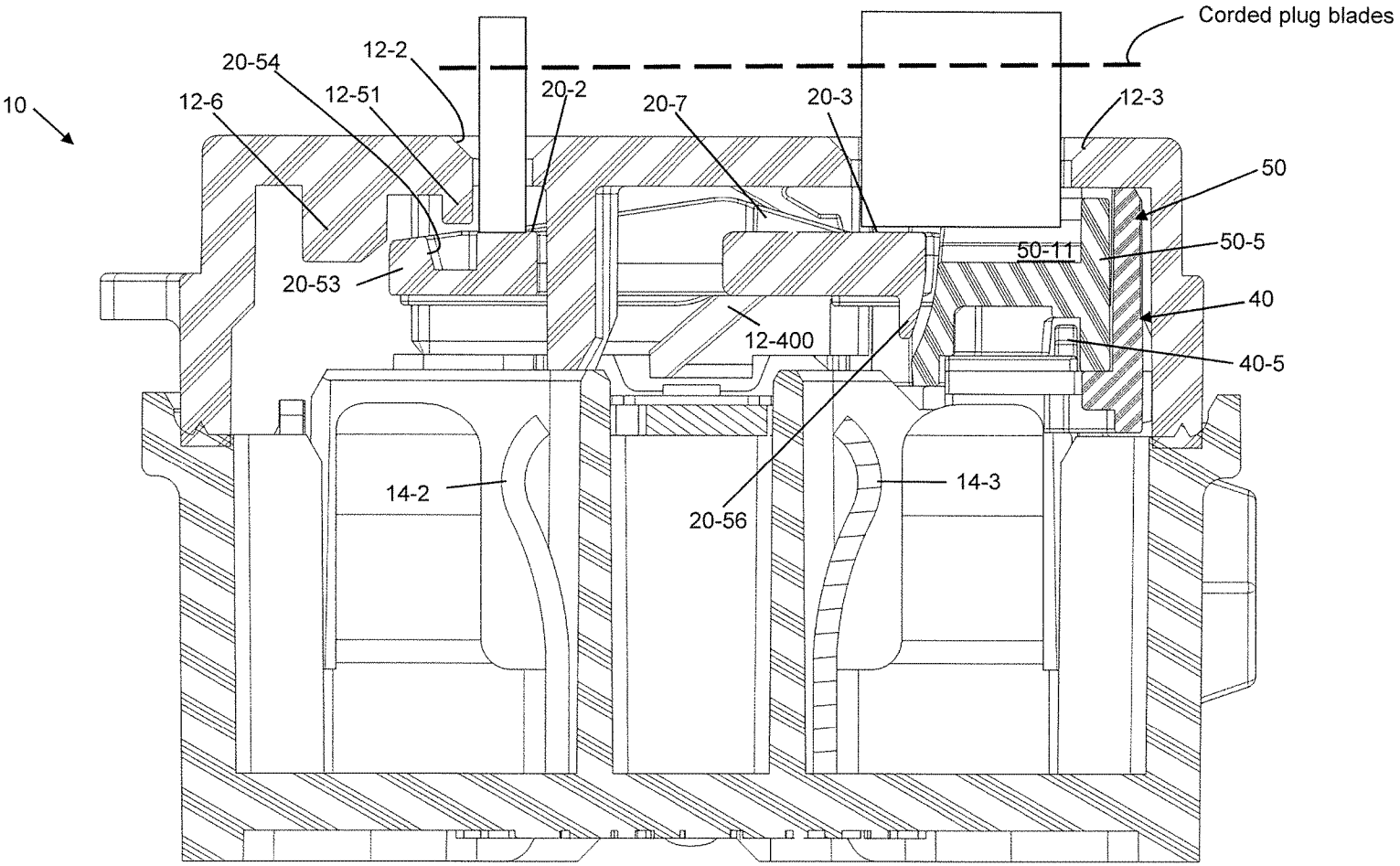
FIG. 21A is a cross sectional view of the shutter assembly depicted in FIG. 12 with a 20 A corded plug blade assembly inserted in accordance with the present invention.

FIG. 21A is a cross sectional view of the shutter assembly depicted in FIG. 12 with a 20 A corded plug blade assembly inserted in accordance with the present invention. With the exception of guide rib 12-400, this embodiment is substantially the same as the embodiment of FIG. 11A.

Figure 21B:
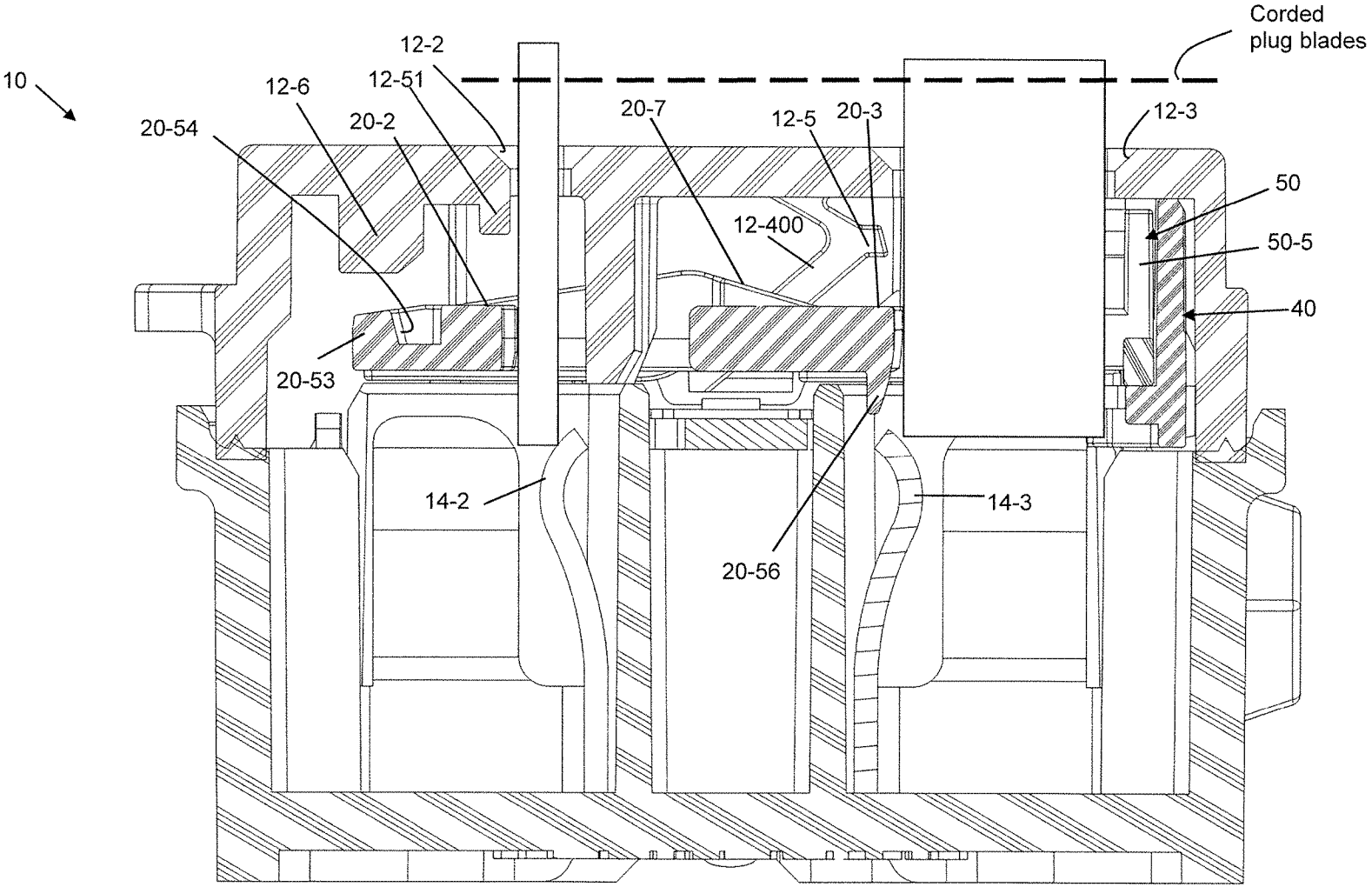
FIGS. 21B and 21C are cross sectional views of the shutter assembly depicted in FIG. 12 with a 20 A corded plug blade assembly fully inserted and the shutter assembly in an open position.
Figure 21C:
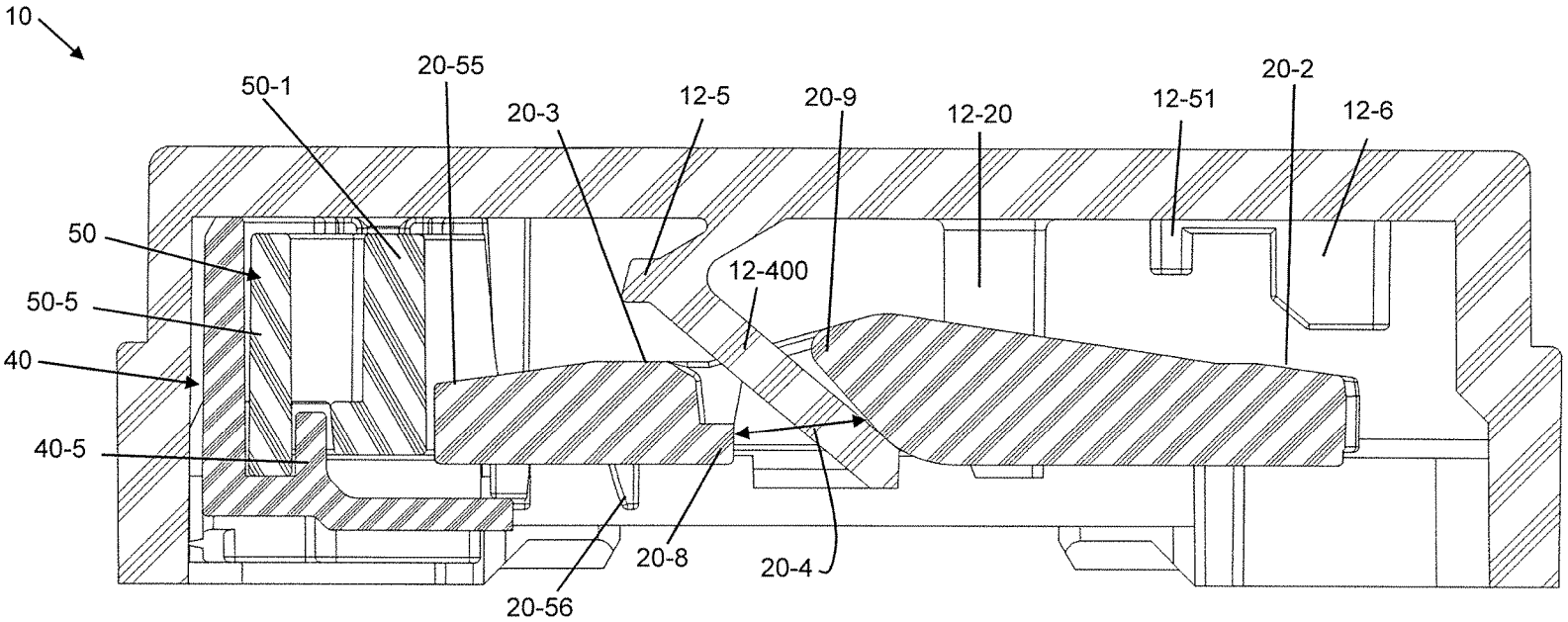

FIGS. 21B and 21C are cross sectional views of the shutter assembly depicted in FIG. 12 with a 20 A corded plug blade assembly fully inserted and the shutter assembly in an open position. With the exception of the guide rib 12-400, this embodiment is substantially the same as the embodiment of FIGS. 11B-11C. When a 20 A plug is employed, the neutral plug blade will engage the tandem shutter so that it will move in the y-direction (i.e., retract into the pages shown at FIGS. 21A, B). FIG. 21C illustrates that the tandem shutter 50 has been moved in the y-direction by the 20 A neutral plug blade so that the finger 20-55 is retracted and not blocking the tandem blocking cam 50-1. (See also FIG. 6B).

Figure 22:
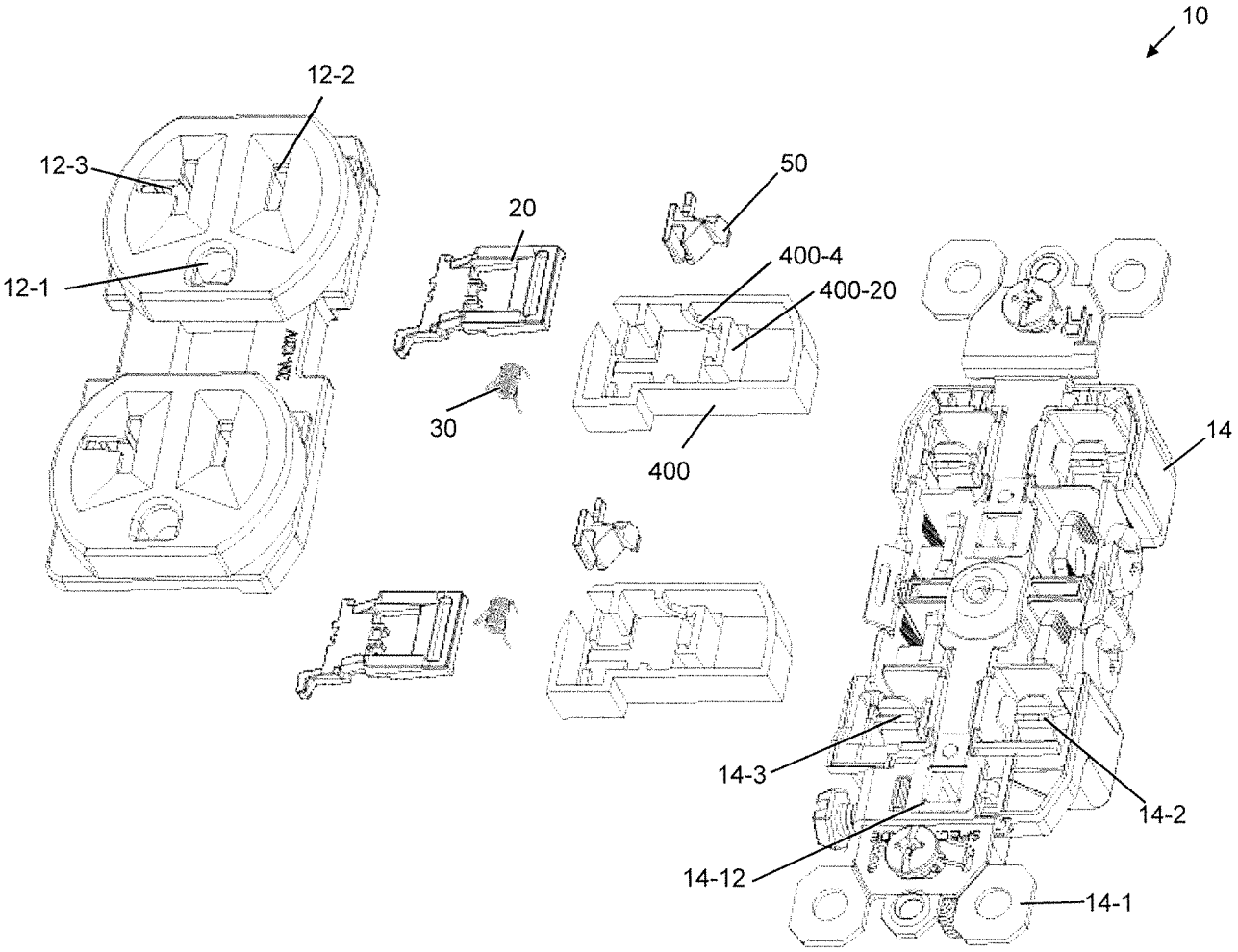
FIG. 22 is an exploded view of an electrical device with the front cover and the shutter assembly removed in accordance with another embodiment of the present invention.

As embodied herein and depicted in FIG. 22, an exploded view of another electrical device with the front cover and the shutter assembly removed is disclosed. This embodiment is similar to the embodiment depicted in FIGS. 1-11C.

As before, the receptacle 10 includes a cover 12 and a back body 14 and is configured as a duplex device (providing two sets of plug blade openings, one set at each end thereof). Each set of plug blade openings includes a ground prong aperture 12-1, a hot opening 12-2 and a neutral opening 12-3. The cover 12 is configured to mate with a back body 14.

Unlike the previous embodiments, the features that were previously provided in the cover are relocated into guide structure 400. The lateral walls of guide member 400 function much like gussets 12-40 and 12-50. Thus, the shutter guide ribs 400-4 are formed on the interior face of the lateral walls of guide member 400. As before, a shutter catch 400-5 is attached to each guide rib 400-4 and a return rib 400-30 extends substantially perpendicular from each guide rib 400-4 and shutter catch 400-5. The guide member also includes a plurality of stand-off elements 400-6, anti-probing walls 400-10 and 400-20, and 400-51.

The shutter 20 and tandem shutter 50 are disposed in the guide member 400 so that they are positioned between each set of hot and neutral plug blade openings (12-2, 12-3 respectively) and their corresponding hot and neutral contacts (14-2, 14-3), respectively. Each shutter 20 is equipped with a dual-torsion return spring 30 that is configured to move the shutter to a "return" or "rest" position when no external force is applied to the shutter by a plug or foreign object. To be more specific, the shutter 20 can rotate about an axis between about +/−8 degrees in this position/state. All told, the shutter 20 may be in one of four positions: a return position, a neutral blocking position; a hot blocking position; or an open position. As before, the main shutter 20A operates in concert with the tandem shutter 50.

Figure 23:
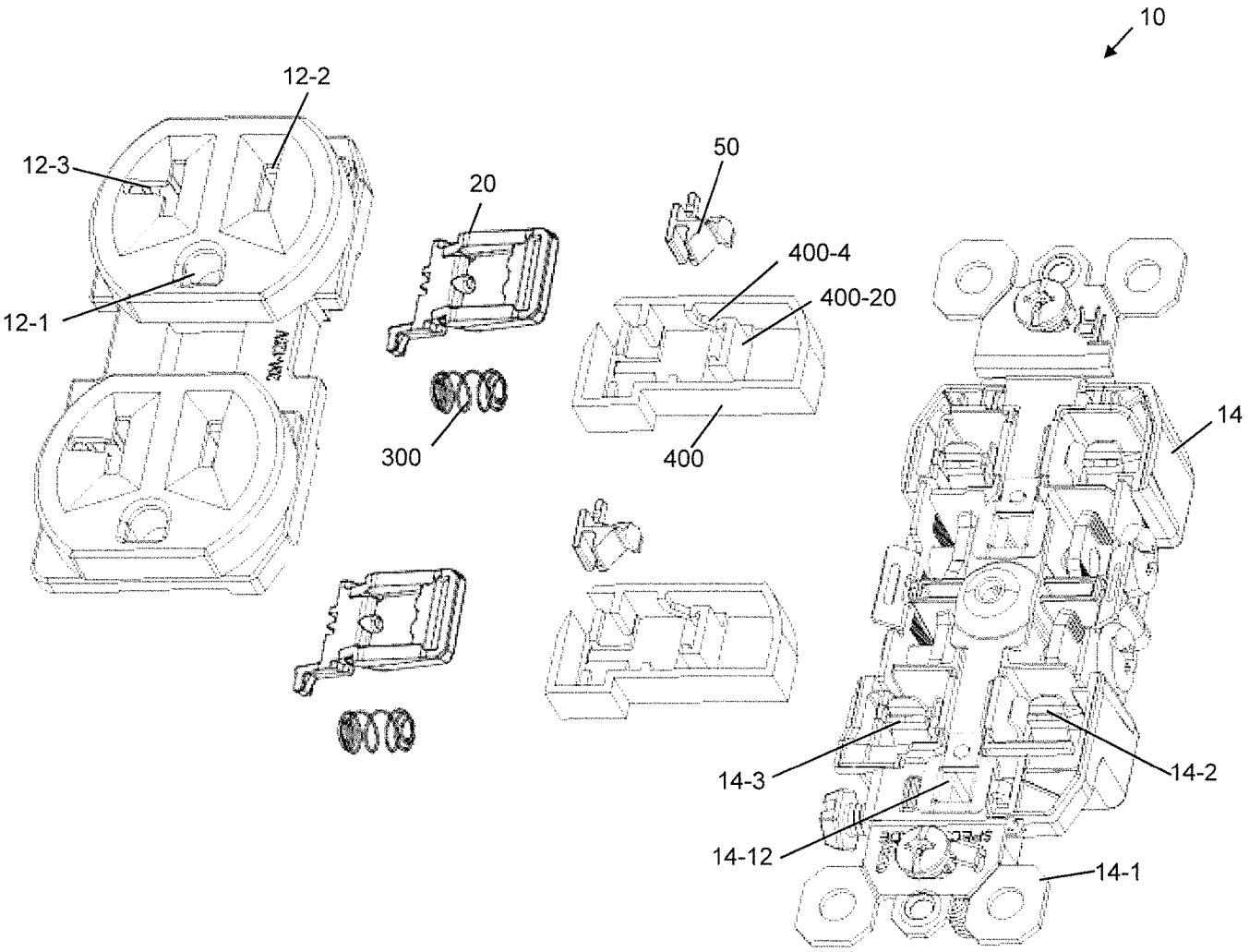
FIG. 23 is an exploded view of an electrical device with the front cover and the shutter assembly removed in accordance with another embodiment of the present invention.

As embodied herein and depicted in FIG. 23, an exploded view of yet another electrical device with the front cover and the shutter assembly removed is disclosed. This embodiment is similar to the embodiment depicted in FIGS. 12-21C. Thus, with the exception of the compression spring 300, this embodiment is substantially the same as the embodiment of FIG. 22. Each shutter 20 is equipped with a compression spring 300 that is configured to move the shutter to a "return" or "rest" position when no external force is applied to the shutter by a plug or foreign object. To be more specific, the shutter 20 can rotate about an axis between about +/−8 degrees in this position/state. All told, the shutter 20 may be in one of four positions: a return position, a neutral blocking position; a hot blocking position; or an open position. The main shutter 20A operates in concert with the tandem shutter 50.

Like FIG. 22, the features that were previously provided in the cover are relocated into guide structure 400. The lateral walls of guide member 400 function much like gussets 12-40 and 12-50. Thus, the shutter guide ribs 400-4 are formed on the interior face of the lateral walls of guide member 400. As before, a shutter catch 400-5 is attached to each guide rib 400-4 and a return rib 400-30 extends substantially perpendicular from each guide rib 400-4 and shutter catch 400-5. The guide member also includes a plurality of stand-off elements 400-6, anti-probing walls 400-10 and 400-20, and 400-51.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. There is no intention to limit the invention to the specific form or forms disclosed, but on the contrary, the intention is to cover all modifications, alternative constructions, and equivalents falling within the spirit and scope of the invention, as defined in the appended claims. It is, therefore, to be understood that the foregoing embodiments are presented by way of example only and that, within the scope of the appended claims and equivalents thereto; inventive embodiments may be practiced otherwise than as specifically described and claimed.

All references, including publications, patent applications, and patents, cited herein are hereby incorporated by reference to the same extent as if each reference were individually and specifically indicated to be incorporated by reference and were set forth in its entirety herein.

All definitions, as defined and used herein, should be understood to control over dictionary definitions, definitions in documents incorporated by reference, and/or ordinary meanings of the defined terms.

The use of the terms "a" and "an" and "the" and similar referents in the context of describing the invention (especially in the context of the following claims) are to be construed to cover both the singular and the plural, unless otherwise indicated herein or clearly contradicted by context.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An electrical device comprising:

a housing including a front cover coupled to at least one body member, the front cover including a plurality of receptacle openings in a major front surface thereof wherein the major front surface is substantially rectangular shaped, the plurality of receptacle openings being configured to receive a plurality of plug blades of a corded electrical plug, the at least one body member including at least one set of receptacle contacts including a hot receptacle contact and a neutral receptacle contact;

a guidance structure corresponding to the at least one set of receptacles coupled to the front cover, the guidance structure including a first guidance portion and a second guidance portion; and a shutter assembly including a first shutter portion coupled to a second shutter portion, the first shutter portion being coupled to the first guidance portion in a return position when not engaged by an object and rotatable about the first guidance portion from the return position to a shutter blocking position in response to being engaged by the object via one of the plurality of receptacle openings, the object being prevented from obtaining access to the at least one set of receptacle contacts in the blocking position, the first shutter portion substantially preventing the second shutter portion from moving in the return position or the blocking position, the first shutter portion being translated from the return position on the first guidance portion to an open position on the second guidance portion in response to being engaged by the plurality of plug blades, the first shutter portion allowing the second shutter portion to move from a closed second shutter position to an open second shutter position in the open position, the first shutter portion being coupled to the guidance structure so that the first shutter portion rotationally self-aligns to the plurality of plug blades when the shutter element is translated from the return position to the open position.

2. The device of claim 1, wherein the first shutter portion is configured to rotate while being translated in two-dimensions from the return position to the open position, each of the two dimensions being orthogonal to a first dimensional axis, the first shutter portion allowing the second shutter portion to move in a direction parallel to the first dimensional axis when the first shutter portion is in the open position.

3. The device of claim 1, wherein the first shutter portion includes an elongated portion configured and positioned to prevent movement of the second shutter portion from the closed second shutter position to the open second shutter position when the first shutter portion is in the return position or the blocking position.

4. The device of claim 3, wherein the second shutter portion further comprises a cam portion configured to be engaged by the elongated portion, and wherein the elongate portion is configured and positioned to engage the cam portion so that the second shutter assembly is repositioned to the closed second shutter position when the first shutter portion is translated from the open position to the return position.

5. The device of claim 1, wherein the guidance structure includes a pivot region disposed between the first guidance portion and the second guidance portion.

6. The device of claim 5, wherein the first shutter portion is configured to rotate about the pivot region in the blocking position.

7. The device of claim 6, wherein the first shutter portion is configured move from the return position to the open position via the pivot position when the first shutter portion is engaged by the plurality of plug blades.

8. The device of claim 1, wherein the first shutter portion includes an aperture configured to allow one of the plurality of plug blades to pass through in the open position.

9. The device of claim 1, wherein the shutter assembly includes a spring configured to bias the first shutter portion in the return position, and wherein the spring is selected from a group of springs that include a torsion spring or a compression spring.

10. The device of claim 9, wherein the first shutter portion is configured to apply a rotational force to the compression spring when the first shutter portion moves from the return position to the open position.

11. The device of claim 1, wherein the guidance structure is an integrally molded feature of an interior surface of the front cover.

12. The device of claim 1, wherein the guidance structure is configured to be inserted in an interior surface of the front cover.

13. The device of claim 1, wherein the housing includes a wiring device housing, a duplex receptacle housing, a decorator housing, an extension cord housing, a multiple outlet strip housing, a combination receptacle and switch housing.

14. The device of claim 1, further including a protection circuit, a ground fault circuit interrupter, an arc fault circuit interrupter, or a surge protective device.

15. The device of claim 1, wherein the second shutter portion further comprises a stationary guide member configured to be disposed in the front cover and a second shutter element configured to be linearly moveable within the stationary guide member.

16. The device of claim 15, wherein the second shutter portion includes a blocking cam and a plug blade cam disposed obliquely relative to the blocking cam.

17. The device of claim 16, wherein the first shutter portion includes an elongated finger configured to engage the blocking cam in the return position or the blocking position so that the second shutter element is prevented from moving linearly within the stationary guide member.

18. The device of claim 16, wherein the plug blade cam is configured to engage a portion of a 20 A neutral plug blade so that the second shutter element moves linearly within the stationary guide member in the open position.

19. The device of claim 1, wherein two surface of the first shutter portion bear against the guidance structure in the blocking position.

20. A shutter assembly comprising:

a rail shaped guidance structure configured to allow a first shutter element to move between a plurality of positions including a return position, at least one blocking position and an open position;

a first shutter assembly including the first shutter element coupled to the guidance structure, the first shutter element being configured to rotate within a predetermined angular range while being translated in two-dimensions between the return position to the open position, each of the two dimensions being orthogonal to a first dimensional axis;

a second shutter assembly including a second shutter element coupled to the first shutter element, the first shutter element allowing the second shutter element to move in a direction parallel to the first dimensional axis in a first direction when the first shutter element is being translated into the open position, the first shutter element being configured to drive the second shutter element in a direction parallel to the first dimensional axis in a second direction when the first shutter element is being translated into the return position.

21. The assembly of claim 20, further comprising a stationary guide member, and wherein the second shutter element is configured to be linearly moveable within the stationary guide member.

22. The assembly of claim 21, wherein the second shutter element includes a blocking cam and a plug blade cam disposed obliquely relative to the blocking cam.

23. The assembly of claim 22, wherein the first shutter portion includes an elongated finger configured to engage the blocking cam in the return position or the blocking position so that the second shutter element is prevented from moving linearly within the stationary guide member.

24. The assembly of claim 23, wherein the plug blade cam is configured to engage a portion of a 20 A neutral plug blade so that the second shutter element moves linearly within the stationary guide member in the open position.

25. The assembly of claim 20, wherein the guidance structure is formed in a front cover of an electrical wiring device.

26. The assembly of claim 20 wherein the guidance structure further comprises a stationary guide member configured to accommodate the first shutter element and the second shutter element.

27. The assembly of claim 20, wherein the guidance structure includes a pivot region disposed between a first guidance portion and a second guidance portion.

28. The assembly of claim 20, wherein the shutter assembly includes a spring configured to bias the first shutter element in the return position, and wherein the spring is selected from a group of springs that include a torsion spring or a compression spring.

29. The assembly of claim 28, wherein the first shutter element is configured to apply a rotational force to the compression spring when the first shutter element moves from the return position to the open position.

30. The assembly of claim 20, wherein the guidance structure includes at least one guide rib and the first shutter element is coupled to the at least one guide rib by way of two bearing surfaces when in the at least one blocking position.

31. An electrical device comprising:

a housing including a front cover coupled to at least one body member, the front cover including a plurality of receptacle openings in a major front surface thereof, the plurality of receptacle openings being configured to receive a plurality of plug blades of a corded electrical plug, the at least one body member including at least one set of receptacle contacts including a hot receptacle contact, a neutral receptacle contact, and a ground contact;

a guidance structure corresponding to the at least one set of receptacles coupled to the front cover, the guidance structure including a first guidance portion and a second guidance portion; and a shutter assembly including a first shutter portion coupled to a second shutter portion, the first shutter portion being coupled to the first guidance portion in a return position when not engaged by an object and rotatable about the first guidance portion from the return position to a shutter blocking position in response to being engaged by the object via one of the plurality of receptacle openings, the object being prevented from obtaining access to the at least one set of receptacle contacts in the blocking position, the first shutter portion substantially preventing the second shutter portion from moving in the return position or the blocking position, the first shutter portion being translated from the return position on the first guidance portion to an open position on the second guidance portion in response to being engaged by the plurality of plug blades, the first shutter portion allowing the second shutter portion to move from a closed second shutter position to an open second shutter position in the open position, the first shutter portion being coupled to the guidance structure so that the first shutter portion rotationally self-aligns to the plurality of plug blades when the shutter element is translated from the return position to the open position.

32. The device of claim 31, wherein the first shutter portion is configured to rotate while being translated in two-dimensions from the return position to the open position, each of the two dimensions being orthogonal to a first dimensional axis, the first shutter portion allowing the second shutter portion to move in a direction parallel to the first dimensional axis when the first shutter portion is in the open position.

33. The device of claim 31, wherein the first shutter portion includes an elongated portion configured and positioned to prevent movement of the second shutter portion from the closed second shutter position to the open second shutter position when the first shutter portion is in the return position or the blocking position.

34. The device of claim 33, wherein the second shutter portion further comprises a cam portion configured to be engaged by the elongated portion, and wherein the elongate portion is configured and positioned to engage the cam portion so that the second shutter assembly is repositioned to the closed second shutter position when the first shutter portion is translated from the open position to the return position.

35. The device of claim 31, wherein the guidance structure includes a pivot region disposed between the first guidance portion and the second guidance portion.

36. The device of claim 35, wherein the first shutter portion is configured to rotate about the pivot region in the blocking position.

37. The device of claim 36, wherein the first shutter portion is configured move from the return position to the open position via the pivot position when the first shutter portion is engaged by the plurality of plug blades.

38. The device of claim 31, wherein the first shutter portion includes an aperture configured to allow one of the plurality of plug blades to pass through in the open position.

39. The device of claim 31, wherein the shutter assembly includes a spring configured to bias the first shutter portion in the return position, and wherein the spring is selected from a group of springs that include a torsion spring or a compression spring.

40. The device of claim 39, wherein the first shutter portion is configured to apply a rotational force to the compression spring when the first shutter portion moves from the return position to the open position.

41. The device of claim 31, wherein the guidance structure is an integrally molded feature of an interior surface of the front cover.

42. The device of claim 31, wherein the guidance structure is configured to be inserted in an interior surface of the front cover.

43. The device of claim 31, wherein the housing includes a wiring device housing, a duplex receptacle housing, a decorator housing, an extension cord housing, a multiple outlet strip housing, a combination receptacle and switch housing.

44. The device of claim 31, further including a protection circuit, a ground fault circuit interrupter, an arc fault circuit interrupter, or a surge protective device.

45. The device of claim 31, wherein the second shutter portion further comprises a stationary guide member configured to be disposed in the front cover and a second shutter element configured to be linearly moveable within the stationary guide member.

46. The device of claim 45, wherein the second shutter portion includes a blocking cam and a plug blade cam disposed obliquely relative to the blocking cam.

47. The device of claim 46, wherein the first shutter portion includes an elongated finger configured to engage the blocking cam in the return position or the blocking position so that the second shutter element is prevented from moving linearly within the stationary guide member.

48. The device of claim 46, wherein the plug blade cam is configured to engage a portion of a 20 A neutral plug blade so that the second shutter element moves linearly within the stationary guide member in the open position.

49. The device of claim 31, wherein two surface of the first shutter portion bear against the guidance structure in the blocking position.

* * * * *